US012745863B2

(12) United States Patent
Choi et al.

(10) Patent No.: US 12,745,863 B2
(45) Date of Patent: Sep. 29, 2026

(54) SHOE CARE DEVICE

(71) Applicant: LG ELECTRONICS INC., Seoul (KR)

(72) Inventors: Kyoung Min Choi, Seoul (KR); Young Jae Lee, Seoul (KR); Tae Yong Jung, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 87 days.

(21) Appl. No.: 18/718,624

(22) PCT Filed: Dec. 2, 2022

(86) PCT No.: PCT/KR2022/019476
§ 371 (c)(1),
(2) Date: Jun. 11, 2024

(87) PCT Pub. No.: WO2023/113322
PCT Pub. Date: Jun. 22, 2023

(65) Prior Publication Data

US 2025/0040733 A1 Feb. 6, 2025

(30) Foreign Application Priority Data

Dec. 17, 2021 (KR) ..... 10-2021-0181150
May 3, 2022 (KR) ..... 10-2022-0055068
(Continued)

(51) Int. Cl.
*A47F 7/08* (2006.01)
*A47F 3/00* (2006.01)

(52) U.S. Cl.
CPC ..... *A47F 7/08* (2013.01); *A47F 3/001* (2013.01); *A47F 3/005* (2013.01)

(58) Field of Classification Search
CPC ..... A47F 3/001; A47F 3/005; A47F 3/063; A47F 7/08; A47F 23/205
See application file for complete search history.

(56) References Cited

U.S. PATENT DOCUMENTS 4,269,461 A * 5/1981 Roach, Jr. ..... B65D 85/42 312/111
5,016,364 A * 5/1991 Cochrane ..... F26B 9/066 34/195
(Continued)

FOREIGN PATENT DOCUMENTS

CN 1848884 A 7/2005
CN 210227596 U 4/2020
(Continued)

*Primary Examiner* — James O Hansen
(74) *Attorney, Agent, or Firm* — Birch, Stewart, Kolasch & Birch, LLP

(57) ABSTRACT

A shoe care device provided with an accommodation space inside which shoes are accommodated includes a body; a movable body which forms the accommodation space together with the body and is coupled to the body so as to be slidable between a first position and a second position prior to the first position; a blowing part configured to circulate air in the accommodation space; and a frame body coupled to the body so as to support the body, in a form of connecting the upper surface, the lower surface, and the rear surface of the body.

18 Claims, 74 Drawing Sheets

(30) Foreign Application Priority Data

Sep. 1, 2022 (KR) ..... 10-2022-0110941
Oct. 18, 2022 (KR) ..... 10-2022-0134250

(56) References Cited

U.S. PATENT DOCUMENTS

| | | | | | |
|---|---|---|---|---|---|
| 5,165,181 | A * | 11/1992 | Acosta, Sr. | A47L 23/205 | 34/104 |
| 5,245,841 | A * | 9/1993 | Paul | F25D 23/006 | 62/344 |
| 9,836,910 | B1 * | 12/2017 | Pierre | A47F 3/063 | |
| 2008/0173631 | A1 * | 7/2008 | Gagas | A47J 36/2483 | 219/400 |
| 2011/0000098 | A1 * | 1/2011 | Karafinka | A47L 23/205 | 34/239 |
| 2018/0127150 | A1 | 5/2018 | Adanur et al. | | |
| 2021/0220496 | A1 * | 7/2021 | An | A61L 2/26 | |

FOREIGN PATENT DOCUMENTS

| | | | |
|---|---|---|---|
| CN | 113287871 | A | 8/2021 |
| JP | 8-35769 | A | 2/1996 |
| JP | 2558033 | Y2 | 12/1997 |
| JP | 2010-156173 | A | 7/2010 |
| JP | 3186097 | U | 9/2013 |
| JP | 2016-216070 | A | 12/2016 |
| JP | 2017-77389 | A | 4/2017 |
| KR | 10-2000-0009653 | A | 2/2000 |
| KR | 20-0438015 | Y1 | 1/2008 |
| KR | 10-2010-0104292 | A | 9/2010 |
| KR | 10-1091716 | B1 | 12/2011 |
| KR | 10-2013-0034367 | A | 4/2013 |
| KR | 10-2014-0107876 | A | 9/2014 |

* cited by examiner

SHOE CARE DEVICE

CROSS REFERENCE TO RELATED APPLICATIONS

This application is the National Phase of PCT International Application No. PCT/KR2022/019476, filed on Dec. 2, 2022, which claims priority under 35 U.S.C. 119(a) to Patent Application Nos. 10-2021-0181150, 10-2022-0055068, 10-2022-0110941, and 10-2022-0134250, filed in the Republic of Korea on Dec. 17, 2021, May 3, 2022, Sep. 1, 2022, and Oct. 18, 2022, respectively, all of which are hereby expressly incorporated by reference into the present application.

TECHNICAL FIELD

The present invention relates to a shoe care device, and more particularly, to a shoe care device that manages and displays an article stored therein.

BACKGROUND ART

Only when shoes should be properly kept, the shoes can be worn for a long time without breaking the shape of the shoes. When the shoes are stacked in layers, the shape can be deformed. In general, a shoes cabinet is used for organization and keeping of the shoes.

In recent years, people who collect shoes of popular brands as part of hobby or financial tech have appeared, and a show case has been disclosed which is configured to keep and display the shoes.

US Patent Publication No. 2018-0127150 (hereinafter, referred to as 'Prior Art Document 1'), entitled, "Modular storage container", discloses a modular storage container including a housing, a door panel, a fan, and a light source.

According to Prior Art Document 1 above, the housing has a rectangular parallelepiped box shape having an opening on a front surface thereof. The housing has an accommodation space therein. The door panel opens/closes the opening of the housing, and is configured to be transparent or translucent.

In Prior Art Document 1 above, the fan is installed on a rear panel of the housing. When the fan rotates, air in the accommodation space is ventilated to outside air. An air duct is formed in the housing for an air flow between the outside air and the accommodation space. The light source is installed in an upper panel and illuminates the accommodation space.

According to Prior Art Document 1 above, since internal air of the container is configured to be ventilated to the outside air, a possibility that an internal environment (temperature and humidity) of the container will be influenced by an external environment (temperature and humidity) of the container increases. That is, it may be difficult to control the internal temperature and humidity of the container.

For example, according to Prior Art Document 1 above, since the internal air of the container is just ventilated to the outside air, the humidity of the accommodation space can be continuously maintained when the humidity of the outside air is high like the rainy season. The air may change a color and a shape of the shoe stored in the container, and act to cause the shoe to be contaminated by mold and bacteria which are easy to breed at high temperature and humidity.

As such, in that Prior Art Document 1 above does not consider a technology of maintaining the internal temperature and humidity of the container in an optimal state, there is a risk of deformation or contamination of the shoe in the process of using the container by a user.

Further, according to Prior Art Document 1 above, the inside of the container can be viewed only through a door panel, and the inside of the container cannot be viewed at a left side or a right side of the container, so there is a limit in increasing a display effect of the shoe.

In relation to a technology of displaying the shoes for a commercial purpose, Korean Patent Unexamined Publication No. 2013-0034367 (hereinafter, referred to as 'Prior Art Document 2') discloses a show case having transmissive display, and the resulting case is configured to include a show case body, a transparent display means, a turntable, a touch panel, and an LED.

The show case body has a space capable of storing products such as the shores therein. The transparent display means is installed on a front surface of the showcase body. The products are seated on the turntable, and rotate inside the show case body by the rotation of the turntable. The LED illuminates the products inside the show case body.

However, in that Prior Art Document 2 above does not consider a technology of controlling the internal temperature and humidity of the show case, there is a risk of deformation or contamination of the shoe in a state in which the shoe is stored inside the show case.

Further, according to Prior Art Document 2 above, the inside of the show case can be viewed only through the transparent display means, and the inside of the show case cannot be viewed at the left side or the right side of the show case, so there is a limit in increasing the display effect of the shoe.

Korean Patent Unexamined Publication No. 10-2000-0009653 (hereinafter, referred to as 'Prior Art Document 3') discloses a shoes cabinet for the sanitization, and the resulting shoes cabinet is configured to include a body, an infrared radiation unit, a circulation fan, an air circulation passage, a sanitization filter unit, etc.

Prior Art Document 3 above discloses that the shoes are dehumidified, sanitized, and deodorized by far infrared rays and filters while storing the shoes.

However, according to Prior Art Document 3 above, the shoes cannot be displayed.

As described above, conventional devices that accommodate the shoes therein have a limit in the care of the shoes and the display of the shoes.

As a result, in the development of a shoe care device, considering whether the display effect of the shoes can be maximized while constantly maintaining an environment of an internal space (hereinafter, referred to as 'accommodation space') of the shoe care device, whether the accommodation space can be easily opened and closed, whether the shoes can be effectively stored and withdrawn in a state in which the accommodation space is opened, whether structural stability of the shoe care device can be ensured in a state in which the accommodation space is maximally opened, etc., is required.

Moreover, it should be considered whether structural rigidity of a lowest shoe care device can be maintained for a long period even though the shoe care devices are stacked in multiple layers, whether electrical stability can be effectively guaranteed even though the shoe care device is used for a long period, whether an interior effect by the shoe care device can be maximized in addition to the display effect of the shoe, whether internal components are appropriately arranged in a limited space, whether use convenience is excellent, etc., should also be considered, and the development of the shoe care device considering all of the points is required.

DISCLOSURE

Technical Problem

An object of the present invention is to provide the problems of the shoe care device accommodating shoes therein.

Specifically, an object of the present invention is to provide a shoe care device which simultaneously achieves a shoe display effect of displaying shoes and a shoe care effect of interrupting deformation or contamination of the shoes to meet needs of a user who intends to continuously keep and maintain the shoes in a best state.

Further, an object of the present invention is to provide a shoe care device of a structure which can easily open and close an accommodation space accommodating the shoes to effectively store and withdraw the shoes in a state in which the accommodation space is opened.

Further, an object of the present invention is to provide a shoe care device in which a part having a relatively vulnerable rigidity is reinforced in a structure of the shoe care device to stably perform an intrinsic function stably without deformation or damage.

Further, the present invention provides a shoe care device of a structure which can manage the shoes by controlling air in a space accommodating the shoes, and at the same time, can expose the item in various directions as possible to excellently display the shoes.

The present invention provides a shoe care device of a structure which can minimize display performance of the shoes by a dropping prevention structure while forming a structure capable of drooping of an upper body which extends forward from an upper side of a middle body in a shoe care device in which a moving body including a transparent window in which three surfaces are transparent moves with respect to a body.

Further, the present invention provides a shoe care device of a structure which can prevent aesthetics lowering of the shoe care device by exposure of a flexible portion hole even though a flexible portion hole through a front frame passes is formed on a base on which the shoes are placed.

Further, the present invention provides a shoe care device of a structure in which a plurality of shoe care devices are stacked vertically, a stacking structure of the shoe care devices can be stably maintained while a structure capable of completely interrupting drooping of the upper body by weights of the stacked shoe care devices is formed.

Technical objects to be achieved by the present invention are not limited to the aforementioned technical objects, and other technical objects not described above may be evidently understood by a person having ordinary skill in the art to which the present invention pertains from the following description.

Technical Solution

In order to solve the or another problem, a shoe care device according to is configured to display shoes in a state of being blocked from the outside by accommodating the shoes in an accommodation space, and appropriately maintain an environment of the accommodation space. Specifically, after the shoes are accommodated in the accommodation space formed by both a body and a moving body, an opened state is switched to a closed state to display the shoes and at the same time, air in the accommodation space is circulated through a blowing part to adjust the state of the accommodation space.

Further, the shoe care device according to an aspect of the present invention is configured in which the accommodation space may be easily opened and closed by relative movement of components forming the accommodation space. Specifically, the moving body coupled to the body to be slidably movable moves between a first location and a second location, and opens and closes the accommodation space.

Further, in the shoe care device according to an aspect of the present invention, a reinforcing member is coupled to a portion where a rigidity is relatively vulnerable in terms of a structure. Specifically, a frame body is coupled to the body and supports the body in a shape of connecting an upper surface, a lower surface, and a rear surface of the body.

Further, in the shoe care device according to an aspect of the present invention, a heating part heats air in the accommodation space to adjust the state of the accommodation space.

Further, in the shoe care device according to an aspect of the present invention, the body may include an upper body, a lower body, and a middle body, and the moving body may include a base and a transparent window.

Further, in the shoe care device according to an aspect of the present invention, the frame body may include an upper frame, a lower frame, and a middle frame.

Further, in the shoe care device according to an aspect of the present invention, the frame body including the upper frame, the lower frame, and the middle frame may be formed by bending one member which is formed to extend in a longitudinal direction.

Further, in the shoe care device according to an aspect of the present invention, the frame body may be formed in a form of cutting a part of a flange in C channel steel, and bending a part of a web.

Further, in the shoe care device according to an aspect of the present invention, the frame body may be formed in a structure in which the lower frame, and the middle frame, a fastening member is fastened to a flange portion overlapped after bending the web.

Further, in the shoe care device according to an aspect of the present invention, the frame body may be formed in a structure in which the lower frame, and the middle frame, the flange portion overlapped after bending the web is coupled by welding.

Further, in the shoe care device according to an aspect of the present invention, the frame body may be placed not to be exposed to the outside.

Further, in the shoe care device according to an aspect of the present invention, a plurality of frame bodies may be placed to reinforce the body in a horizontal direction of the body.

Further, in the shoe care device according to an aspect of the present invention, a turntable may be placed on the bottom of the accommodation space and rotate around a vertical axis.

Further, in the shoe care device according to an aspect of the present invention, a rotational axis of the turntable may be positioned at the front more than a front end portion of the body in the opened state.

Further, in the shoe care device according to an aspect of the present invention, a stopping part may limit sliding movement of the moving body to the body not to exceed the second location.

In order to solve the or another problem, in the shoe care device according to an aspect of the present invention, the frame body may be formed by die casting. The frame body may be made of an aluminum die cast (ALDC) material.

Further, in the shoe care device according to an aspect of the present invention, the upper frame may include an upper extension portion and an upper connection portion.

Further, in the shoe care device according to an aspect of the present invention, the upper connection portion may be formed to be long in the front and rear direction.

Further, in the shoe care device according to an aspect of the present invention, the upper connection portion may include the rear side of the upper extension portion and the middle body. A vertical width of the upper connection portion may increase rearward.

Further, in the shoe care device according to an aspect of the present invention, the lower frame may include a lower extension portion and a lower connection portion.

Further, in the shoe care device according to an aspect of the present invention, the lower extension portion may be formed to be long in the front and rear direction.

Further, in the shoe care device according to an aspect of the present invention, the lower connection portion may include the rear side of the lower extension portion and the middle body. The vertical width of the lower connection portion may increase rearward.

Further, in the shoe care device according to an aspect of the present invention, the upper frame may extend to the front more than the lower frame. Therefore, drooping of a front end of the upper body may be minimized.

Further, in the shoe care device according to an aspect of the present invention, a location where the upper frame is coupled to the upper body may be positioned at the front more than a location where the lower frame is coupled to the lower body. Therefore, drooping of a front end of the upper body may be minimized.

Further, in the shoe care device according to an aspect of the present invention, the upper frame may have the vertical width larger than a horizontal width.

Further, in the shoe care device according to an aspect of the present invention, the horizontal width of the middle frame may be larger than the horizontal width of the upper frame.

Further, in the shoe care device according to an aspect of the present invention, the vertical width of the upper connection portion may increase downward rearward.

Further, in the shoe care device according to an aspect of the present invention, the vertical width of the lower connection portion may increase upward rearward.

In order to solve the or another problem, the shoe care device according to an aspect of the present invention may include a front frame. The front frame may support the upper body by connecting the lower body and the upper body at the front of the body.

Further, in the shoe care device according to an aspect of the present invention, the front frame may include a first front frame and a second front frame.

Further, in the shoe care device according to an aspect of the present invention, the first front frame may be positioned at a shortest distance from a corner portion where the first window and the second window meet at the first location.

Further, in the shoe care device according to an aspect of the present invention, the second front frame may be positioned at a shortest distance from a corner portion where the first window and the third window meet at the first location.

Further, in the shoe care device according to an aspect of the present invention, the base may be coupled to the lower side of the transparent window. The shoes may be placed at the upper side of the base.

Further, in the shoe care device according to an aspect of the present invention, a flow portion hole through which the front frame passes in the vertical direction may be formed in the base. The flow portion hole may include a first flow portion hole and a second flow portion hole.

Further, in the shoe care device according to an aspect of the present invention, the first front frame may pass through the first flow portion hole in the vertical direction. The second front frame may pass through the second flow portion hole in the vertical direction.

Further, in the shoe care device according to an aspect of the present invention, the first flow portion hole and the second flow portion hole may be positioned at opposite sides to each other based on the turntable.

Further, in the shoe care device according to an aspect of the present invention, based on the moving body, the front frame may relatively move forward and backward along the flow portion hole between the first location and the second location.

Further, in the shoe care device according to an aspect of the present invention, the moving body may include a flip cover and an elastic member.

Further, in the shoe care device according to an aspect of the present invention, the flip cover may be rotatably coupled to the bottom of the base.

Further, in the shoe care device according to an aspect of the present invention, the elastic member may rotate the flip cover so that the flip cover covers the flow portion hole.

Further, in the shoe care device according to an aspect of the present invention, the flip cover may be pushed by the front frame between the first location and the second location, and rotated to open the flow portion hole.

Further, in the shoe care device according to an aspect of the present invention, the flip cover may include a first inclination portion, a second inclination portion, and a cover portion.

Further, in the shoe care device according to an aspect of the present invention, the first inclination portion may be pushed by the front frame, and rotated to open the flow portion hole when the moving body moves forward at the first location.

Further, in the shoe care device according to an aspect of the present invention, the second inclination portion may be pushed by the front frame, and rotated to open the flow portion hole when the moving body moves forward at the second location.

Further, in the shoe care device according to an aspect of the present invention, the cover portion may connect the first inclination portion and the second inclination portion. The cover portion may cover the flow portion hole at the first location and the second location.

Further, in the shoe care device according to an aspect of the present invention, the rotational axis of the flip cover may be in line with the front and rear direction.

Further, in the shoe care device according to an aspect of the present invention, the first inclination portion and the second inclination portion may be in contact with the front frame below the rotational axis of the flip cover.

Further, in the shoe care device according to an aspect of the present invention, the contact surface of the first inclination portion which contacts the front frame may be distant from the rotational axis of the flip cover as going rearward.

Further, in the shoe care device according to an aspect of the present invention, the contact surface of the second inclination portion which contacts the front frame may be distant from the rotational axis of the flip cover as going forward.

Alternatively, in order to solve another problem, a shoe care device assembly according to an aspect of the present invention may include a shoe care device and a rear bracket.

Further, in the shoe care device assembly according to an aspect of the present invention, the shoe care device may include a first shoe care device and a second care device. The second shoe care device may be stacked on the top of the first shoe care device.

Further, in the shoe care device assembly according to an aspect of the present invention, the rear bracket may connect rear surfaces of the first shoe care device and the second shoe care device.

Further, in the shoe care device assembly according to an aspect of the present invention, the rear bracket may include a first coupling portion, a second coupling portion and a rear connection portion.

Further, in the shoe care device assembly according to an aspect of the present invention, the first coupling portion may be coupled to the rear surface of the first shoe care device. In addition, the second coupling portion may be coupled to the rear surface of the first shoe care device.

Further, in the shoe care device assembly according to an aspect of the present invention, the rear connection portion may connect the first coupling and the second coupling portion in a vertical direction. The rear connection portion may be formed by bending one member formed to extend in the vertical direction.

Solving means of technical objects to be achieved by the present invention are not limited to the aforementioned solving means, and other solving means not described above may be evidently understood by a person having ordinary skill in the art to which the present invention pertains from the following description.

Advantageous Effects

Effects of the shoe care device according to the present invention will be described below.

According to at least one of embodiments of the present invention, since the shoes are displayed by switching to a closed state after accommodating the shoes in an accommodation space in which both a body and a moving body are formed, and at the same time, a state of the accommodation space is adjusted by circulating air in the accommodation space through a blowing part, a shoe display effect and a shoe care effect can be effectively implemented at the same time.

Further, according to at least one of embodiments of the present invention, in the display device according to the exemplary embodiment, since the accommodation space is opened and closed while the moving body slidably coupled to the body moves between the first location and the second location, the shoe may be effectively stored and withdrawn.

Further, according to at least one of embodiments of the present invention, since a frame body is coupled to the body in a shape of connecting an upper surface, a lower surface, and a rear surface of the body to support the body, the shoe care device can maintain a stable state by reinforcing a structurally vulnerable part in the body.

Further, according to at least one of embodiments of the present invention, since a state of the accommodation space is adjusted by heating the air in the accommodation space through a heating part, the shoes can be more effectively cared by appropriately maintaining an environment of the accommodation space.

Further, according to at least one of embodiments of the present invention, since the body includes the upper body, the lower body, and the middle body, and the moving body is configured to include the base and the transparent window, a connection structure of the body and the moving body can be stably maintained in a sliding movement process of the moving body with respect to the body.

Further, according to at least one of embodiments of the present invention, since the frame body is configured to include an upper frame, a lower frame, and a middle frame, the vulnerable part of the body can be reinforced in the structure of connecting the upper body, the lower body, and the middle body.

In this case, in that the frame body is concentratedly placed on a rear surface of the body to support the body, an overall center of gravity can move backward by the frame body, so stress can be prevented from being concentrated on a front surface portion of the upper body of the shoe care device positioned below even though the plurality of shoe care devices are stacked on each other.

Further, according to at least one of embodiments of the present invention, since the frame body including the upper frame, the lower frame, and the middle frame may be formed by bending one member which is formed to extend in a longitudinal direction, the frame body can be easily manufactured, and the cutting surface of the frame body corresponding to the reinforcing member can be minimized.

Further, according to at least one of embodiments of the present invention, since the frame body may be formed in a form of cutting a part of a flange in C channel steel, and bending a part of a web, the rigidity of the one C-channel steel frame body can be more largely formed.

Further, according to at least one of embodiments of the present invention, since the frame body may be formed in a structure in which the lower frame, and the middle frame, a fastening member is fastened to a flange portion overlapped after bending the web, the bent portion of the C channel steel can be prevented from being structurally vulnerable.

Further, according to at least one of embodiments of the present invention, since the frame body may be formed in a structure in which the lower frame, and the middle frame, the flange portion overlapped after bending the web is coupled by welding, the bent portion of the C channel steel can be prevented from being structurally vulnerable.

Further, according to at least one of embodiments of the present invention, Since the frame body is placed not to be exposed to the outside, the aesthetics can be visually provided by minimizing the exposure of a member not directly related to the function of the shoe care device.

Further, according to at least one of embodiments of the present invention, since a plurality of frame bodies may be placed to reinforce the body in a horizontal direction of the body, the structural reinforcing for the body may be uniformly and stably achieved.

Further, according to at least one of embodiments of the present invention, since the turntable is placed on the bottom of the accommodation space and rotates around the vertical axis, the shoe may be rotated and displayed, and the air flow is made in various directions of the shoe, thereby achieving the uniform care throughout the shoe.

Further, according to at least one of embodiments of the present invention, since a rotational axis of the turntable may be positioned at the front more than a front end portion of the body in the opened state, opening enough to store and withdrawn the shoe can be achieved while maintaining the stable state in the opening process of the accommodation space.

Further, according to at least one of embodiments of the present invention, since a stopping part may limit sliding movement of the moving body to the body not to exceed the second location, the separation of the body and the moving body or occurrence of reversal depending on a change in center of gravity can be prevented when the moving body excessively moves for the opened state.

According to at least one of embodiments of the present invention, since the frame body may be manufactured by an ALDC material in an integrated structure formed by die casting, each of the upper frame, the lower frame, and the middle frame may have a cross-sectional shape without a hollow. Therefore, each of the upper frame, the lower frame, and the middle frame may have high moment of inertia. Therefore, the total drooping amount of the upper body is reduced to interrupt the increase in opening force of the moving body even though the shoe care devices are stacked in multiple stages.

According to at least one of embodiments of the present invention, since the frame body may be manufactured by an ALDC material in an integrated structure formed by die casting, a connection portion between the upper frame and the middle frame, and a connection portion of the middle frame and the lower frame may secure the rigidity without bending processing or a separate fastening member. Therefore, the total drooping amount of the upper body is reduced to interrupt the increase in opening force of the moving body even though the shoe care devices are stacked in multiple stages.

According to at least one of embodiments of the present invention, the horizontal width of the middle frame may be larger than the horizontal width of the upper frame. Therefore, even though a front and rear width of the middle frame is formed to be equal to or less than the vertical width of the upper frame, the middle frame may have high moment of inertia resistant to drooping of the upper body and bending deformation of the middle body based on a neutral axis. Therefore, even though a second internal cabinet and a second external cabinet of the middle body have a small spacing distance in the front and rear direction, the middle frame may have high moment of inertia resistant to drooping of the upper body and bending deformation of the middle body based on a neutral axis.

According to at least one of embodiments of the present invention, the upper frame may include an upper extension portion and an upper connection portion. A vertical width of the upper connection portion may increase rearward. The bottom of the upper connection portion may be lowered at a constant slope rearwards. That is, the vertical width of the upper connection portion increases downward rearward. Therefore, the vertical width of the upper connection portion may increase at a constant slope rearward, and the center of figure of the upper connection portion may decrease at a constant slope rearward. Therefore, the upper connection portion may have a higher moment of inertia than the upper extension portion. In addition, the moment of inertia of the upper connection portion may increase rearwards. Therefore, the upper connection portion may have a high moment of inertia which is resistant to the drooping of the upper body based on the neutral axis. Further, the upper connection portion may have high rigidity which is resistant to the permanent deformation and breakage.

According to at least one of embodiments of the present invention, the upper frame may extend to the front more than the lower frame. In this case, a location where the upper frame is coupled to the upper body may be positioned at the front more than a location where the lower frame is coupled to the lower body. Therefore, in the state in which the front surface of the upper frame is spaced apart rearward from the front surface of the upper body, the upper frame and the upper body have a solid coupling force, to minimize the drooping of the front end of the upper body.

According to at least one of embodiments of the present invention, the lower frame may include a lower extension portion and a lower connection portion. The vertical width of the lower connection portion may increase rearward. The top of the lower connection portion may be raised at a constant slope rearward. That is, the vertical width of the lower connection portion may increase upward rearward. Therefore, the vertical width of the lower connection portion may increase at a constant slope rearward, and the center of figure of the lower connection portion may increase at a constant slope rearward. Therefore, the lower connection portion may have a higher moment of inertia than the lower extension portion. In addition, the moment of inertia of the lower connection portion may increase rearwards. Therefore, the lower connection portion may have a high moment of inertia which is resistant to the drooping of the upper body and the bending deformation of the middle body based on the neutral axis. Further, the lower connection portion may have high rigidity which is resistant to the permanent deformation and breakage.

According to at least one of embodiments of the present invention, an upper cover portion covering the upper connection portion may be formed at the upper portion of the second internal cabinet. The upper cover portion may be projected to cover the upper connection portion on the front surface of the second internal cabinet. The aesthetics reduction of the shoe care device by the exposure of the upper connection portion may be prevented by the upper cover portion.

According to at least one of embodiments of the present invention, a lower cover portion covering the lower connection portion may be formed at the rear of the third internal cabinet. The lower cover portion may be projected to cover the lower connection portion on the top of the third internal cabinet. The aesthetics reduction of the shoe care device by the exposure of the lower connection portion may be prevented by the lower cover portion.

According to at least one of embodiments of the present invention, a through hole may be formed in the third internal cabinet. A reinforcing rib may be formed in the third external cabinet. The reinforcing rib may be inserted into the through hole. The harness of the motor may enter the inside of the lower body through the through hole. The reinforcing rib is formed at a point where the harness of the motor enters the inside of the lower body to form the rigidity at the entrance point.

According to at least one of embodiments of the present invention, a fixation hook to which the harness of the motor is locked may be formed on the bottom of the base. The friction of the harness of the motor, and the resulting noise and damage may be prevented by the fixation hook.

According to at least one of embodiments of the present invention, the front frame may support the upper body based on the lower body at the front of the body. Therefore, a vertical gap of the lower body and the upper body may be maintained at the front of the body by the front frame. That is, the drooping phenomenon of the upper body may be interrupted by the front frame. Therefore, the body continuously maintains the 'C' shape on the side view, and as a result, the aesthetics reduction of the shoe care device by the drooping phenomenon of the upper body may be prevented. Further, the gap between the upper end of the transparent window and the upper body may be continuously maintained. Therefore, the increase in opening force of the moving body by the drooping of the upper body is interrupted, so the moving body may continuously maintain the same opening force between the first location and the second location.

According to at least one of embodiments of the present invention, the first front frame may connect the lower body and the upper body at the front of the left side of the body. The second front frame may connect the lower body and the upper body at the front of the right side of the body. Therefore, based on the lower body, each corner portion of the upper body may have the same height.

According to at least one of embodiments of the present invention, the length of the flow portion hole may be larger than the gap between the first location and the second location. In addition, the horizontal width of the flow portion hole may be larger than the diameter of the front frame. Therefore, in the process in which the moving body moves between the first location and the second location, the front frame may not be in contact with the base. Therefore, in the process in which the moving body moves between the first location and the second location, the increase in opening force of the moving body by interference between the front frame and the base may be interrupted. Therefore, the moving body may continuously maintain the same opening force between the first location and the second location.

According to at least one of embodiments of the present invention, the first front frame may be positioned at a shortest distance from the first window at the first location. In addition, the first front frame may form a predetermined distance from the second window between the first location and the second location. Therefore, the first front frame may be positioned at a shortest distance from the first curved surface portion where the first window and the second window meet at the first location. As the first front frame is positioned at a shortest distance from the first curved surface portion at the first location, when the vision of the user is positioned in a direction in which the X axis and the Y axis form an angle of approximately 45 degrees, the vision of the user may reach the first front frame through the first curved surface portion. That is, the first front frame may be observed through the first curved surface portion. Therefore, even though the first front frame is provided in the accommodation space, a visibility lowering phenomenon of the shoe by the first front frame may be minimized.

According to at least one of embodiments of the present invention, the second front frame may be positioned at a shortest distance from the first window at the first location. In addition, the second front frame may form a predetermined distance from the third window between the first location and the second location. Therefore, the second front frame may be positioned at a shortest distance from a corner portion where the first window and the third window meet, i.e., the second curved surface portion at the first location. As the second front frame is positioned at a shortest distance from the second curved surface portion at the first location, when the vision of the user is positioned in a direction in which the X axis and the Y axis form an angle of approximately 45 degrees, the vision of the user may reach the second front frame through the second curved surface portion. That is, the second front frame may be observed through the second curved surface portion. Therefore, even though the second front frame is provided in the accommodation space, a visibility lowering phenomenon of the shoe by the second front frame may be minimized.

According to at least one of embodiments of the present invention, the flip cover may be pushed by the front frame between the first location and the second location, and rotated to open the flow portion hole. Therefore, the lower side of the flow portion hole is just exposed through the flow portion hole only in the process of opening or closing the shoe care device, and the flow portion hole maintains the closed state by the flip cover at the first location and the second location of the moving body. Therefore, the environment of the accommodation space may be constantly maintained in the state of accommodating the shoes. Further, the aesthetics reduction of the shoe care device by the exposure of the top of the lower body may be prevented.

According to at least one of embodiments of the present invention, the contact surface of the first inclination portion which contacts the front frame may be distant from the rotational axis of the flip cover as going rearward. In addition, the contact surface of the second inclination portion which contacts the front frame may be distant from the rotational axis of the flip cover as going forward. Therefore, in the process in which the moving body moves between the first location and the second location, the flip cover gradually rotates to open and close the flow portion hole. Therefore, the flip cover is easily rotated, and as a result, the increase in opening force of the shoe care device by the rotation of the flip cover may be minimized.

According to at least one of embodiments of the present invention, when the first flip cover is rotated at 180 degrees around the Z axis, the first flip cover may be used as the second flip cover. Similarly to this, when the second flip cover is rotated at 180 degrees around the Z axis, the second flip cover may be used as the first flip cover. That is, the first flip cover and the second flip cover may be manufactured to have the same shape. Therefore, the flip cover is easily manufactured and assembled to minimize the increase in production cost and the increase in production man-hours.

According to at least one of embodiments of the present invention, the rolling screen may maintain a tightly stretched state below the flow portion hole by the elastic restoration force of the first clockwork and the second clockwork. Therefore, the rolling screen may cover the flow portion hole below the flow portion hole. The rolling screen may continuously maintain the state of covering the flow portion hole between the first location and the second location. Therefore, the environment of the accommodation space may be constantly maintained in the state of accommodating the shoes. Further, the aesthetics reduction of the shoe care device by the exposure of the top of the lower body may be prevented.

According to at least one of embodiments of the present invention, the rear bracket may include a first rear bracket and a second rear bracket. The first rear bracket may connect the first shoe care device and the second shoe care device on the left rear surface of the body. The second rear bracket may connect the first shoe care device and the second shoe care device on the right rear surface of the body. Therefore, a rear corner portion of the second care device may have the same height as the rear surface of the first shoe care device. Therefore, the first shoe care device and the second shoe care device continuously maintain a height difference on the bottom view, and as a result, the aesthetics reduction of the shoe care device by the drooping phenomenon of the upper body may be prevented. Further, the increase in opening force of the moving body by the drooping of the upper body is interrupted, so the moving body may continuously maintain the same opening force between the first location and the second location.

According to at least one of embodiments of the present invention, the rear bracket may be placed on the rear surface of the body. Since the rear bracket is placed not to be observed at the front of the transparent window, the aesthetics may be visually provided by minimizing the exposure of a member not directly related to the function of the shoe care device.

According to at least one of embodiments of the present invention, the rear bracket including the first coupling portion, the second coupling portion, and the rear connection portion may be formed by bending one member formed to extend in the longitudinal direction of the rear bracket. Therefore, the rear bracket can be easily manufactured, and the cutting surface of the rear bracket corresponding to the reinforcing member can be minimized.

An additional range of an applicability of the present invention will be apparent from the following detailed description. However, since various changes and modifications can be clearly appreciated by those skilled in the art within the spirit and the scope of the present invention, the detailed description and a specific embodiment such as a preferred embodiment of the present invention should be appreciated as being just given as an example.

DESCRIPTION OF DRAWINGS

FIG. 9*a* illustrates a state in which a path cover of the air path is separated.

FIG. 10*a* illustrates an air flow in the accommodation space while the front side of the shoe faces the front side in the first direction.

FIG. 10*b* illustrates the air flow in the accommodation space while the front side of the shoe faces the rear side in the second direction.

FIG. 12 does not illustrate the shoe.

MODES FOR THE INVENTION

Figure 1A:
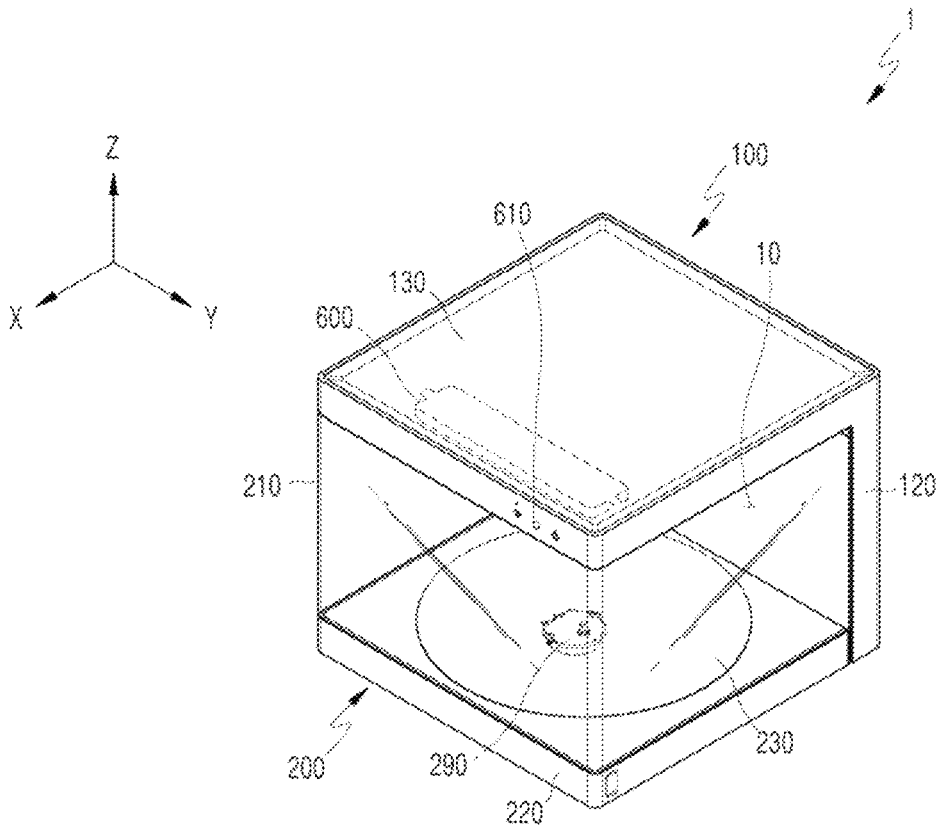
FIG. 1*a* is a perspective view illustrating a shoe care device according to an embodiment of the present invention.

Hereinafter, embodiments disclosed in this specification will be described in detail with reference to the accompanying drawings and the same or similar components are denoted by the same or similar reference numerals, and duplicated description thereof will be omitted. Suffixes "module" and "unit" for components used in the following description are given or mixed in consideration of easy preparation of the present invention only and do not have their own distinguished meanings or roles. Further, in describing the embodiment disclosed in this specification, a detailed description of related known technologies will be omitted if it is determined that the detailed description makes the gist of the embodiment disclosed in this specification unclear. Further, it is to be understood that the accompanying figures are just used for easily understanding the embodiments disclosed in this specification and a technical spirit disclosed in this specification is not limited by the accompanying figures and all changes, equivalents, or substitutes included in the spirit and the technical scope of the present invention are included.

Terms including an ordinary number, such as first and second, are used for describing various elements, but the elements are not limited by the terms. The terms are used only to discriminate one element from another element.

It should be understood that, when it is described that a component is "connected to" or "accesses" another component, the component may be directly connected to or access the other component or a third component may be present therebetween. In contrast, when it is described that a component is "directly connected to" or "directly accesses" another component, it is understood that no element is present between the element and another element.

A singular form includes a plural form if there is no clearly opposite meaning in the context.

In the present application, it should be understood that term "include" or "have" indicates that a feature, a number, a step, an operation, a component, a part or the combination thereof described in the specification is present, but does not exclude a possibility of presence or addition of one or more other features, numbers, steps, operations, components, parts or combinations thereof, in advance.

When the shoe is directly exposed to dust, water, heat, and/or sunshine, a fiber material of the shoe may be damaged over time, and a color and a form of the shoe may be changed.

In order to keep the shoe in an original state (e.g., a state of the shoe at the time of purchase or a state of a clean shoe) for a long time, the shoe should not be exposed much to light and the shoe should be kept at a place that is not too cold or hot. Further, the shoe needs to be kept at a place at which a temperature and a humidity are appropriately maintained.

Since the shoe made of a leather or suede material is easily colored or has mold, the shoe should be kept in an environment where temperature and humidity are appropriately maintained. A mothball acquired by solidifying pesticides and fragrances have a unique chemical smell that makes it difficult to remove because the smell permeates the shoe when the mothball is kept jointly with the shoe.

Further, when the shoes are stacked in layers, the form of the shoe may be changed by an applied load.

Meanwhile, as described above, in recent years, users who collect shoes of popular brands as part of a hobby or financial tech has increased, and the care of the shoe and the display of the shoe has become important needs of users.

Considering the points, a shoe care device according to an embodiment of the present invention is configured to safely keep the shoe, establish and adjust an environment (e.g., a predetermined range of temperature, humidity, etc.) required for each shoe, and effectively display the shoe, and increase use convenience of the user.

A first direction X, a second direction Y, and a third direction Z described in the embodiment of the present invention may be directions orthogonal to each other.

The first direction X and the second direction Y may be directions parallel to a horizontal direction, and the third direction Z may be a direction parallel to a vertical direction. When the first direction X is a direction parallel to the front and rear direction, the second direction Y may be a direction parallel to a left and right direction.

In describing embodiments of the present invention, except for a case which is particularly differently limited, the first direction X, the second direction Y, and the third direction Z may be appreciated as a front direction, a left direction, and an upper direction, respectively.

Figure 1B:
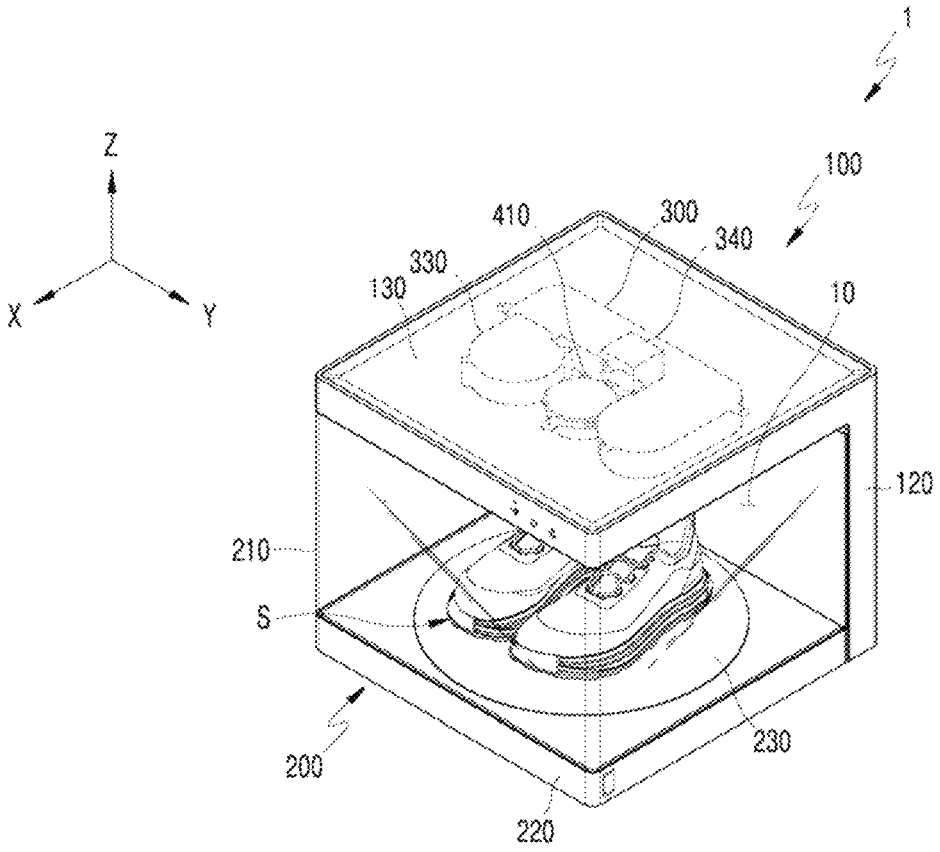
FIG. 1*b* is a perspective view illustrating a state in which an item is stored in an accommodation space of the shoe care device of FIG. 1*a*.

FIG. 1*a* is a perspective view illustrating a shoe care device 1 according to an embodiment of the present invention. FIG. 1*a* illustrates a state in which an internal space (hereinafter, referred to as 'accommodation space 10') of the shoe care device 1 is closed. FIG. 1*b* is a perspective view illustrating a state in which a shoe S is stored in the accommodation space 10 of the shoe care device 1 of FIG. 1*a*.

Figure 2A:
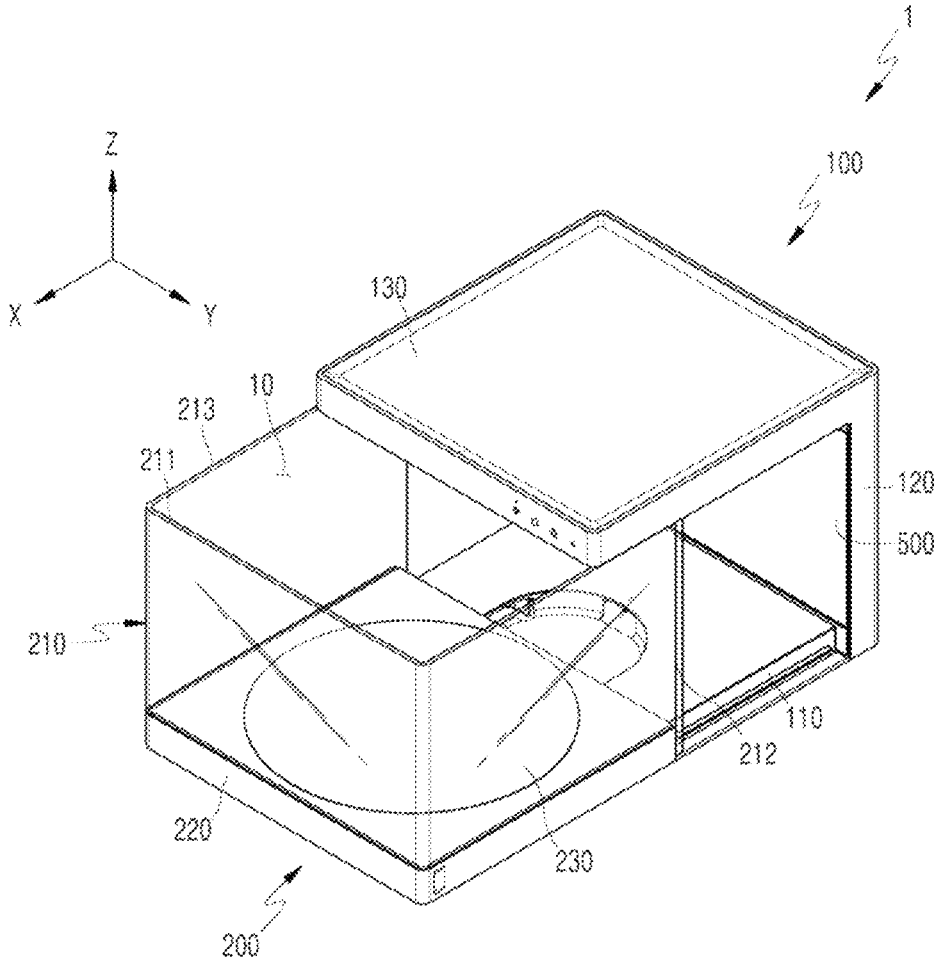
FIG. 2*a* is a perspective view illustrating a state in which the accommodation space of the shoe care device of FIG. 1*a* is opened.
Figure 2B:
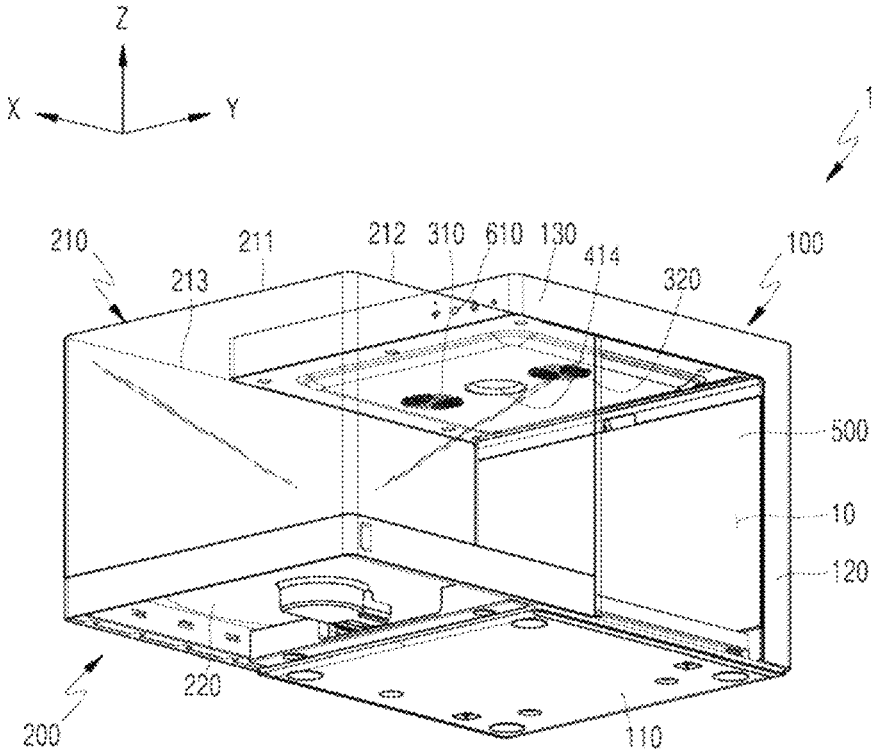
FIG. 2*b* is a perspective view illustrating a view of the shoe care device of FIG. 2*a* viewed in another direction.

FIG. 2*a* is a perspective view illustrating a state in which the accommodation space 10 of the shoe care device 1 of FIG. 1*a* is opened. FIG. 2*b* is a perspective view illustrating a view of the shoe care device of FIG. 2*a* viewed in another direction.

As illustrated in FIGS. 1*a* and 1*b*, the shoe care device 1 according to the embodiment is configured to include a body 100 and a moving body 200.

The body 100 and the moving body 200 form the accommodation space 10 accommodating the shoe S jointly. The body 100 and the moving body 200 are coupled to move with respect to each other. The moving body 200 may be coupled to the body 100 to reciprocally move in a horizontal direction.

The shoe care device 1 illustrated in FIG. 1*a* may be changed like the shoe care device 1 illustrated in FIG. 2*a*. That is, the moving body 200 may slidably move in a first direction X with respect to the body 100, and the shoe care device 1 is transformed from the closed state to the opened state, and the accommodation space 10 may be opened.

The shoe care device 1 illustrated in FIG. 2*a* may be changed like the shoe care device 1 illustrated in FIG. 1*a* again. That is, the moving body 200 may slidably move in an opposite direction to the first direction X with respect to the body 100, and the shoe care device 1 is transformed from the opened state to the closed state, and the accommodation space 10 may be closed.

As such, in the shoe care device 1 according to the embodiment of the present invention, the moving body 200 may move the first direction X or the opposite direction to the first direction X with respect to the body 100, and reciprocally move in front and rear directions.

In the state in which the accommodation space 10 is closed, the accommodation space 10 may be sealed from outside air. Therefore, when the shoe S is accommodated in the accommodation space 10 and the accommodation space 10 is closed, a contact of the shoe S with dust and moisture of the outside air may be interrupted.

The body 100 may form an upper surface and a rear surface of the accommodation space 10.

The moving body 200 may form a front surface, a lower surface, and both side surfaces of the accommodation space 10.

The accommodation space 10 may be formed in a hexahedral form. However, the accommodation space 10 of the shoe care device 1 according to the embodiment of the present invention is not limited to such a shape, and may be configured in various three-dimensional shapes.

The body 100 and the moving body 200 may form an overall appearance of the shoe care device 1. An exterior of the shoe care device 1 may be configured in the hexahedral form. That is, in the state in which the body 100 and the moving body 200 are coupled to each other and the accommodation space 10 is closed, the external appearance of the shoe care device 1 may be configured in the hexahedral form. However, the shoe care device 1 according to the embodiment of the present invention is not limited to such a shape, and may be configured in various three-dimensional shapes.

The body 100 may include an upper body 130, a middle body 120, and a lower body 110.

The upper body 130 is positioned at an upper side of the accommodation space 10. The upper body 130 forms the upper surface of the accommodation space 10. The upper body 130 may form an uppermost portion of the shoe care device 1. The upper surface of the upper body 130 may form a flat surface along a substantially horizontal surface. When a plurality of shoe care devices 1 is provided, any one shoe care device 1 may be placed on the upper surface of the upper body 130 of the other one shoe care device 1, and the shoe care devices 1 may be stacked on each other.

The lower body 110 is positioned below the accommodation space 10. The lower body 110 may form a lowermost portion of the shoe care device 1. The lower body 110 may form a bottom portion of the shoe care device 1.

The middle body 120 is positioned behind the accommodation space 10. The middle body 120 forms the rear surface of the accommodation space 10. The middle body 120 may connect the upper body 130 and the lower body 110 behind the accommodation space 10. The middle body 120 may form a rear wall surface of the shoe care device 1.

The body 100 is configured to include the upper body 130, the middle body 120, and the lower body 110, and as a result, the body 100 may form a substantially 'C' form on the side view.

As described above, the moving body 200 is configured to move forward and backward with respect to the body 100. The moving body 200 may include a base 220, a transparent window 210, and a turntable 230.

The base 220 may be coupled to the lower body 110 to be slidably movable in the first direction X. The base 220 may form the bottom portion of the moving body 200. The base 220 may be positioned at the upper side of the lower body 110. A bottom surface of the base 220 may be positioned in close contact with or in proximity to the upper surface of the lower body 110.

The transparent window 210 may form of extending upward from the base 220. The transparent window 210 may form the front surface, and both side surfaces (a left surface and a right surface) of the accommodation space 10. The transparent window 210 may be made of a transparent or translucent material.

Light inside and outside the accommodation space 10 may pass through the transparent window 210. The transparent window 210 may be made of a material which is weather-resistant to prevent discoloration. The transparent window 210 may be made of an acrylic (PMMA) material which is weather-resistant and scratch-resistant.

The transparent window 210 may prevent a beam having a predetermined wavelength from being introduced into the accommodation space 10. As an example, the transparent window 210 may be configured to block ultraviolet rays. The ultraviolet rays as an electromagnetic wave in which a wavelength corresponds to 10 to 397 nm shorter than visible rays are light which has a strong chemical action and causes getting sunburn or discoloration.

As an example, an ultraviolet-proof film may be attached to an inner surface or an outer surface of the transparent window 210. Alternatively, the inner surface or the outer surface of the transparent window 210 may be UV-coated with an ultraviolet-proof agent.

The transparent window 210 includes a first window 211, a second window 212, and a third window 213. The first window 211 may form the front surface of the accommodation space 10. The second window 212 may form the left surface of the accommodation space 10. The third window 213 may form the right surface of the accommodation space 10.

In the state in which the shoe S is accommodated in the accommodation space 10, a user may view the shoe S through the transparent window 210. As a result, the shoe care device 1 may be used as a device which may display the shoe S while keeping and caring the shoe S.

As illustrated in FIGS. 1*a* and 1*b*, in the state in which the moving body 200 is positioned relatively at a rearmost side, the accommodation space 10 may be sealed from the outside air. In this case, the accommodation space 10 may be formed in the hexahedral form. In this case, the moving body 200 may be present at a first location and the shoe care device 1 is in the closed state.

As illustrated in FIGS. 2*a* and 2*b*, in the state in which the moving body 200 moves in the first direction X, the accommodation space 10 may be opened. In this case, an upper portion of the first window 211 is spaced to a front side in the first direction X from the front surface of the upper body 130 to form a gap (hereinafter, referred to as 'first gap').

In this case, an upper portion of the first window 212 is spaced to a front side in the first direction X from the front surface of the upper body 120 to form a gap (hereinafter, referred to as 'first gap'). The third window 213 is spaced to the front side in the first direction X from a right side surface of the middle body 120 to form a gap (hereinafter, referred to as 'third gap').

In the state in which the moving body 200 moves in the first direction X as much as possible, i.e., in the state in which the moving body 200 is positioned relatively at a frontmost side, the moving body 200 may be present at a second location and the shoe care device 1 may be in the opened state.

The user may put the shoe S into the accommodation space 10 or withdraw the shoe S from the accommodation space 10 through the first gap. The user may put the shoe S into the accommodation space 10 or withdraw the shoe S from the accommodation space 10 through the first gap. An internal panel 500 may be coupled to the inner surface of the middle body 120 or uncoupled from the inner surface of the middle body 120.

The turntable 230 may form the upper surface on which the shoe S is placed. The upper surface of the turntable 230 may have a circular shape. The turntable 220 may form the lower surface of the accommodation space 10 jointly with the base 220.

The turntable 230 may be rotatably coupled to the base 220 around a vertical axis, i.e., an axis parallel to a third direction Z.

For the rotation of the turntable 230, a motor 290 may be provided in the moving body 200. The motor 290 may be coupled to the base 220. The turntable 230 may rotate in conjunction with the rotation of the motor 290. Rotational force of the motor 290 may be delivered to the turntable 230 through a reducer. The motor 290 may rotate unidirectionally or reciprocally rotate bidirectionally.

The turntable 230 is provided, and as a result, the shoe S may rotate in the accommodation space 10 or a display effect of the shoe S may be enhanced.

The shoe care device 1 may include an operating button 610 and a controller 600. The operating button 610 may be formed in the body 100. As an example, the operating button 610 may be formed on the front surface of the upper body 130. When the user manipulates the operating button 610, the turntable 230 may rotate or stop. The user manipulates the operating button 610 to adjust a rotational speed of the turntable 230. The user may input a rotation time of the turntable 230 into the controller 600 through the operating button 610.

The user manipulates the operating button 610 to rotate the turntable 230 at a predetermined angle. In the state in which the accommodation space 10 is opened, the user may place the shoe S on the upper surface of the turntable 230 by holding any one part (heel top, lining, tong, etc.) of the shoe S. Thereafter, the user manipulates the operating button 610 to rotate the turntable 230 at a predetermined angle.

As an example, the user manipulates the operating button 610 to rotate the turntable 230 at a predetermined angle so that a front and rear direction of the shoe S coincides with the first direction X. Alternatively, the user manipulates the operating button 610 to rotate the turntable 230 at a predetermined angle so that the front and rear direction of the shoe S form a predetermined angle with the first direction X.

Therefore, even though the user places the shoe S on the upper surface of the turntable 230 while gripping any one part of the shoe S, the shoe S may be placed (displaced) in a direction desired by the user.

A sensor (not illustrated) that senses movement of the moving body 200 may be provided in the body 100. When the accommodation space 10 is closed, the controller 600 may rotate the turntable 230 by a signal of the sensor.

A load sensor (not illustrated) may be provided in the base 220. The load sensor may automatically measure a load of the shoe S placed on the turntable 230. The rotational speed of the turntable 230 according to a measurement value of the load sensor may be set in the controller 600. Alternatively, the user may input the rotational speed of the turntable 230 according to the measurement value of the load sensor into the controller 600 through the operating button 610.

A camera (not illustrated) may be provided in the shoe care device 1. The camera may automatically shoot the shoe S placed on the turntable 230. The controller 600 may recognize the shape, size, and/or type of the shoe S through a shooting image of the camera.

The rotational speed of the turntable 230 according to the shape, size, and/or type of the shoe S may be set in the controller 600. Alternatively, the user may input the rotational speed of the turntable 230 according to the shape, size, and/or type of the shoe S into the controller 600 through the operating button 610.

The shoe care device 1 may include an operating sensor. The operating sensor may sense an access of the user. The turntable 230 may be rotated or stopped by the sensing signal of the operating sensor.

Figure 3A:
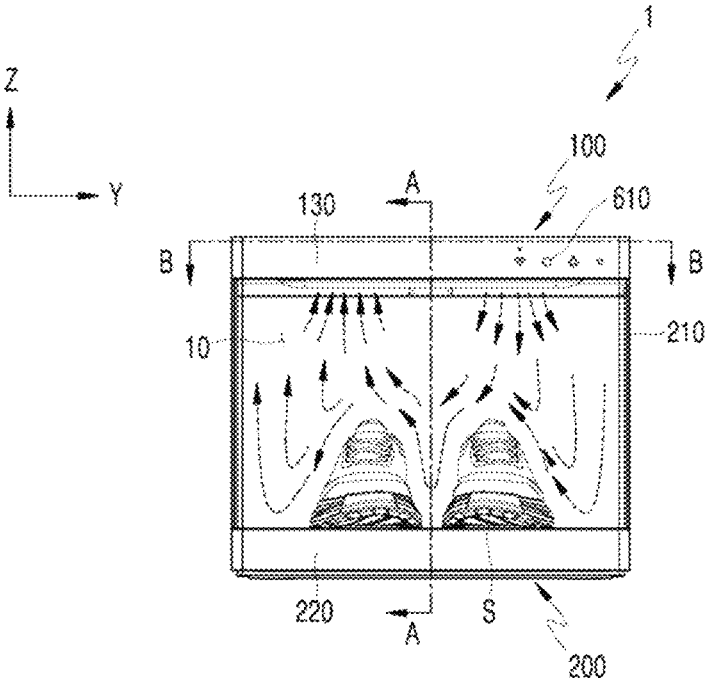
FIG. 3*a* is a side view illustrating a use state of the shoe care device of FIG. 1*b*.

FIG. 3*a* is a side view illustrating a use state of the shoe care device 1 of FIG. 1*b*. FIG. 3*a* illustrates a state of illuminating the shoe S in the accommodation space 10.

Figure 3B:
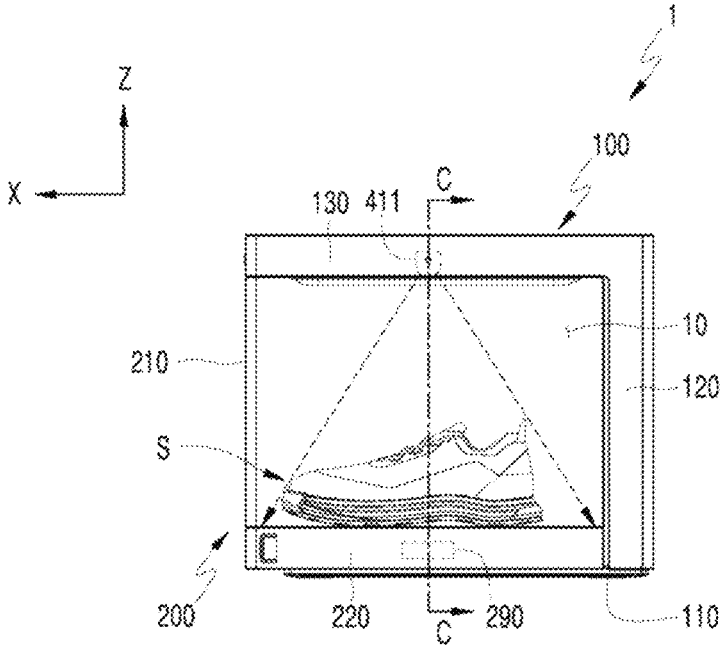
FIG. 3*b* is a front view illustrating the use state of the shoe care device of FIG. 1*b*.

FIG. 3*b* is a front view illustrating the use state of the shoe care device 1 of FIG. 1*b*. FIG. 3*b* illustrates an air flow in the accommodation space 10.

The shoe care device 1 according to the embodiment of the present invention may include a first light 410. The first light 410 may be provided in the upper body 130.

As illustrated in FIG. 3*a*, the first light 410 may illuminate the accommodation space 10. The first light 410 may include a light source 411 and a lens 414.

The light source 411 may intensively irradiate light onto the upper surface of the turntable 230 on which the shoe S is placed. The light of the light source 411 may intensively illuminate the shoe S placed on the upper surface of the turntable 230. When the light 410 is turned, an image of the shoe S stored in the accommodation space 10 may be changed by the light of the light source 411.

The light of the light source 411 may illuminate the accommodation space 10 by passing through the lens 414. An ultraviolet-proof film may be attached to the lens 414 or the ultraviolet-proof agent may be coated on the lens 414 in order to block the ultraviolet rays.

When the user manipulates the operating button 610, the light source 411 may be turned on or off. The user may input an operating time of the light source 411 into the controller 600 through the operating button 610. The user manipulates the operating button 610 to adjust the operating time of the light source 411.

Alternatively, the light source 411 may be turned on or off by the sensing signal of the operating sensor. The controller 600 may turn on-off the light source by the signal of the operating sensor.

Alternatively, the light source 411 may be turned on or off by the sensing signal of the sensor. When the accommodation space 10 is closed, the controller 600 may turn on-off the light source by the signal of the sensor.

Alternatively, the operating time and the operating pattern of the light source according to the measurement value of the load sensor may be set in the controller 600. The user may input the operating time and the operating pattern of the light source 411 according to the measurement value of the load sensor into the controller 600 through the operating button 610.

Alternatively, the operating time and the operating pattern of the light source according to the shape, size, and/or type of the shoe S may be set in the controller 600. The user may input the operating time and the operating pattern of the light source 411 according to the shape, size, and/or type of the shoe S into the controller 600 through the operating button 610.

The light source 411 may be configured to change the color of the light. As an example, the light source 411 may be constituted by Red Green Blue White (RGBW) LEDs. The controller 600 may control current applied to a Red (R) LED, a Green (G) LED, a Blue (B) LED, and a White (W) LED. When the controller 600 controls the current applied to the RGBW LEDs, the aesthetics and a color sense of the shoe S stored in the accommodation space 10 may be variously changed. The user may input a pattern of the current applied to the RGBW LED into the controller 600 through the operating button 610.

Figure 4A:
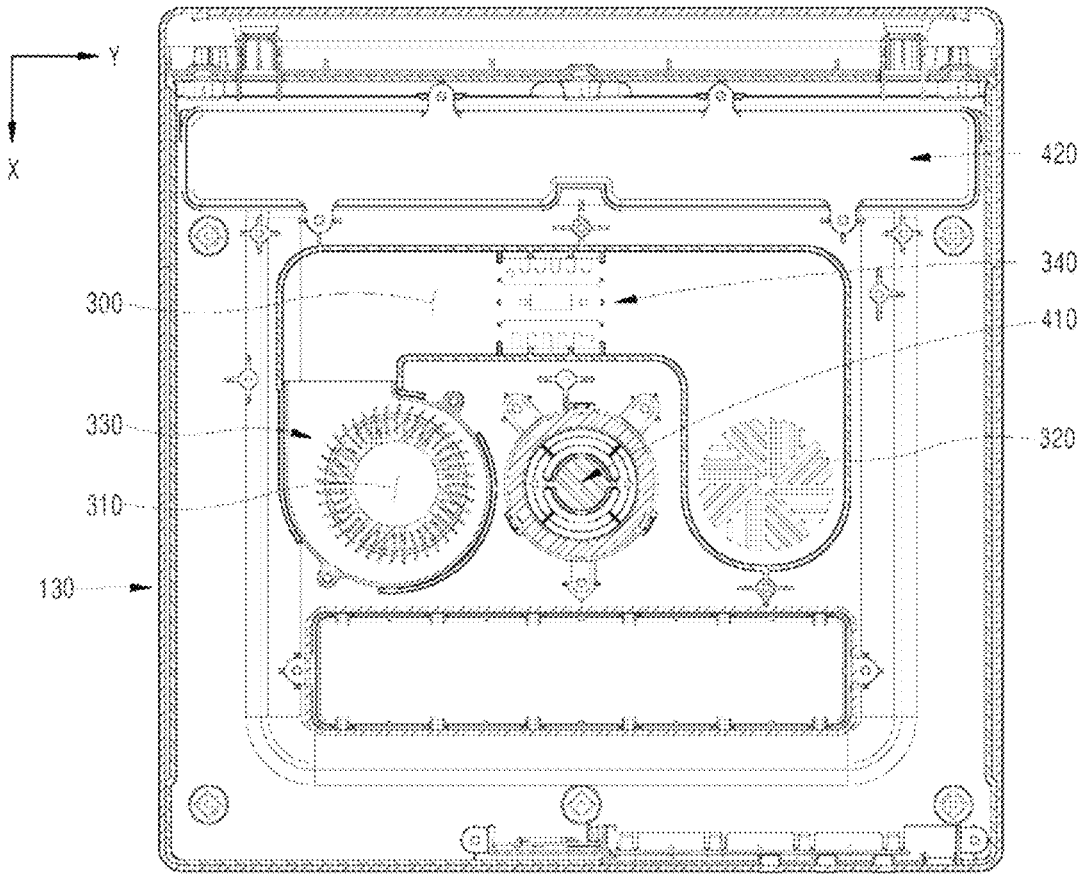
FIG. 4*a* as a cross-sectional view illustrating a body according to an embodiment of the present invention is a diagram an upper body viewed from the top.

FIG. 4*a* as a cross-sectional view illustrating a body 100 according to an embodiment of the present invention is a diagram an upper body 130 viewed from the top. In FIG. 4*a*, in order to show an internal view of the upper body 130, a state in which a first external cabinet 136 of the upper body 130 is removed is illustrated.

Figure 4B:
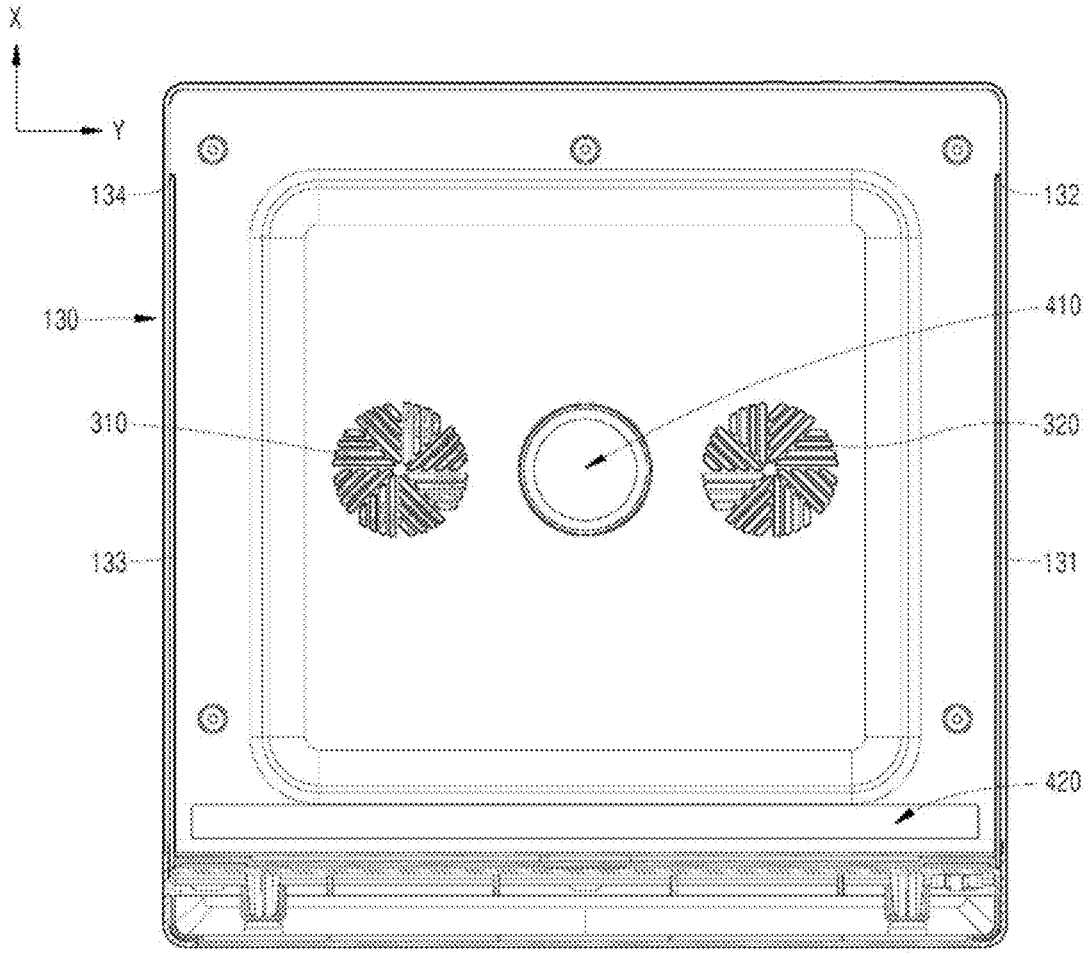
FIG. 4*b* as a cross-sectional view illustrating the body according to an embodiment of the present invention is a diagram illustrating an upper body from the bottom.

FIG. 4*b* as a cross-sectional view illustrating the body 100 according to an embodiment of the present invention is a diagram illustrating the upper body 130 from the bottom.

The body 100 may be configured to include an air path 300. The body 100 may be configured to include a suction port 310 and a discharge port 320.

The air path 300 may be formed in the upper body 130. The air path 300 may be provided inside the upper body 130.

The air path 300 connects the suction port 310 and the discharge port 320. The suction port 310 may form an inlet of the air path 300, and the discharge port 320 may form an outlet of the air path 300.

The suction port 310 may be formed on a bottom surface of the upper body 130. The discharge port 320 may be formed on the bottom surface of the upper body 130.

The air in the accommodation space 10 may be suctioned into the air path 300 through the suction port 310. The air in the air path 300 may be discharged to the accommodation space 10 through the discharge port 320. Therefore, air forcibly blown by a blowing part 330 to be described below may be circulated in the accommodation space 10 and the air path 300.

As illustrated in FIGS. 1*b* and 4*a*, the shoe care device 1 according to the embodiment of the present invention may include the blowing part 330 and a heating part 340. The blowing part 330 and the heating part 340 may be provided in the upper body 130.

The blowing part 330 is configured to circulate the air in the accommodation space 10.

The blowing part 330 may be positioned in the upper body 130. The blowing part 330 may be placed in the air path 300, and may generate a flow of the air in the air path 300.

The heating part 340 may be configured to directly or indirectly heat the air in the accommodation space 10. The heating part 340 may be placed in the body 100. The heating part 340 may be placed in the air path 300.

The body 100 may be configured to include the first light 410 and a second light 420. The first light 410 may be configured to be formed on the bottom surface of the upper body 130 and to illuminate the accommodation space 10. The second light 420 may be configured to be formed on the bottom surface of the upper body 130 and to illuminate the middle body 120 behind the first light 410.

The heating part 340 may deliver thermal energy to the air which moves in the air path 300. The heating part 340 may be configured to include a heat wire 341.

The blowing part 330 and the heating part 340 may control the temperature and/or humidity of the accommodation space 10.

When the user manipulates the operating button, the blowing part 330 may rotate or stop. The user manipulates the operating button to adjust the rotational speed of the blowing part 330. The user may input the rotation time of the blowing part 330 into the controller through the operating button. The air in the accommodation space 10 may be circulated by operating the blowing part 330, and the air in the accommodation space 10 may maintain a uniform state as a whole.

When the user manipulates the operating button, the heating part 340 may be turned on or off. The user manipulates the operating button to adjust the operating time of the heating part 340. The user may input an operating temperature of the heating part 340 into the controller through the operating button. The temperature of the air heated by the heating part 340 may be selected or adjusted according to characteristics of a used shoe S.

The blowing part 330 and the heating part 340 may be operated for a predetermined time. Further, each of the operating and the stopping of the blowing part 330 and the heating part 340 may be repeatedly conducted for a predetermined time. The time may be decided by the user, or automatically decided by a program.

According to the embodiment of the present invention, the temperature and/or the humidity of the accommodation space 10 may be maintained at an optimal state which is suitable for the characteristics of each shoe S.

Therefore, the shoe care device 1 according to the embodiment of the present invention may achieve both a shoe display effect of displaying the shoe and a shoe care effect of interrupting deformation or contamination of the shoe.

The blowing part 330 and the heating part 340 may be turned on or off by the sensing signal of the sensor. When the accommodation space 10 is closed, the controller 600 may turn on-off the blowing part 330 and the heating part 340 by the signal of the sensor.

Alternatively, the operating time and the operating pattern of the blowing part 330 and the heating part 340 according to the measurement value of the load sensor may be set in the controller. The user may input the operating time and the operating pattern of the blowing part 330 and the heating part 340 according to the measurement value of the load sensor into the controller through the operating button.

Alternatively, the operating time and the operating pattern of the blowing part 330 and the heating part 340 according to the shape, size, and/or type of the shoe may be set in the controller. The user may input the operating time and the operating pattern of the blowing part 330 and the heating part 340 according to the shape, size, and/or type of the shoe into the controller through the operating button.

Therefore, the shoe care device 1 according to the embodiment of the present invention controls the temperature and/or the humidity of the accommodation space 10 differently according to a material, a load, the shape, the size, and/or the type of the shoe to completely interrupt the deformation or the contamination of the shoe.

Figure 5A:
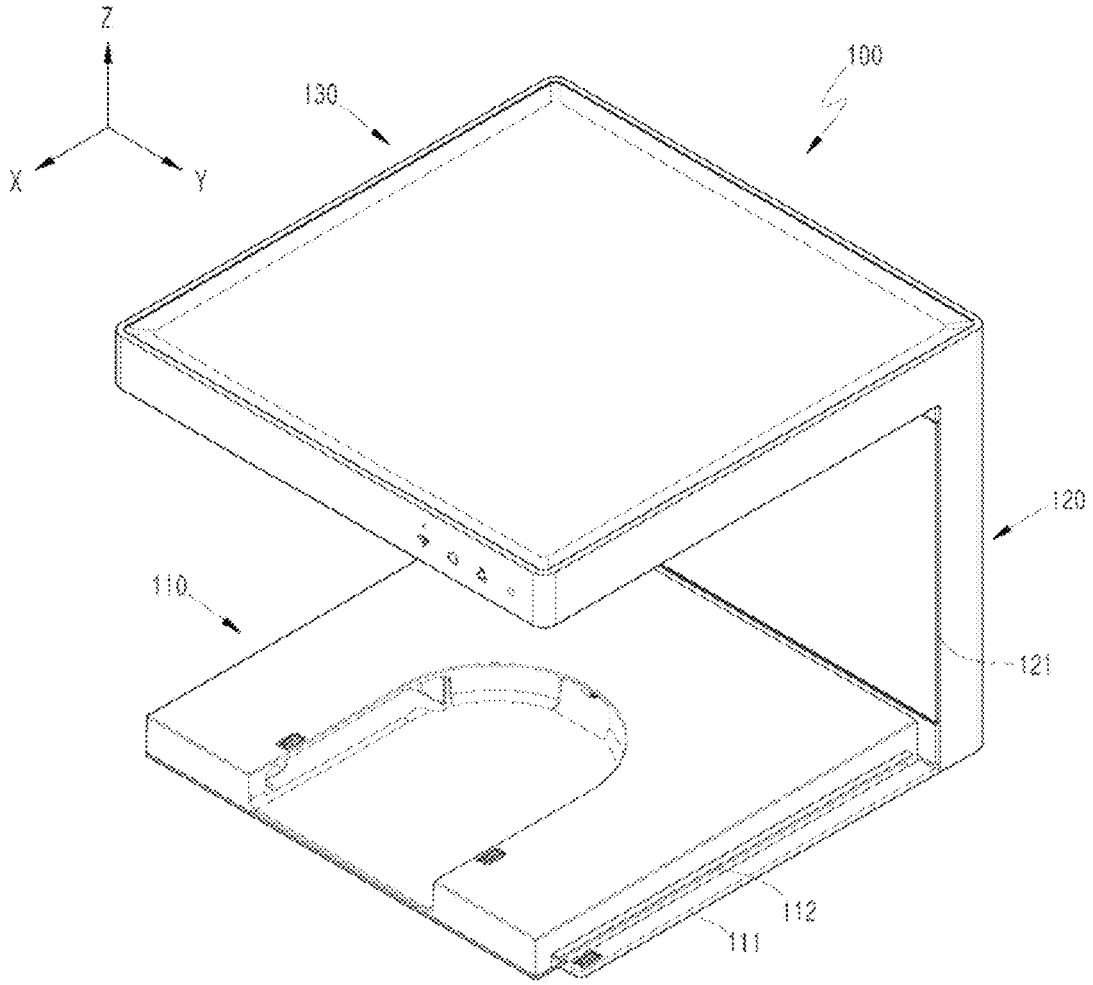
FIG. 5*a* is a perspective view illustrating the body of the shoe care device according to an embodiment of the present invention.
Figure 5B:
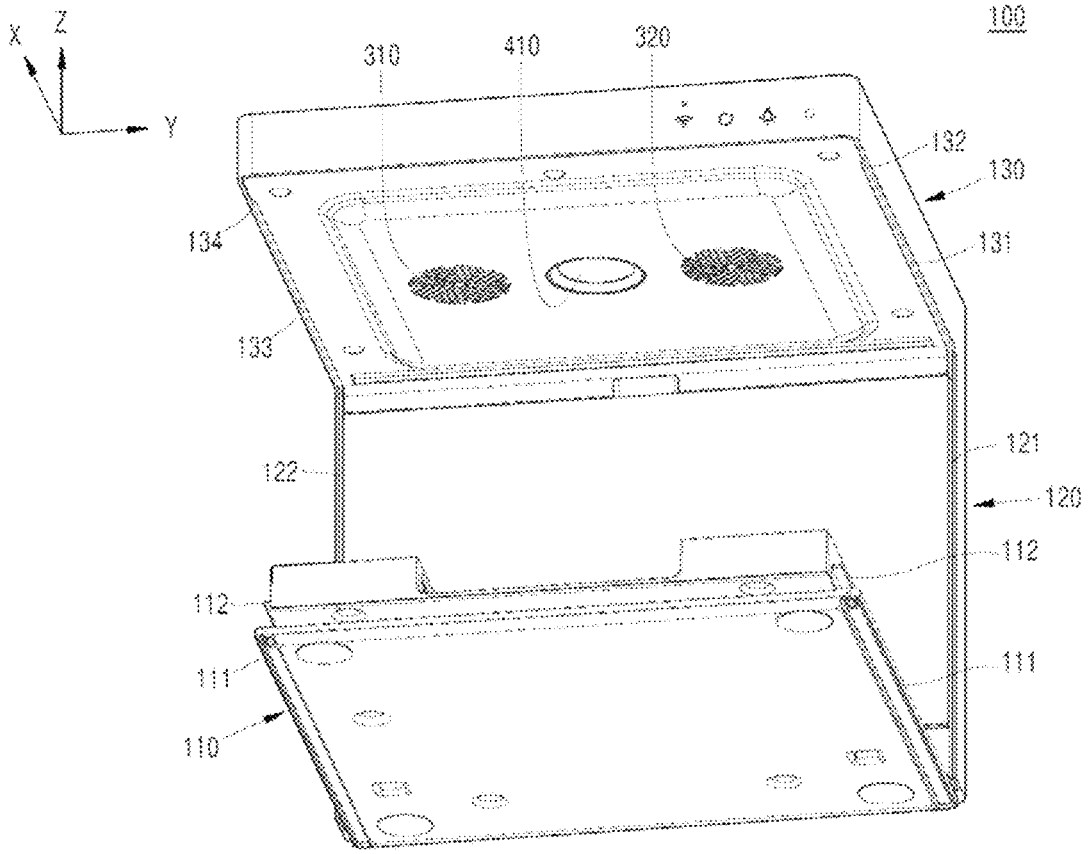
FIG. 5*b* is a perspective view illustrating a view of the body of FIG. 5*a* viewed in another direction.

FIG. 5*a* is a perspective view illustrating the body 100 of the shoe care device 1 according to the embodiment of the present invention. FIG. 5*b* is a perspective view illustrating a view of the body 100 of FIG. 5*a* viewed in another direction.

Figure 6:
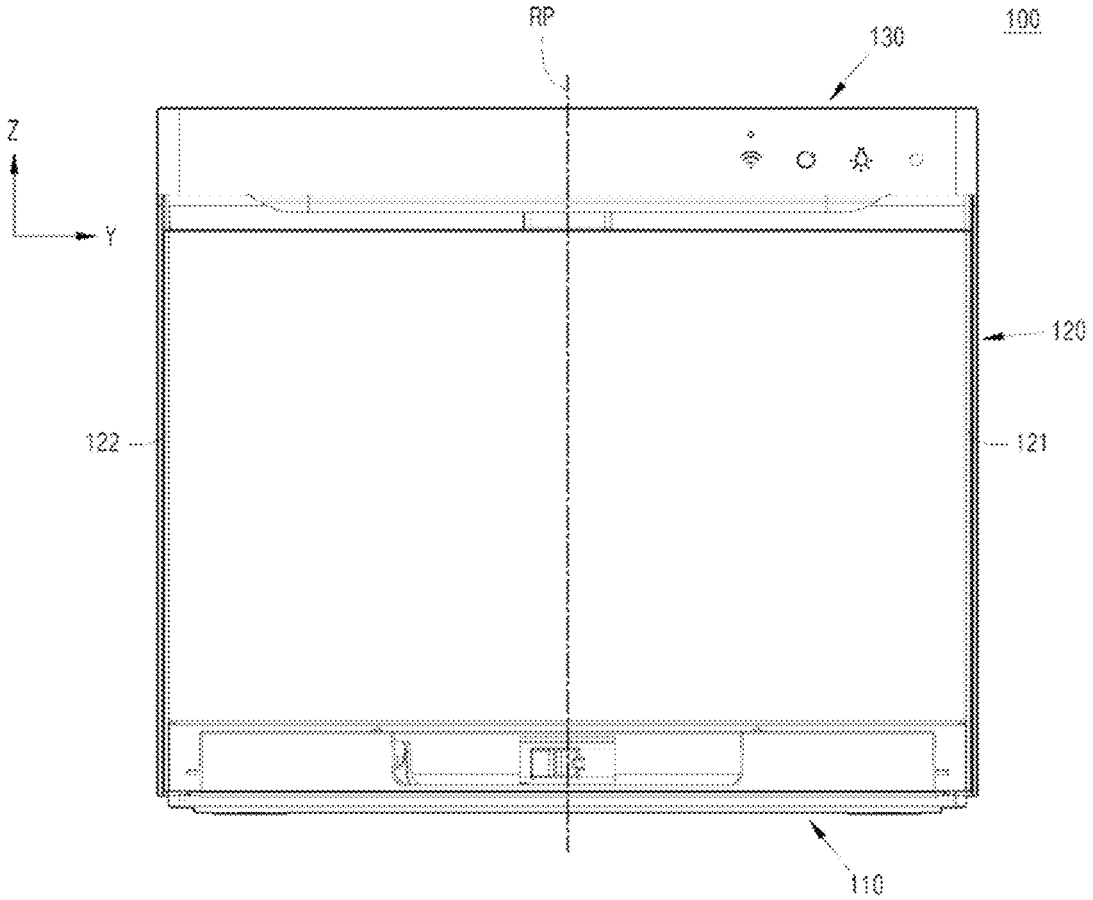
FIG. 6 is a front view illustrating the body of FIG. 5*a*.

FIG. 6 is a front view illustrating the body 100 of FIG. 5*a*.

The lower body 100 of the body 100 forms the bottom surface of the shoe care device 1. The lower body 110 may be configured to support the lower side of the moving body 200.

The middle body 120 of the body 100 extends upward from a rear side of the lower body 110 and forms a back surface of the shoe care device 1. The inner surface of the middle body 120 forms the back surface of the accommodation space 10.

The upper body 130 of the body 100 extends forward from the upper side of the middle body 120 and forms the upper surface of the shoe care device 1. The inner surface of the upper body 130 may forms the upper surface of the accommodation space 10. The upper body 130 may be configured to support the upper side of the moving body 200.

The body 100 may be configured in a symmetric form around a reference plane RP orthogonal to the second direction Y.

Figure 7A:
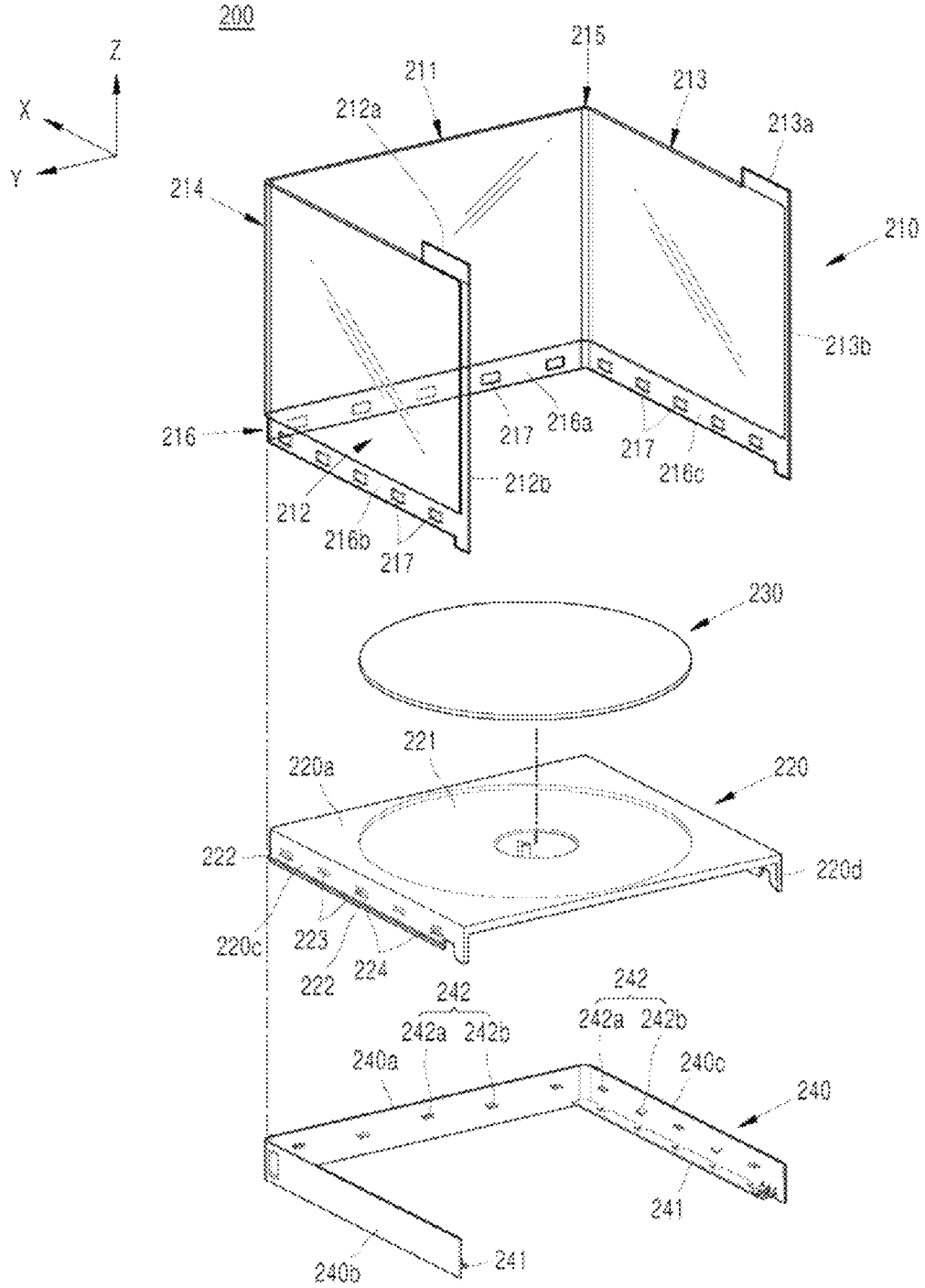
FIG. 7*a* is an exploded perspective view illustrating a moving body of the shoe care device according to an embodiment of the present invention.
Figure 7B:
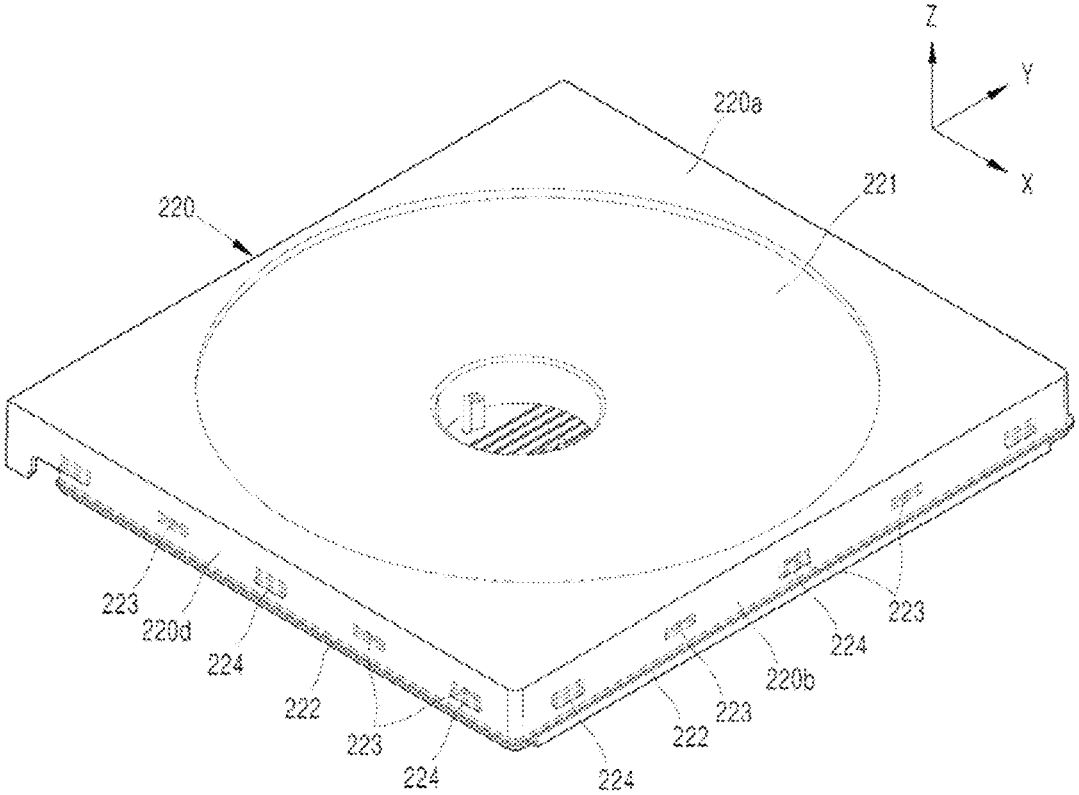
FIG. 7*b* is a perspective view illustrating a view of the base of FIG. 7*a* viewed in another direction.

FIG. 7*a* is an exploded perspective view illustrating the moving body 200 of the shoe care device 1 according to the embodiment of the present invention. FIG. 7*b* is a perspective view illustrating a view of the base 220 of FIG. 7*a* viewed in another direction.

The moving body 200 forms the accommodation space 10 jointly with the body 100. The moving body 200 may be movably coupled to the body 100 between a first location and a second location. The second location is a location before the first location. The moving body 200 may be coupled to the body 100 to be movable forward and backward with respect to the body 100.

When the moving body 200 is at the first location, the accommodation space 10 is closed and when the moving body 200 is at the second location, the accommodation space 10 is opened.

When the moving body 200 is at the second location, the accommodation space 10 of the shoe care device 1 is opened at the upper side, the left side, and the right side.

When the moving body 200 moves forward and backward with respect to the body 100, the moving body 200 may be supported by the lower body 110 and the upper body 130.

When the moving body 200 is at the first location, both left and right sides at the upper side and both left and right sides at the lower side of the moving body 200 are supported by the body 100. When the moving body 200 is at the second location, both left and right sides at the upper side and both left and right sides at the lower side of the moving body 200 may be supported by the body 100.

Each component of the moving body 200 will be additionally described below.

Figure 8A:
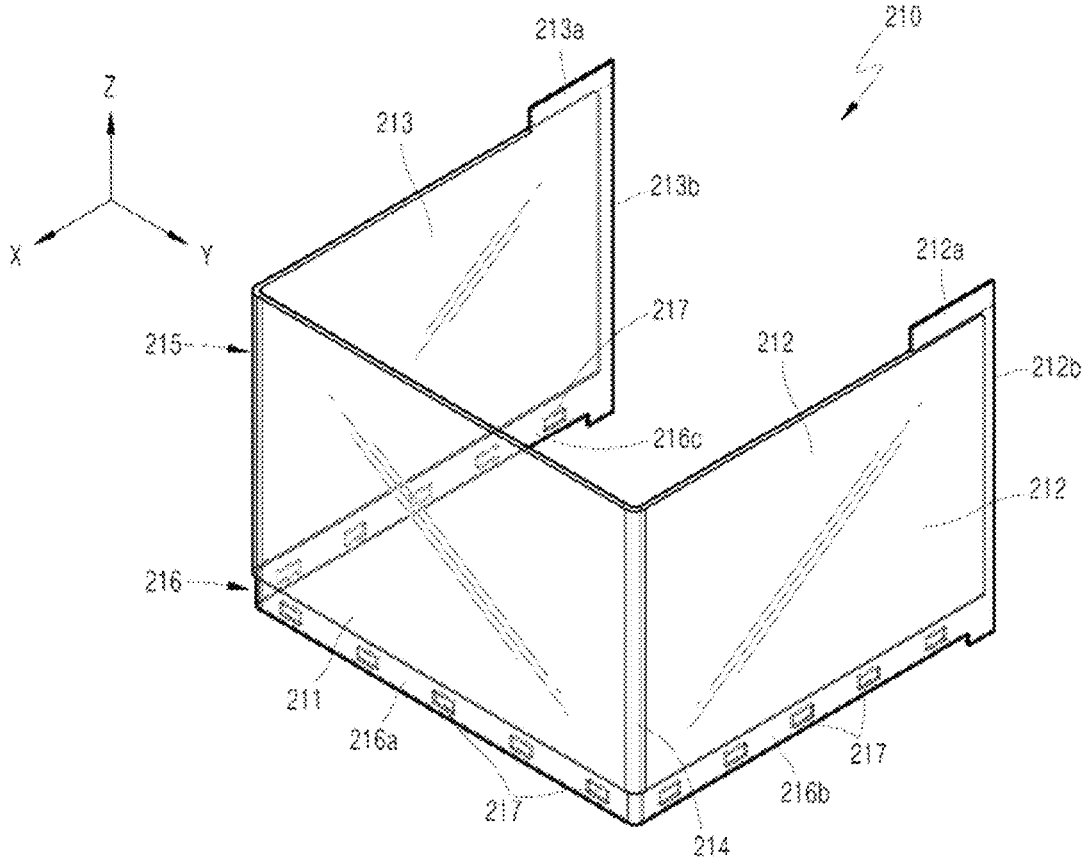
FIG. 8*a* is a perspective view illustrating a transparent window according to an embodiment of the present invention.
Figure 8B:
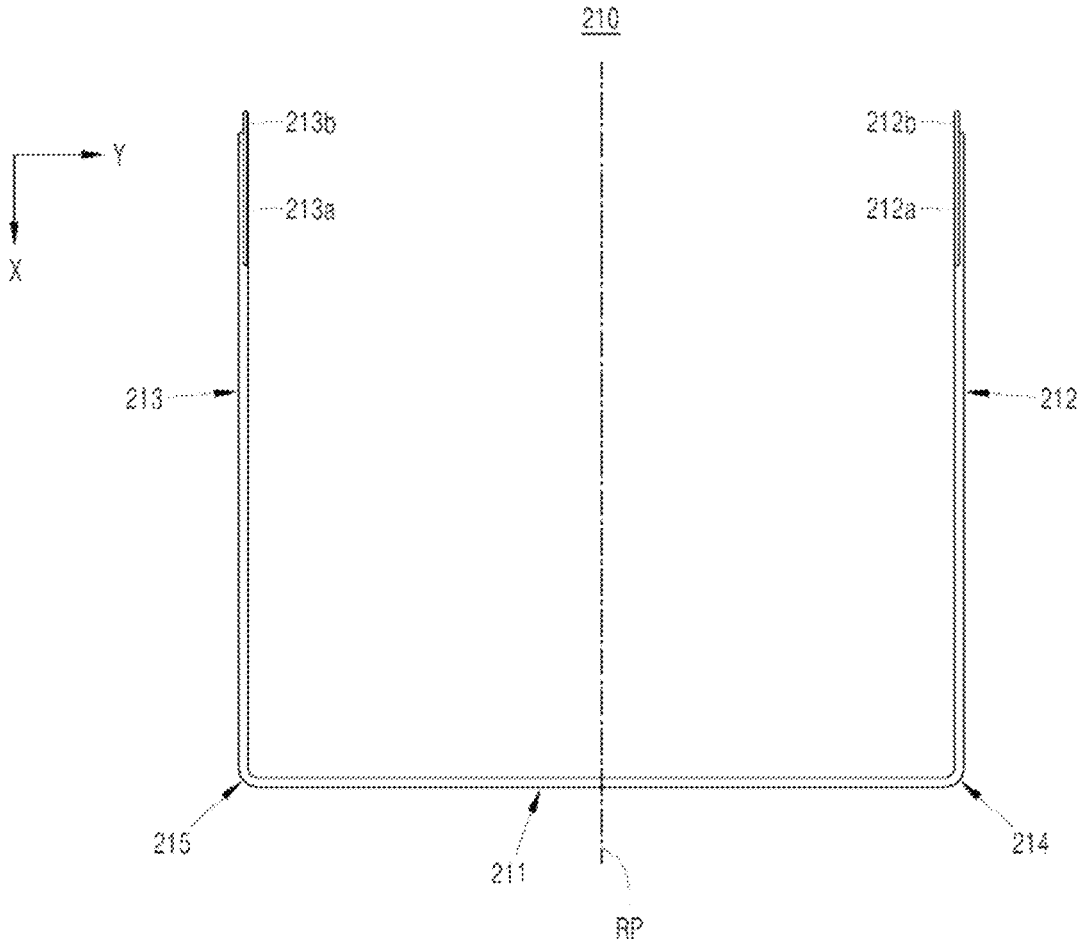
FIG. 8*b* is a plan view illustrating the transparent window of FIG. 8*a*.

FIG. 8*a* is a perspective view illustrating a transparent window 210 according to an embodiment of the present invention. FIG. 8*b* is a plan view illustrating the transparent window 210 of FIG. 8*a*.

In the embodiment of the present invention, the transparent window 210 may be integrally configured. That is, respective parts constituting the transparent window 210 is not configured to be connected or fixed to each other by a fixation means (e.g., a bracket, a clip, a bolt, an adhesive, etc.), but the transparent window 210 may be configured as one body from the time of manufacturing. All parts constituting the transparent window 210 may be made of the same material. All parts constituting the transparent window 210 may be configured to have the same made of the same physical property.

In the shoe care device 1 according to the embodiment of the present invention, the transparent window 210 may be formed by injection molding.

A substantial part of the transparent window 210 or all parts of the transparent window 210 may be configured to be transparent.

The transparent window 210 may be configured by a combination of plates constituting planes which are distinguished from each other. The plates constituting the transparent window 210 are connected to each other. The plates constituting the transparent window 210 are connected to each other at respective corners. A part where the plates are connected in the transparent window 210 may form a bent form, a curved surface, or a flat surface.

The transparent window 210 may be made of polymethyl methacrylate (PMMA).

The transparent window 210 includes a first window 211, a second window 212, and a third window 213. Each of the first window 211, the second window 212, and the third window 213 is configured to be transparent. Each of the first window 211, the second window 212, and the third window 213 may be configured in a flat plate form. Each of the first window 211, the second window 212, and the third window 213 may be configured in a square plate form. Vertical heights of the respective windows of the first window 211, the second window 212, and the third window 213 may be the same as or similar to each other.

The first window 211 forms the front surface of the shoe care device 1, the second window 212 forms the left surface of the shoe care device 1, and the third window 213 forms the right surface of the shoe care device 1. The second window 212 extends to a rear side from a left end of the first window 211, and the third window 213 extends to the rear side from a right end.

The first window 211 forms the front surface of the transparent window 210, the second window 212 forms the left surface of the transparent window 210, and the third window 213 forms the right surface of the transparent window 210. An inner surface and an outer surface of the first window 211 may form surfaces orthogonal to the first direction. The inner surface and the outer surface of the second window 212 may form surfaces orthogonal to the second direction. The inner surface and the outer surface of the third window 213 may form surfaces orthogonal to the second direction.

The inner surface of the first window 211 forms the front surface of the accommodation space 10. The inner surface of the second window 212 forms the left surface of the accommodation space 10. The inner surface of the third window 213 forms the right surface of the accommodation space 10.

The transparent window 210 includes the first window 211, the second window 212, and the third window 213, and as a result, the transparent window 210 may be configured in a substantially C shape (or □ shape, □ shape, or ⊓ shape) on a plan view.

The transparent window 210 may be configured in a symmetric form around the reference plane RP. The second window 212 and the third window 213 may be configured symmetric to each other around the reference plane RP.

In the shoe care device 1, the upper body 130 and the first window 211 may be opened/closed to each other, the middle body 120 and the second window 212 may be opened/closed to each other, and the middle body 120 and the third window 213 may be opened/closed to each other.

The lower side of the second window 212 and the lower side of the third window 213 may be supported on the lower body 110.

The upper side of the second window 212 and the upper side of the third window 213 may be supported on the upper body 130.

In the shoe care device 1 according to the embodiment of the present invention, the transparent window 210 may be integrally formed. In addition, the transparent window 210 may form an area of substantial parts of the front surface, the left surface, and the right surface of the shoe care device 1. An area of the first window 211 may be configured to correspond to the area of the front surface of the accommodation space 10. The area of the second window 212 may be configured to correspond to the area of the left surface of the accommodation space 10. The area of the third window 213 may be configured to correspond to the area of the right surface of the accommodation space 10.

According to the embodiment of the present invention, the area of the transparent window 210 may be maximized, the shoe S accommodated in the accommodation space 10 may not be blocked, but well viewed at all of the front side, the left side, and the right side, and the display effect of the shoe may be increased.

Unlike the embodiment of the present invention, when the transparent window 210 is formed only on the front surface of the shoe care device 1, the shoe S may not be viewed at the left side or the right side of the shoe care device 1, and the display effect of the shoe may not be sufficiently shown.

Unlike the embodiment of the present invention, if the first window 211 and the second window 212 are not integrally configured (further, if the first window 211 and the third window 213 are not integrally configured), a boundary between the first window 211 and the second window 212 (further, a boundary between the first window 211 and the third window 213) is viewed to the user, and the boundary may visually block the shoe inside the accommodation space 10 and the display effect of the shoe may be reduced, and the satisfaction of the user may be lowered. Further, a gap may be generated between the boundaries, and foreign substances may be introduced into the accommodation space 10 through the gap.

The transparent window 210 includes a first curved surface portion 214 and a second curved surface portion 215. Each of the first curved surface portion 214 and the second curved surface portion 215 forms a vertical corner portion of the transparent window 210.

The first curved surface portion 214 is a portion connecting the first window 211 and the second window 212. A cross section of the first curved surface portion 214 may be constantly configured in an upper and lower direction (or third direction). The first curved surface portion 214 is configured in a curved surface structure. Each of the outer surface and the inner surface of the first curved surface portion 214 is configured in a curved surface form which is convex to the outside of the transparent window 210.

The first window 211 and the first curved surface portion 214 may be configured so that a curvature radius is continuously changed. Further, the second window 212 and the first curved surface portion 214 may be configured so that the curvature radius is continuously changed. That is, on an inner surface and an outer surface of a portion connected from the first window 211 to the first curved surface portion 214 and the second window 212, the curvature radius may not be discontinuously changed, but a bent surface may not be formed.

When the inner surfaces and the outer surfaces of the first window 211 and the second window 212 are configured by planes in the transparent window 210, and the transparent window 210 is configured to include the first curved surface portion 214, the curvature radii of the inner surface and the outer surface of the first curved surface portion 214 may be configured as 1 to 50 mm.

The transparent window 210 is configured to include the first curved surface portion 214, and as a result, the shoe S inside the accommodation space 10 may not be visually blocked through the first curved surface portion 214, but fully viewed to the user.

Further, the first curved surface portion 214 is configured as described above, and as a result, the shoe S inside the accommodation space 10 viewed through the first curved surface portion 214, a portion where the first curved surface portion 214 and the first window 211 are connected, and a portion where the first curved surface portion 214 and the second window 212 are connected may be prevented or minimized from being distorted.

The second curved surface portion 215 is a portion connecting the first window 211 and the third window 213. The cross section of the second curved surface portion 215 may be constantly configured in the upper and lower direction (or third direction). The second curved surface portion 215 is configured in the curved surface structure. Each of the outer surface and the inner surface of the second curved surface portion 215 is configured in the curved surface form which is convex to the outside of the transparent window 210.

The first window 211 and the second curved surface portion 215 may be configured so that the curvature radius is continuously changed. Further, the third window 213 and the second curved surface portion 215 may be configured so that the curvature radius is continuously changed. That is, on the inner surface and the outer surface of a portion connected from the first window 211 to the second curved surface portion 215 and the third window 213, the curvature radius may not be discontinuously changed, but the bent surface may not be formed.

When the inner surfaces and the outer surfaces of the first window 211 and the third window 213 are configured by the planes in the transparent window 213, and the transparent window 210 is configured to include the second curved surface portion 215, the curvature radii of the inner surface and the outer surface of the first curved surface portion 214 may be configured as 1 to 50 mm.

The transparent window 210 is configured to include the second curved surface portion 215, and as a result, the shoe S inside the accommodation space 10 may not be visually blocked through the second curved surface portion 215, but fully viewed to the user.

Further, the second curved surface portion 215 is configured as described above, and as a result, the shoe S inside the accommodation space 10 viewed through the second curved surface portion 215, a portion where the second curved surface portion 215 and the first window 211 are connected, and a portion where the second curved surface portion 215 and the third window 213 are connected may be prevented or minimized from being distorted.

As described above, according to an embodiment of the present invention, any gap is not formed at a connection portion of the first window 211 and the second window 212 and a connection portion of the first window 211 and the third window 213, and the aesthetics at the portions are excellent, and foreign substances such as dust can be prevented from being inserted into the accommodation space 10 through the portions. Further, the shoe S is not visually blocked, but the shoe S is viewed even through the connection portion of the first window 211 and the second window 212, and the connection portion of the first window 211 and the third window 213. Further, the air in the accommodation space 10 may be controlled, and the shoe S may be fully exposed at the front side, the left side, and the right side of the shoe care device 1, and both the management of the shoe and the display of the shoe may be effectively achieved.

Further, by the shoe care device 1 according to the embodiment of the present invention, even though a plurality of shoe care devices 1 are stacked vertically or arranged horizontally, each shoe care device 1 may be smoothly operated, and each shoe S accommodated in each shoe care device 1 may be visually exposed.

The transparent window 210 integrally configured in the shoe care device 1 according to the embodiment of the present invention is made of polymethyl methacrylate (PMMA), and includes the first curve portion 214 and the second curve portion 215. As a result, the aesthetic of the transparent window 210 itself may be excellent, and the shoe care device 1 may be easily assembled. Further, discoloration of the transparent window 210 may be prevented, and a solid transparent window 210 may be formed. Further, when the shoe S accommodated in the shoe care device 1 is viewed to an external user through the transparent window 210, the entire shape of the shoe is not divided, but integrally viewed, and distortion is prevented.

The base 220 is fixedly coupled to the lower side of the transparent window 210 to form a lower portion of the moving body 200. An entire form of the base 220 may be configured as a flat form in the horizontal direction. The base 220 may be configured in the square form on the plan view (see FIGS. 7*a* and 7*b*).

The base 220 may be configured so that the shoe S is placed at the upper side of the base 220. An upper surface 220*a* of the base 220 may be configured substantially in the square form.

The base 220 is positioned at the upper side of the lower body 110. The upper surface 220*a* of the base 220 is positioned at the upper side of the lower body 110. The base 220 is coupled to the lower body 110 to be movable forward and backward.

The moving body 200 may be configured to include the turntable 230. The turntable 230 is rotatably coupled around a perpendicular rotational axis 231 at the upper side of the base 220. The turntable 230 is configured in a circular plate form. The upper surface of the turntable 230 may be configured to be in parallel to the first direction X and the second direction Y.

A turntable accommodation portion 221 accommodating the turntable 230 may be provided in the base 220. The table accommodation portion 221 may be configured in a concave form at the center of the upper surface 220*a* of the base 220. As a result, a height of the upper surface of the table accommodation portion 221 is configured to be a little lower than the height of the upper surface 220*a* of the base 220 except for the table accommodation portion 221. The table accommodation portion 221 may be configured in a circular shape on plan view. A shape and a size of the table accommodation portion 221 are configured to correspond to the shape and the size of the turntable 230.

While the turntable 230 is coupled to the base 220, the height of the upper surface 220*a* of the base 220 except for the table accommodation portion 221 may be configured to correspond to or coincide with the height of the upper surface of the turntable 230.

While the transparent window 210 and the base 220 move forward with respect to the body 100, the shoe may be seated on the base 220 or the shoe may be withdrawn from the base 220 through the space between the upper body 130 and the first window 211. Further, in this case, the user may access the shoe or an upper space through the space between the middle body 120 and the second window 212 or between the middle body 120 and the third window 213. Further, in this case, the user easily accesses the inner surface of each of the lower body 110, the middle body 120, and the upper body 130 (see FIGS. 2*a* and 2*b*).

According to the embodiment of the present invention, it is convenient to withdraw and insert the shoe from and into the shoe care device 1, and positioning the shoe is convenient.

As described above, the moving body 200 is configured to include the turntable 230 in the shoe care device 1 according to the embodiment of the present invention. Therefore, a shoe care device 1 may be provided in which both circulation of the air and rotation of the shoe are conducted in the accommodation space 10, and as a result, both the management of the shoe and the display effect of the shoe are excellent.

The moving body 200 may be configured to include a lower guard 240. The lower guard 240 is fixedly coupled to an outer side of a border of the base 220. The lower guard 240 is fixedly coupled to a front surface 220*b*, a left surface 220*c*, and a right surface 220*d* of the base 220 (see FIG. 7*a*).

The lower guard 240 may be configured substantially in the C shape (or ⊂ shape, π shape, or ⊓ shape) on the plan view. On the plan view, the shape of the lower guard 240 may be configured to correspond to the shape of the transparent window 210.

The lower guard 240 may be positioned outside the lower body 110.

The lower guard 240 is configured to include a first lower guard 240*a*, a second lower guard 240*b*, and a third lower guard 240*c*. The lower guard 240 may be integrally configured.

The first lower guard 240*a* forms the front surface of the lower guard 240. The outer surface and the inner surface of the first lower guard 240*a* may be configured to be orthogonal to the first direction X. The second lower guard 240*b* forms the left surface of the lower guard 240. The outer surface and the inner surface of the second lower guard 240*b* may be configured to be orthogonal to the second direction Y. The third lower guard 240*c* forms the right surface of the lower guard 240. The outer surface and the inner surface of the third lower guard 240*c* may be configured to be orthogonal to the second direction Y.

The first lower guard 240*a* may be positioned at the front side of a front end of the lower body 110. The second lower guard 240*b* may be positioned at the left side of a left end of the lower body 110. The third lower guard 240*c* may be positioned at the right side of a right end of the lower body 110.

Figure 9A:
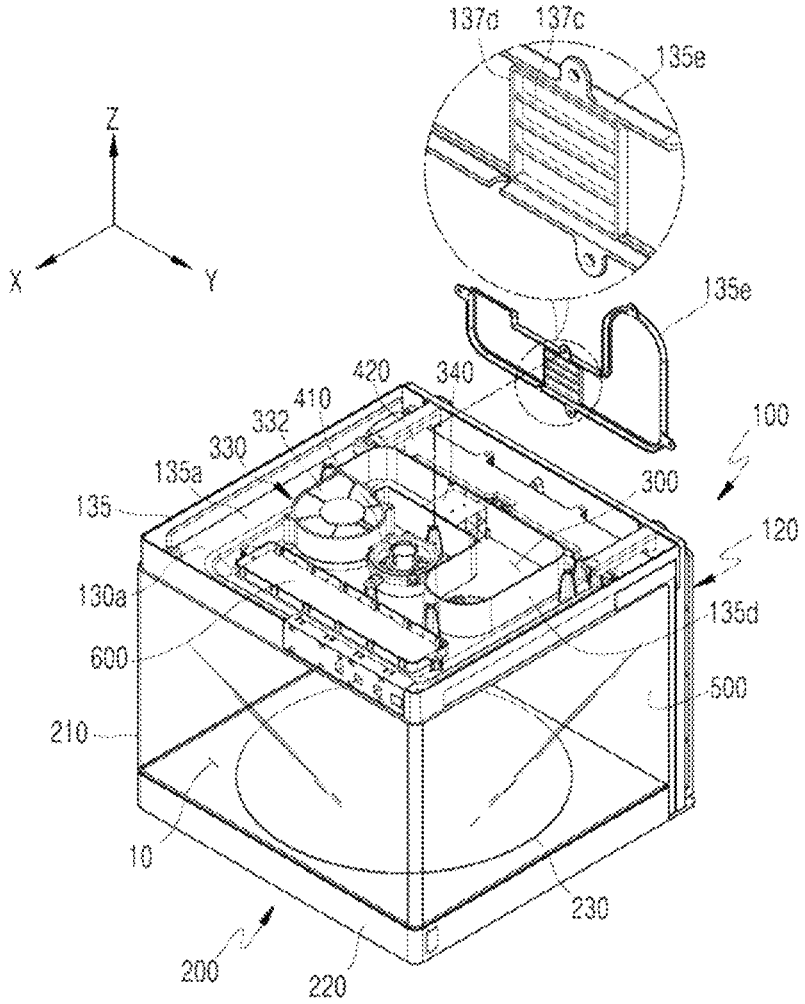
FIG. 9*a* is a perspective view illustrating a state in which the first external cabinet is removed from the body of the shoe care device of FIG. 1*a*.

FIG. 9*a* is a perspective view illustrating a state in which the first external cabinet 36 is removed from the body 100 of the shoe care device 1 of FIG. 1*a*. FIG. 9*a* illustrates a state in which a path cover 135*e* of the air path 300 is separated.

Figure 9B:
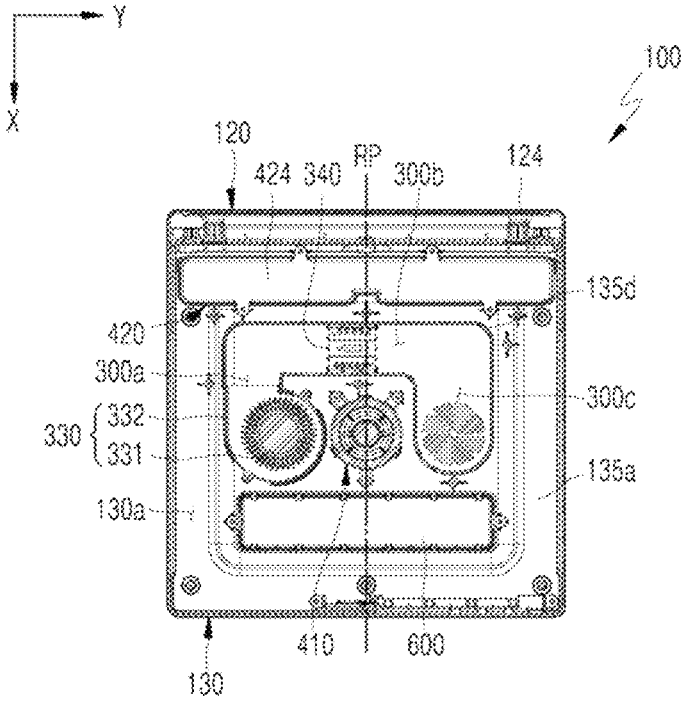
FIG. 9*b* is a cross-sectional view of the shoe care device of FIG. 3*a* taken along line B-B.

FIG. 9*b* is a cross-sectional view of the shoe care device 1 of FIG. 3*a* taken along line B-B.

As illustrated in FIGS. 9*a* and 9*b*, the shoe care device 1 according to the embodiment of the present invention may include the body 100, the moving body 200, the blowing part 330, the first light 410, and the air path 300.

The body 100 and the moving body 200 may form the accommodation space 10 accommodating the shoe S jointly. The body 100 and the moving body 200 may be coupled to move with respect to each other. The moving body 200 may be coupled to the body 100 to reciprocally move in the front and rear direction.

The body 100 may include the upper body 130. The upper body 130 may be positioned above the accommodation space 10. The upper body 130 may have an upper space 130*a* of which gas flow is disconnected from the accommodation space therein. The upper space 130*a* may have a hexahedral shape in which lengths in the first direction X and the second direction Y are larger than a length in the third direction Z.

The upper body 130 may include a first internal cabinet 135 and a first external cabinet 136. The first internal cabinet 135 and the first external cabinet 136 may form the accommodation space 10 jointly.

As illustrated in FIG. 9*a*, the first internal cabinet 135 may have a rectangular box shape opened upward. The first internal cabinet 135 may have an air path 300 connected to the accommodation space 10. The first internal cabinet 135 may include the upper bottom plate 135*a*, a path barrier 135*d*, and the path cover 135*e*.

The upper bottom plate 135*a* may partition the accommodation space 10 and the upper space 130*a*. The upper bottom plate 135*a* may have a plate shape which is wide in the horizontal direction. The lower surface of the upper bottom plate 135*a* may form the upper surface of the accommodation space 10.

The upper surface of the top bottom plate 135*a* may form the bottom of the upper space 130*a*. The suction port 310 and the discharge port 420 may be formed on the upper bottom plate 135*a*. The air in the accommodation space 10 may be suctioned into the air path 300 through the suction port 310. The air in the air flow path 300 may be discharged to the accommodation space 10 through the discharge port 320.

The accommodation space 10 may exchange thermal energy with outside air through the first external cabinet 136. Therefore, the temperature of the accommodation space 10 may vary depending on the temperature of the outside air. The air path 300 is provided above the accommodation space 10, and the air flow the air path 300 to/from the upper space 130*a* may be stopped.

Therefore, the shoe care device 1 according to the embodiment of the present invention may control the temperature of air circulated in the accommodation space 10 and the air path 300 regardless of the temperature variation of the outside air. Therefore, the accommodation space 10 may maintain an optimal temperature at which the shoe S may be appropriately kept.

The blowing part 330 is a component that circulates the air in the accommodation space 10 and the air path 300. The blowing part 330 and the air path 300 may be provided above the upper bottom plate 135*a*.

The blowing part 330 may include the fan 331 and the fan housing 332. The fan 331 may pressure-feed the air by the rotary movement of the impeller. The fan 331 may be provided inside the air path 300.

A power supply (not illustrated) may be provided in the base 220. The power supply may supply power to the fan 331. The controller 600 may control the power supplied to the fan 331 from the power supply.

The fan housing may be coupled to the top of the upper bottom plate 135*a* above the suction port 310. The fan housing 332 may be provided inside the air path 300 above the suction port 310. Alternatively, the fan housing 332 may constitute a part of the air path 300 above the suction port 310.

The path barrier 135*d* may protrude upward on the top of the upper bottom plate 135*a*. The path barrier 135*d* may form a side all of the air path 300 jointly with the fan housing 332.

The path cover 135*e* may close an upper opening of the path barrier 135*d*. The path cover 1353 may form a ceiling portion of the air path 300 jointly with the fan housing 332. The path cover 135*e* may be detachably coupled to the upper bottom plate 135*e* by the bolt.

Figure 10A:
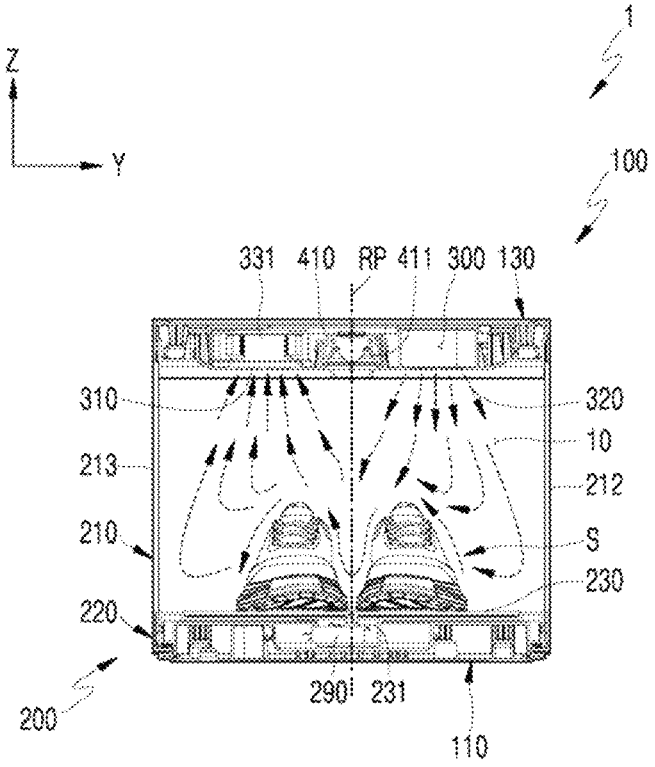
FIG. 10*a* is a cross-sectional view of the shoe care device of FIG. 3*b* taken along line C-C.

FIG. 10*a* is a cross-sectional view of the shoe care device 1 of FIG. 3*b* taken along line C-C. FIG. 10*a* illustrates an air flow in the accommodation space while the front side of the shoe S faces the front side in the first direction X.

Figure 10B:
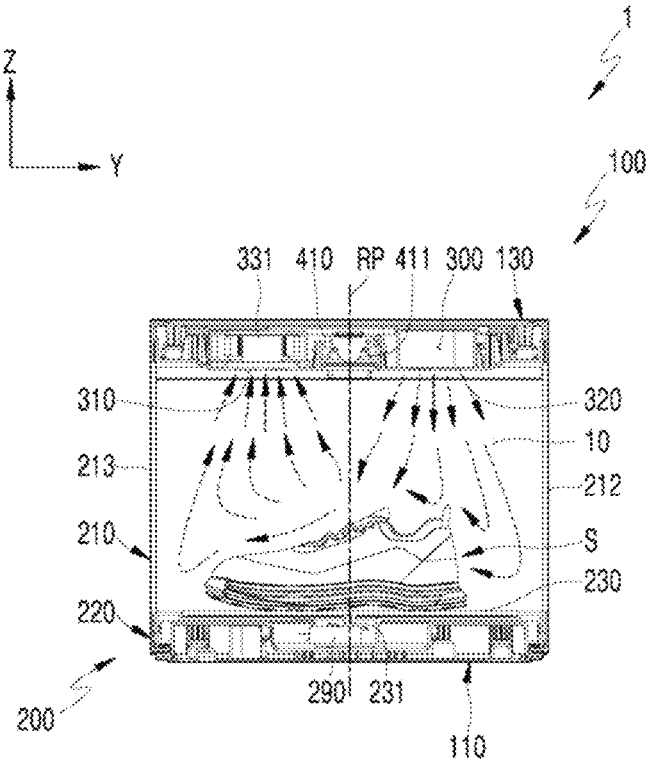
FIG. 10*b* is a cross-sectional view of the shoe care device of FIG. 3*b* taken along line C-C.

FIG. 10*b* is a cross-sectional view of the shoe care device 1 of FIG. 3*b* taken along line C-C. FIG. 10*b* illustrates the air flow in the accommodation space while the front side of the shoe S faces the rear side in the second direction Y.

As illustrated in FIGS. 10*a* and 10*b*, the moving body 200 may include the base 220, the turntable 230, and the transparent window 210.

The body 100 may include the lower body 110. The lower body 110 may be positioned below the accommodation space 10. The base 220 may be coupled to the lower body 110 to be relatively movable in the front and rear direction so as to open/close the accommodation space 10. The transparent window 210 may be coupled to the base 220. The transparent window 210 may form the front surface, and both side surfaces (the left surface and the right surface) of the accommodation space 10.

The turntable 230 may be rotatably coupled to the base 220 around a vertical axis 231. The base 220 and the turntable 230 may form the lower surface of the accommodation space 10 jointly. The upper surface of the turntable 230 may have the circular shape around the vertical axis 231.

The motor 290 may be provided in the base 220. The motor 290 may deliver the rotary movement to the turntable 230. The rotational axis 231 of the turntable 230 may be in line with the vertical direction. The axis of the motor 290 may be directly coupled to the rotational axis 231 of the turntable 230.

The first light 410 may irradiate light to the top of the turntable 230 on which the shoe S is placed on the extension line of the vertical axis 231. The first light 410 may be coupled to the upper bottom plate 135*a*.

As illustrated in FIG. 9*b*, the suction port 310 and the discharge port 320 of the air path 300 may be formed at opposite sides to each other in the horizontal direction based on the first light 410. A path of the air path 300 may be formed along a horizontal circumference of the first light 410.

The first light 410 may be provided on the extension line of the vertical axis 231. Therefore, the suction port 310 and the discharge port 320 of the air path 300 may be formed at opposite sides to each other in the horizontal direction based on the extension line of the vertical axis 231. The accommodation space 10 may be parallel to the first direction X which is the horizontal direction and form the symmetry based on the reference surface RP which is the vertical surface. The extension line of the vertical axis 231 may be positioned within the reference plane RP.

As the first light 410 and the air path 300 are placed in the upper space 130*a* in the horizontal direction, the upper space 130*a* may be formed to have a low height. An increase in height of the upper space 130*a* may be in proportion to an increase in volume of the shoe care device 1. A volume increase of home appliances may be a major factor which reduces installability and usability, and raises product prices.

The first light 410 and the air path 300 are placed in the upper space 130*a* in the horizontal direction, and as a result, the upper space 130*a* may be efficiently utilized, and the installability and usability of the shoe care device 1 may be increased.

As an example, the suction port 310 and the discharge port 320 of the air path 300 may be formed at opposite sides to each other based on the first light 410. In this case, the path of the air path 300 may be formed along the horizontal circumference of the first light before or behind the first light 410 in the first direction X.

Alternatively, the suction port 310 and the discharge port 320 of the air path 300 may also be formed at opposite sides to each other in the front and rear direction based on the first light 410. In this case, the path of the air path 300 may be formed along the horizontal circumference of the first light 410 before or behind the first light 410 in the second direction Y.

A placement form of the suction port 310, the discharge port 320, and the air path 300 based on the first light 410 may be decided in association with the placement of the controller 600 and the second light 420.

When the controller 600 is placed in front in the second direction Y in the upper space 130*a*, the suction port 310 and the discharge port 320 of the air path 300 may be formed at opposite sides to each other in the front and rear direction based on the first light 410. In this case, the path of the air path 300 may be formed along the horizontal circumference of the first light 410 behind the first light 410 in the second direction Y.

Alternatively, when the controller 600 is placed in the rear in the second direction Y in the upper space 130*a*, the suction port 310 and the discharge port 320 of the air path 300 may be formed at opposite sides to each other in the front and rear direction based on the first light 410. In this case, the path of the air path 300 may be formed along the horizontal circumference of the first light 410 before the first light 410 in the second direction Y.

As illustrated in FIG. 9*b*, when the controller 600 is placed in front in the first direction X in the upper space 130*a*, the suction port 310 and the discharge port 320 of the air path 300 may be formed at opposite sides to each other in the left and right direction based on the first light 410. In this case, the path of the air path 300 may be formed along the horizontal circumference of the first light 410 behind the first light 410 in the first direction X.

As illustrated in FIGS. 10*a* and 10*b*, the suction port 310 and the discharge port 320 may form the same gap from the vertical axis 231. That is, the suction port 310 and the discharge port 320 of the air path 300 may be formed at opposite sides to each other in the horizontal direction based on the vertical axis 231, and spaced apart with the same gap from the vertical axis 231.

Therefore, an area where the air drops descends at the discharge port 320 as a starting point and an area where the air rises at the suction port 310 as an ending point in the accommodation space 10 are parallel to the first direction X which is the horizontal direction, and are divided based on the reference plane RP which is the vertical plane, and as a result, the air circulation in the accommodation space 10 may be smooth. Further, even though a direction in which the shoe S is placed is changed while the turntable 230 rotates, a uniform air flow may be formed on the entire surface of the shoe S placed on the top.

As illustrated in FIGS. 9*a* and 9*b*, the air path 300 may include a first path 300*a*, a second path 300*b*, and a third 300*c*.

The first path 300*a* may be formed to extend to the rear side in the first direction X from the upper portion of the suction port 310. The first path 300*a* may form a path in which the air in the accommodation space 10 suctioned from the suction port 310 by the blowing part 330 flows to the rear in the first direction X.

The fan housing may form a part of the first path 300*a*. The path barrier 135*d* constituting the first path 300*a* may be coupled to a side portion of the fan housing 332. The path cover 1353 constituting the first path 300*a* may be coupled to a top portion of the fan housing 332. The upper bottom plate 135*a* may form the bottom of the first path 300*a*.

The third path 300*c* may be formed to extend to the rear side in the first direction X from the upper portion of the discharge port 320. The third path 300*c* may form a path in which the air in the second path 300*b* flows to the front in the first direction X. The air in the third path 300*c* may be discharged to the accommodation space 10 through the discharge port 320.

The second path 300*b* may be formed to connect the first path 300*a* and the third path 300*c* in the second direction Y. The second path 300*b* may form a path in which the air in the first path 300*a* flows to the front in the second direction Y. The heating part 340 may be provided in the second path 300*b*. The heating part 340 may deliver thermal energy to the air which moves in the air path 300.

The path barrier 135*d* may form side surfaces of the second path 300*b* and the third path 300*c*. The path cover 1353 may form tops of the second path 300*b* and the third path 300*c*. The upper bottom plate 135*a* may form bottoms of the second path 300*b* and the third path 300*c*.

Figure 11:
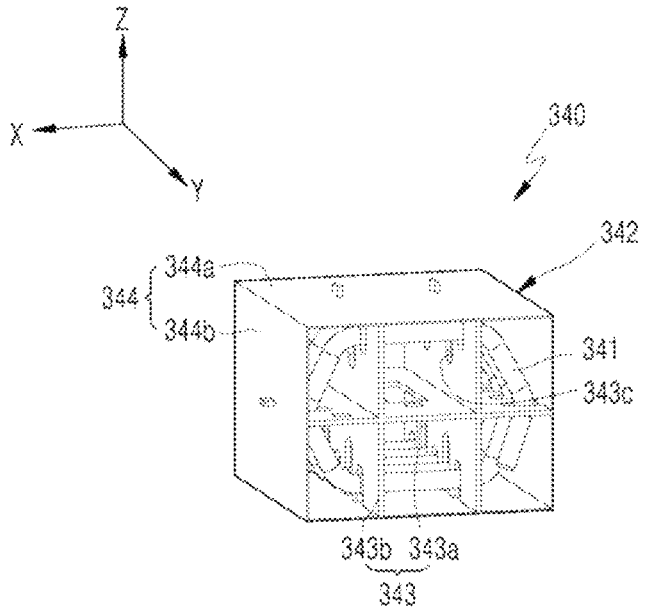
FIG. 11 is a perspective view illustrating the heating part of the shoe care device of FIG. 9*a*.

FIG. 11 is a perspective view illustrating the heating part 340 of the shoe care device 1 of FIG. 9*a*.

Figure 12:
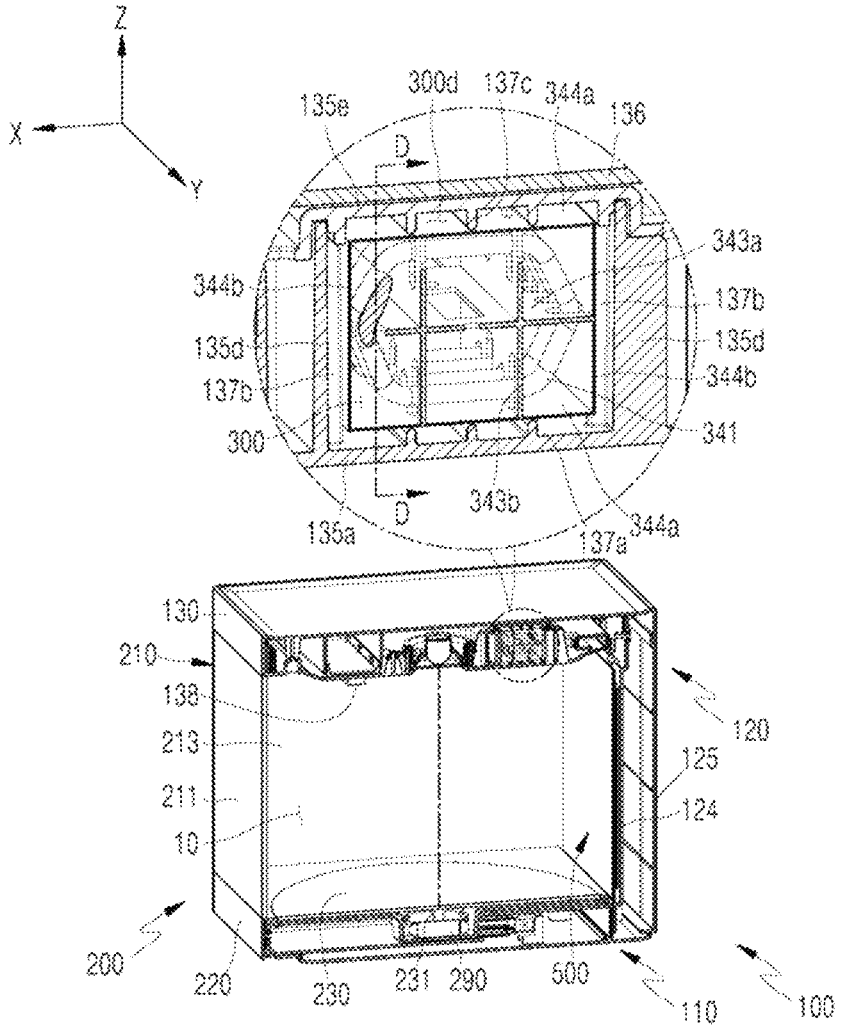
FIG. 12 is a perspective cross-sectional view of the shoe care device of FIG. 3*a* taken along line A-A.

FIG. 12 is a perspective cross-sectional view of the shoe care device 1 of FIG. 3*a* taken along line A-A. FIG. 12 does not illustrate the shoe S.

As illustrated in FIGS. 11 and 12, the heating part 340 may include the heat wire 341 and the heat dissipation member 342.

The heat wire 341 may be a hot wire for generating heat through current. The controller 600 controls the current which flows on the heat wire 341 to control the temperature of the heating part 340. The heat wire 341 may be connected to the heat dissipation member 342.

A power supply (not illustrated) may be provided in the base 220. The power supply may supply power to the heat wire 341. The controller 600 may control the power supplied to the heat wire 341 from the power supply.

The measurement sensor 138 that measures the temperature and/or the humidity of the accommodation space 10 may be installed at one side of the accommodation space 10. The measurement sensor 138 may be installed in the upper body 130, the middle body 120, or the base 220. As an example, the measurement sensor 138 may be installed on the upper bottom plate 135*a*. The controller 600 may receive the measurement value of the measurement sensor 138.

The operating time and the operating pattern of the blowing part 330 and the heating part 340, and the current amount applied to the heating part 340 according to the measurement value of the load sensor may be set in the controller 600.

The user may input the operating time and the operating pattern of the blowing part 330 and the heating part 340, and the current amount applied to the heating part 340 according to the temperature and/or the humidity of the accommodation space 10 into the controller through the operating button 610.

The controller 600 may control the current applied to the heat wire 341 according to the measurement value of the measurement sensor 138. The temperature of the heat wire 341 may vary depending on the measurement value of the measurement sensor 138. Therefore, the shoe care device 1 according to the embodiment of the present invention controls the temperature and/or the humidity of the accommodation space 10 to completely interrupt the deformation or the contamination of the shoe S.

As illustrated in FIG. 9*b*, the heat dissipation member 342 may form a contact surface with the air which moves in the air path 300. Therefore, the thermal energy of the heat wire 341 may be delivered to the air which flows in the air path 300 through the heat dissipation member 342.

As illustrated in FIGS. 11 and 12, the heat dissipation member 342 may include a first heat dissipation plate 343 and a second heat dissipation plate 344. The first heat dissipation plate 343 may include a first horizontal heat dissipation plate 343*a* and a first vertical heat dissipation plate 343*b*.

The first horizontal heat dissipation plate 343*a* may be formed in a plate shape parallel to the upper bottom plate 135*a*. The top and the bottom of the first horizontal heat dissipation plate 343*a* may form the contact surface with the air which flows in the air path 300. One or more first horizontal heat dissipation plates 3 may be provided. A plurality of first horizontal heat dissipation plates 3 may be spaced apart in the vertical direction.

The first vertical heat dissipation plate 343*b* may be formed in the plate shape parallel to an adjacent path barrier 135*d*. Both surfaces of the first vertical heat dissipation plate 343*b* may form the contact surface with the air which flows in the air path 300. One or more first vertical heat dissipation plates 343*b* may be provided. A plurality of first vertical heat dissipation plates 343*b* may be spaced apart in the width direction of the air path 300.

A thermal fuse may be coupled to any one of the first horizontal heat dissipation plate 343*a* and the first vertical heat dissipation plate 343*b*. The thermal fuse is deformed or melted at a setting temperature to open an electrical circuit. Therefore, overheating and fire of the shoe care device 1 may be prevented.

A plurality of winding holes 343*c* may be formed on the first horizontal heat dissipation plate 343*a* and the first vertical heat dissipation plate 343*b*.

Figure 13A:
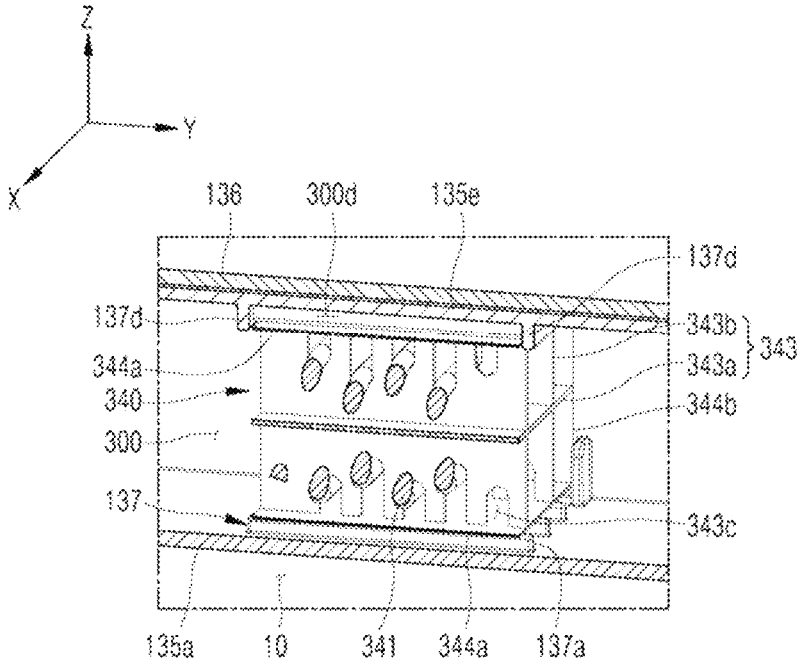
FIG. 13*a* is a perspective cross-sectional view of the air path of the shoe care device of FIG. 12 taken along line D-D.

FIG. 13*a* is a perspective cross-sectional view of the air path 300 of the shoe care device 1 of FIG. 24 taken along line D-D.

As illustrated in FIG. 13*a*, the winding holes 343*c* of the first horizontal heat dissipation plate 343*a* may be spaced apart from each other in a movement direction of the air which flows in the air path 300. The winding holes 343*c* of the first vertical heat dissipation plate 343*b* may be spaced apart from each other in the movement direction of the air which flows in the air path 300. The heat wire 341 may be wound while passing through the winding holes 343*c* of the first horizontal heat dissipation plate 343*a* and the first vertical heat dissipation plate 343*b*.

The winding holes 343*c* may be formed in a zigzag form in a path direction of the air path 300. All of the winding holes 343*c* of the first horizontal heat dissipation plate 343*a* and the first vertical heat dissipation plate 343*b* may be formed in the zigzag form in the path direction of the air path 300. Alternatively, only the winding holes 343*c* of any one of the first horizontal heat dissipation plate 343*a* and the first vertical heat dissipation plate 343*b* may be formed in the zigzag form in the path direction of the air path 300.

As illustrated in FIG. 13*a*, only the winding holes 343*c* of the first vertical heat dissipation plate 343*b* may be formed in the zigzag form in the path direction of the air path 300. Therefore, the heat wire 341 wound on the winding holes 343*c* of the first vertical heat dissipation plate 343*b* may be undulated with each other in the vertical direction. Therefore, thermal energy directly delivered from the heat wire 341 to the air may increase.

Therefore, even though the controller 600 supplies relatively small current to the heat wire 341, larger thermal energy may be delivered to the air which flows in the accommodation space 10. Therefore, a current amount required for operating the shoe care device 1 may be reduced.

Figure 13B:
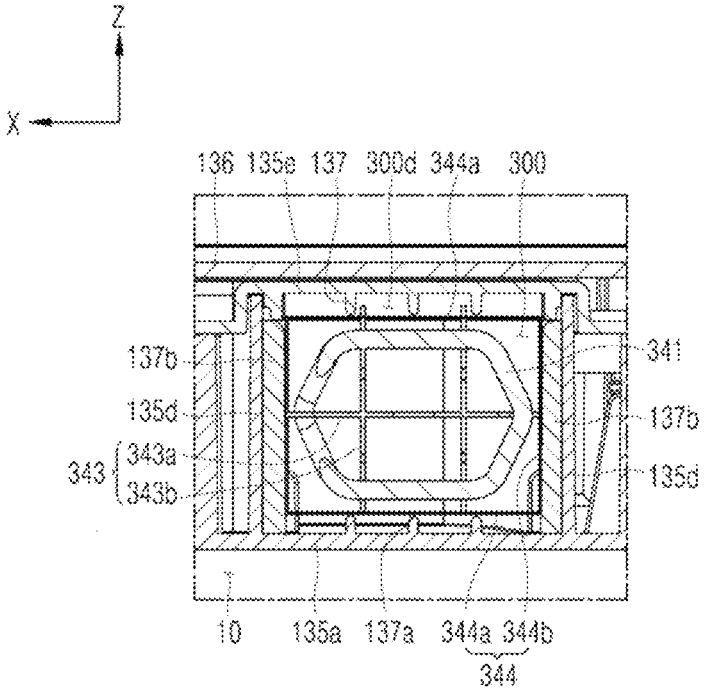
FIG. 13*b* as a partial enlarged diagram of the shoe care device of FIG. 12 illustrating the air path and the heating part.

FIG. 13*b* as a partial enlarged diagram of the shoe care device 1 of FIG. 24 is a diagram illustrating the air path 300.

As illustrated in FIGS. 13*a* and 13*b*, a spacing projection portion 137 may be formed on the inner surface of the air path 300. The spacing projection portion 137 may be project from the inner surface of the air path 300. The heat dissipation member 342 may be separated from the inner surface of the air path 300 by the spacing projection portion 137.

The spacing projection portion 137 may include a first spacing projection portion 137*a*, a second spacing projection portion 137*b*, and a third spacing projection portion 137*c*.

The first spacing projection portion 137*a* may be projected toward the air path 300 from the top of the upper bottom plate 135*a*. The second spacing projection portion 137*b* may be projected toward the air path 300 from both inner surfaces of the path barrier 135*d*. The third spacing projection portion 137*c* may be projected toward the air path 300 from the bottom of the path cover 135*e*.

As illustrated in FIGS. 13*a* and 13*b*, the second heat dissipation plate 344 may be formed to be in line with the inner surface of the air path 300. The second heat dissipation plate 344 may include a second horizontal heat dissipation plate 344*a* and a second vertical heat dissipation plate 344*b*.

The second horizontal heat dissipation plate 344*a* may be coupled to each of the upper portion and the lower portion of the first horizontal heat dissipation plate 343*a*. The second horizontal heat dissipation plate 344*a* may form the contact surface with the air which flows in the air path 300.

The lower second horizontal heat dissipation plate 344*a* may be formed in the plate shape parallel to the upper bottom plate 135*a*. The lower second horizontal heat dissipation plate 344*a* may be spaced upward from the top of the upper bottom plate 135*a* by the first spacing projection portion 137*a*.

The first spacing projection portion 137*a* may be formed to be long in line with the path direction of the air path 300. Therefore, a path in which air flows may be formed between the lower second horizontal heat dissipation plate 344*a* and the upper bottom plate 135*a*. Therefore, the thermal energy of the air path 300 may be delivered to the accommodation space 10 in the form of heat conducting through the upper bottom plate 135*a*. Therefore, operation efficiency of the heating part 340 may be enhanced.

The upper second horizontal heat dissipation plate 344*a* may be formed in the plate shape parallel to the path cover 135*e*. The upper second horizontal heat dissipation plate 344*a* may be spaced downward from the bottom of the path cover 1353 by the third spacing projection portion 137*c*.

As illustrated in FIGS. 13*a* and 13*b*, the upper body 130 may include the first external cabinet 136 that partitions the outside and the upper space 130*a*. A wall surface of the air path 300 may be spaced apart from the first external cabinet 136 in the upper and lower direction. That is, the path cover 135*e* may be spaced apart from the first external cabinet 136 in the upper and lower direction.

As described above, an increase in height of the upper space 130*a* may be in proportion to an increase in volume of the shoe care device 1. A volume increase of home appliances may be a major factor which reduces installability and usability, and raises product prices. Therefore, an up-down direction spacing distance between the path cover 135*e* and the first external cabinet 136 should be minimized.

However, as the up-down direction spacing distance between the path cover 135*e* and the first external cabinet 136 decreases, an amount of the thermal energy of the air path 300, which is dispersed to the outside air increases by the heat delivery through the path cover 135*e* and the first external cabinet 136, so the operating efficiency of the heating part 340 may be lowered.

As illustrated in FIG. 9*a*, an isolation projection portion 137*d* may be formed at a portion close to the first external cabinet 136 on the inner surface of the air path 300. The portion close to the first external cabinet 136 on the inner surface of the air path 300 may mean the bottom of the path cover 135*e*.

As illustrated in FIGS. 13*a* and 13*b*, the isolation projection portion 137*d* may be formed to surround the edge of the upper second horizontal heat dissipation plate 344*a*. Therefore, the isolation projection portion 137*d* may isolate space (hereinafter, referred to as 'heat insulation space 300*d*') between the bottom of the path cover 135*e* and the upper second horizontal heat dissipation plate 344*a* from the air path 300.

The heat insulation space 300*d* may form a space isolated from the air path 300 and the upper space 130*a*. Therefore, the thermal energy of the air path 300 delivered to the path cover 135*e* may be reduced by the heat insulation space 300*d*.

Therefore, even though the up-down direction spacing distance between the path cover 135*e* and the first external cabinet 136 decreases, the amount of the thermal energy of the air path 300, which is dispersed to the outside air is minimized by the heat delivery through the path cover 135*e* and the first external cabinet 136, so the operating efficiency of the heating part 340 may be enhanced.

The second horizontal heat dissipation plate 344*b* may be coupled to each of the left side and the right side of the first horizontal heat dissipation plate 343*a*. The second vertical heat dissipation plate 344*b* may be formed in the plate shape parallel to the adjacent path barrier 135*d*. The second vertical heat dissipation plate 344*b* may form the contact surface with the air which flows in the air path 300. The second vertical heat dissipation plate 344*b* may be spaced apart from the path barrier 135*d* by the second spacing projection portion 137*d*.

When the thermal energy of the air path 300 is dispersed to the upper space 130*a* by the heat delivery through the path barrier 135*d*, the operating efficiency of the heating part 340 may be lowered.

The second spacing projection portion 137*b* may be formed to be long in an orthogonal direction to the path direction of the air path 300. The second spacing projection portion 137*b* may prevent the air flow between the path barrier 135*d* and the second vertical heat dissipation plate 344*b*. Therefore, the thermal energy of the air path 300 delivered to the upper space 130*a* between the path barrier 135*d* and the second vertical heat dissipation plate 344*b* may be reduced.

Therefore, even though the spacing distance between the path barrier 135*d* and the second vertical heat dissipation plate 344*b* decreases, the amount of the thermal energy of the air path 300, which is dispersed to the upper space 130*a* is minimized by the heat delivery through the path barrier 135*d*, so the operating efficiency of the heating part 340 may be enhanced.

Figure 14:
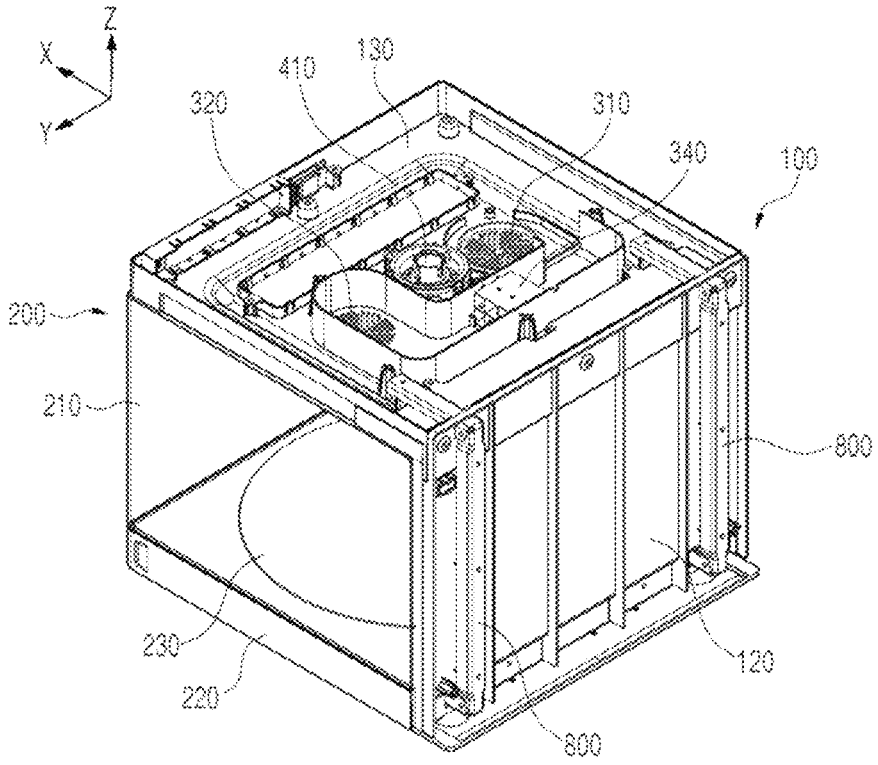
FIG. 14 is a diagram illustrating a state in which the body is reinforced by a frame body in the shoe care device according to an embodiment of the present invention.
Figure 15A:
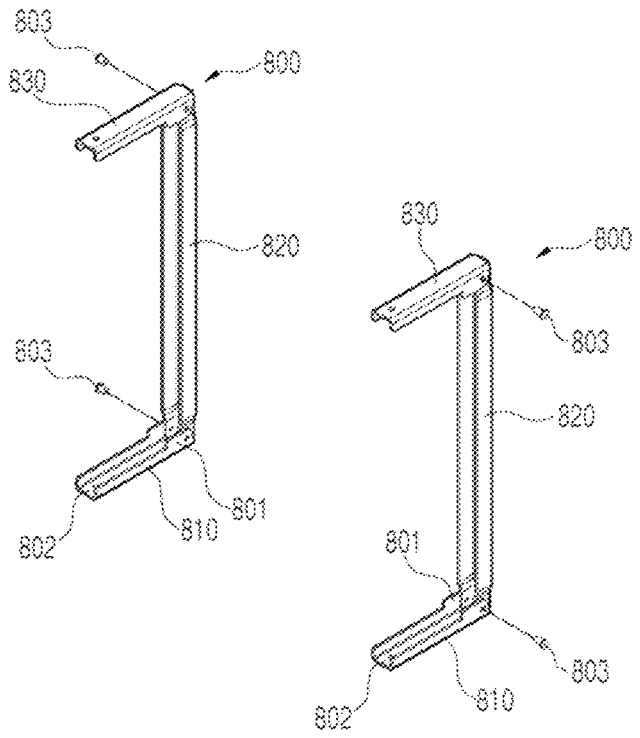
FIGS. 15*a* and 15*b* are diagrams illustrating the frame body in the shoe care device according to an embodiment of the present invention.
Figure 15B:
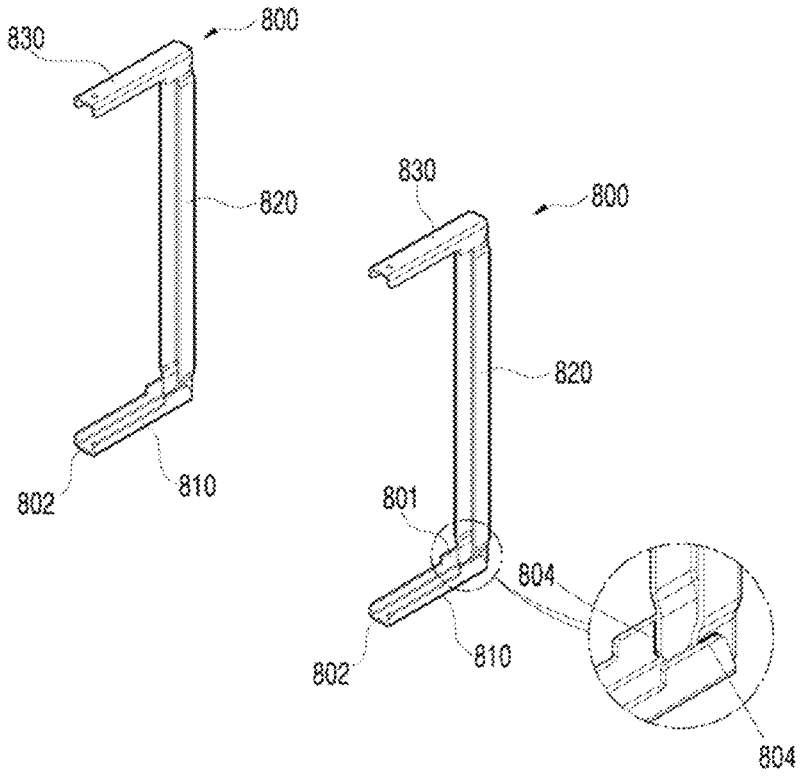
Figure 16:
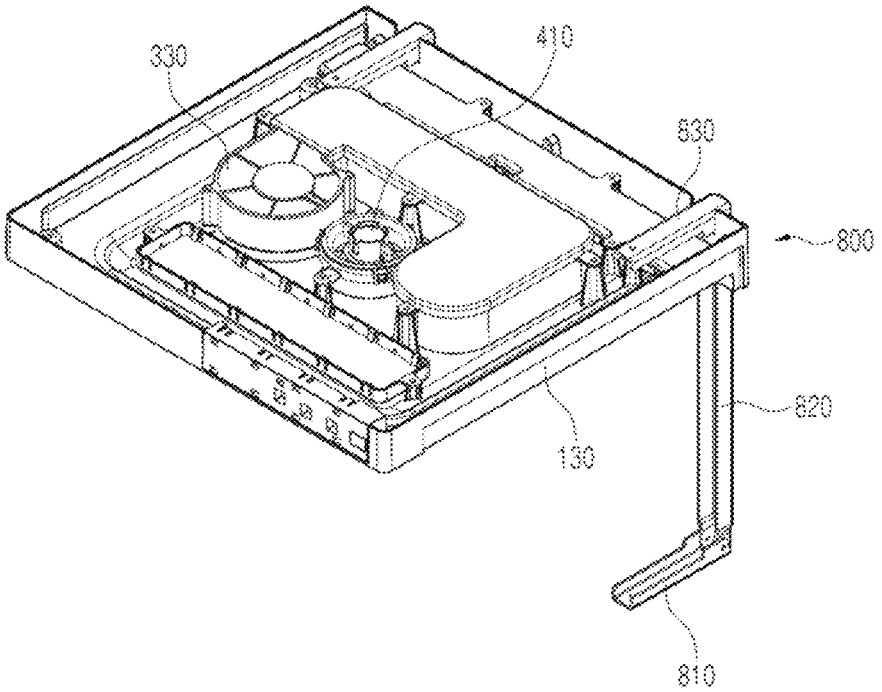
FIGS. 16 to 20 are diagrams exemplarily illustrating a coupling state of the body 100 and the frame body 800 in the shoe care device 1 according to an embodiment of the present invention.
Figure 17:
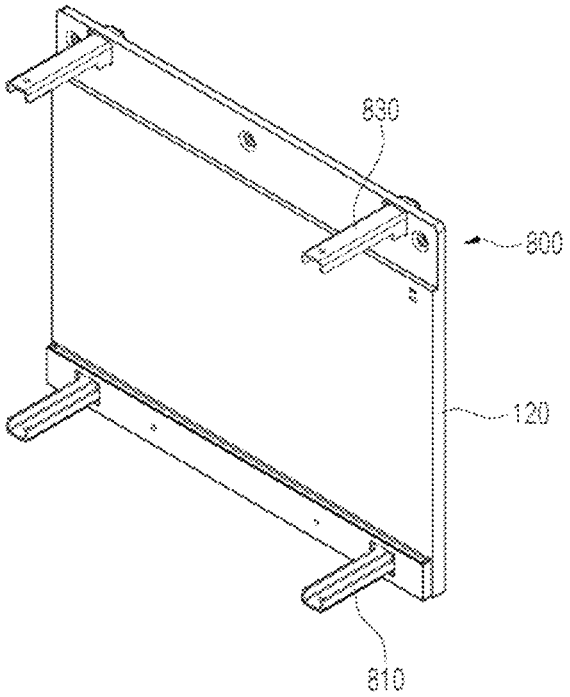
Figure 18:
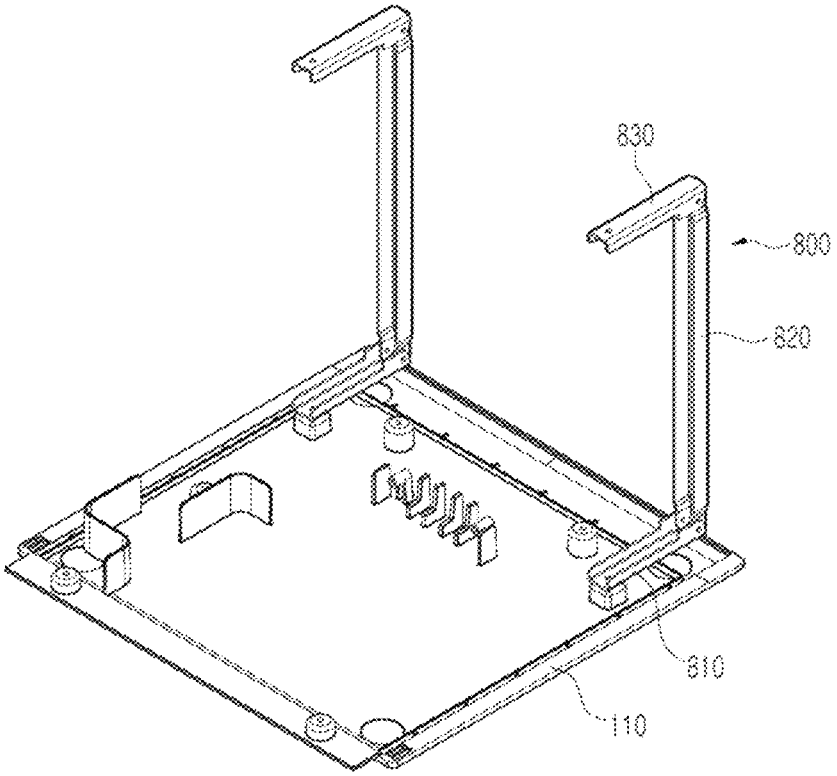
Figure 19:
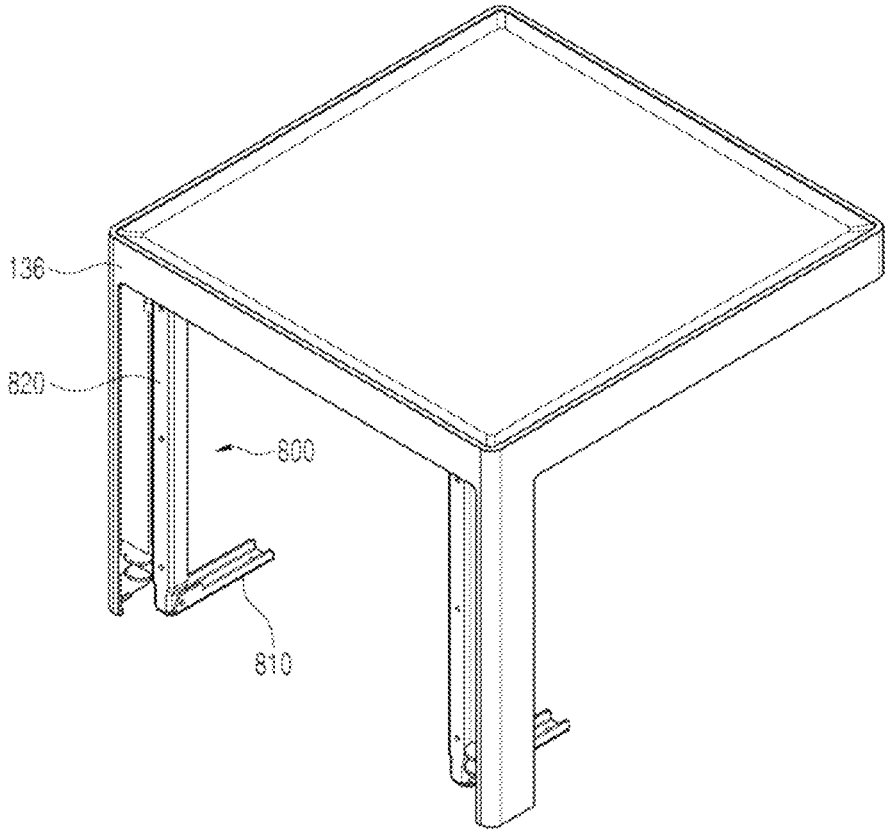
Figure 20:
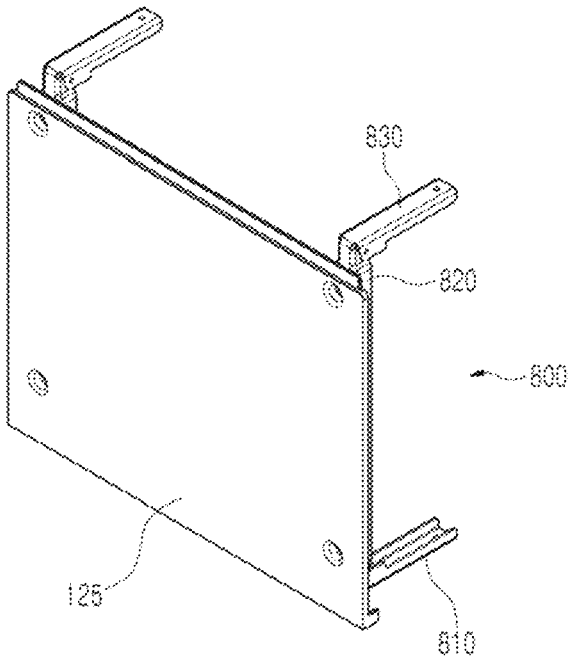

FIG. 14 is a diagram illustrating a state in which the body 100 is reinforced by a frame body 800 in the shoe care device 1 according to an embodiment of the present invention. FIGS. 15*a* and 15*b* are diagrams illustrating the frame body 800 in the shoe care device 1 according to an embodiment of the present invention. FIGS. 16 to 20 are diagrams exemplarily illustrating a coupling state of the body 100 and the frame body 800 in the shoe care device 1 according to an embodiment of the present invention.

According to an embodiment of the present invention, the shoe care device 1 may include the body 100, the moving body 200, the blowing part 330, and the frame body 800.

The body 100 as a part that forms a part of the accommodation space 10 may constitute a reference location for the moving body 200 which slidably moves.

The moving body 200 is a part that forms the accommodation space 10 jointly with the body 100, and is coupled to the body 100 to slidably move between the first location and the second location in front of the first location.

The blowing part 330 as a part configured to circulate the air in the accommodation space 10 may allow the shoe accommodated in the accommodation space 10 to be paced in an appropriate environment by adjusting an air state (in particular, humidity) of the accommodation space 10.

The frame body 800 as a part that is coupled to the body 100 and supports the body 100 in a shape of connecting the upper surface, the lower surface, and the rear surface of the body 100 may reinforce each connection portion of the body 100 which has a relatively vulnerable rigidity structurally.

As described above, in order to for the moving body 200 to slidably move with respect to the body 100, the front surface of the body 100 needs to be opened to correspond to the shape of the moving body 200. Therefore, the body 100 should be formed in a structure to approximately support even a load applied to the opened front surface at portions other than the front surface.

However, in that the body 100 has various components placed therein, and it is possible to form the size or the rigidity to be unlimitedly large, it is necessary to reinforce a structurally vulnerable portion with a separate reinforcing member.

In particular, when the body 100 is formed in a shape in which the front surface is opened, it is necessary to support even the load applied to the front surface on the reaming upper surface, lower surface, and the rear surface, so it may be preferable to reinforce each connection portion of the parts.

As such, in the shoe care device 1 according to the embodiment, since the frame body 800 is coupled to the body 100 in a shape connecting the upper surface, the lower surface, and the rear surface of the body 100 to support the body 100, the shoe care device 1 may maintain a stable state by reinforcing a structural vulnerable part in the body 100.

The shoe care device 1 according to an embodiment of the present invention may further include the heating part 340 configured to heat the circulated air in the accommodation space 10 to appropriately maintain the environment of the accommodation space 10, thereby more effectively caring the shoe.

Further, in the shoe care device 1 according to an embodiment of the present invention, the body 100 includes the upper body 130 forming the top of the accommodation space 10, the lower body positioned below the accommodation space 10, and the middle body 120 forming the rear surface of the accommodation space 10 by connecting the rear sides of the upper body 130 and the lower body 110, and the moving body 200 includes the base 220 slidably coupled to the lower body 110 and the transparent window 210 extending upward on the base 220 and forming the front surface and both side surfaces of the accommodation space 10 to stably maintain the connection structure of the body 100 and the moving body 200 in the process of the sliding movement of the moving body 200 with respect to the body 100.

In the shoe care device 1 according to an embodiment of the present invention, the frame body 800 may be configured to include an upper frame 830 coupled to the upper body 130, a lower frame 810 coupled to the lower body 110, and a middle frame 820 connecting rear sides of the upper frame 830 and the lower frame 810 and coupled to the middle body 120.

As described above, the body 100 in which the lower body 110, the middle body 120, and the upper body 130 are combined is configured in the C shape when viewed from the side, so the body 100 may form three surfaces of the shoe care device 1 in the 3D space.

Therefore, since the upper body 130 and the lower body 110 are formed in a shape of being projected forward from the middle body 120, the structure for supporting the load there may not actually be present at the front ends of the upper body 130 and the lower body 110.

In particular, in that the upper body 130 is a kind of cantilever structure formed to be projected from the middle body 120, if the middle body 120 does not appropriately support the upper body 130, there may be a problem in that the front end of the upper body 130 is drooped.

In this case, in that there is a structural limit to support the upper body 130 only with the middle body 120, it may be preferable to reinforce the connection portion of the lower body 110 and the middle body 120 through the frame body 800, and then reinforce both the middle body 120 and the upper body 130 through the frame body 800.

Therefore, it may be preferable to achieve reinforcement in a structure of connecting the upper body 130, the lower body 110, and the middle body 120 of the body 100 to each other through the upper frame 830, the lower frame 810, and the middle frame 820 of the frame body 800.

That is, the frame body 800 may also be formed in the C shape when viewed from the side, so it is possible to reinforce the structural vulnerable portion of the body 100 formed in the C shape.

As such, in the shoe care device 1 according to the embodiment, since the frame body 800 is configured to include the upper frame 830, the lower frame 810, and the middle frame 820, the vulnerable portion of the body 100 may be reinforced in the structure of connecting the upper body 130, the lower body 110, and the middle body 120 to each other.

Meanwhile, when a plurality of shoe care devices 1 is provided, any one shoe care device 1 may be placed on the upper surface of the upper body 130 of the other one shoe care device 1, and both the shoe care devices 1 may be stacked on each other.

In this case, in that the upper body 130 is a kind of cantilever (C) structure formed to be projected from the middle body 120, if the load of the shoe care device 1 stacked at the upper portion is applied to the front surface of the upper body 130 of the shoe care device 1 positioned at the lower portion, there may be a problem in that the front end of the upper body 130 is drooped.

Therefore, in the shoe care device 1 according to the embodiment, the frame body 800 is configured to be concentratedly placed on the rear surface of the body 100 to support the body 100.

That is, an overall center of gravity may move backward by the frame body 800 placed concentratedly on the rear surface of the body 100, so stress can be prevented from being concentrated on a front surface portion of the upper body 130 of the shoe care device 1 positioned below even though the plurality of shoe care devices are stacked on each other.

In the shoe care device 1 according to an embodiment of the present invention, the upper frame 830, the lower frame 810, and the middle frame 820 may be formed by bending one member which is formed to extend in a longitudinal direction.

As such, in order to form the frame body 800 in the C shape, it may be considered that the frame body 800 is manufactured by connecting three members to each other.

However, since multiple separate connection members for connecting three members to each other are required, manufacturing may be complicated, and there is a risk that there will be the structural vulnerability in that at least two complete cut surfaces are present in the frame body 800.

Therefore, it may be preferable that at least two in one member are bent and formed in the C shape to easily and firmly manufacture the frame body 800.

As such, in the shoe care device 1 according to the embodiment, since the frame body 800 including the upper frame 830, the lower frame 810, and the middle frame 820 is formed by bending one member which is formed to extend in the longitudinal direction, the frame body 800 may be easily manufactured, and a cutting surface of the frame body 800 corresponding to a reinforcing member may be minimized.

In the shoe care device 1 according to an embodiment of the present invention, the upper frame 830, the lower frame 810, and the middle frame 820 may be formed in a form of cutting a part of a flange 801 and bending a part of a web 802 in C-shaped channel steel.

By considering a secondary section modulus, it may be advantageous that the reinforcing member has a tubular or a C-shaped structure rather than a plate type structure. Among them, it may be preferable to form the frame body 800 with the C-shaped channel steel which is relatively easily bent in that it is difficult to bend the tubular structure.

Meanwhile, since it is difficult to bend the C-shaped channel steel as it is, the web 802 is not cut and only a part of the flange 801 is cut to relatively minimize the cut surface. In addition, the web 802 of the cut portion of the flange 801 is bent to form the frame body 800 having the C shape as a whole.

Therefore, one C-shaped channel steel may be easily formed as the frame body 800 including the upper frame 830, the lower frame 810, and the middle frame 820 while minimizing the cut surface.

As such, in the shoe care device 1 according to the embodiment, since the frame body 800 is formed in a form of cutting a part of the flange 801 and bending a part of the web 802 in the C-shaped channel steel, the rigidity of the frame body 800 formed by one C-shaped channel steel may be configured to be larger.

In the shoe care device 1 according to an embodiment of the present invention, in the upper frame 830, the lower frame 810, and the middle frame 820, a fastening member 803 may be fastened to the flange (801) portion overlapped after bending the web 802.

As such, when a part of the flange 801 is cut, and then the web 802 of the corresponding part is bent, cut flanges 801 may partially overlap with each other. Therefore, the fastening member 803 is fastened to the overlapped portions to stably maintain the bent portion in a stable state.

In particular, in that the cut part of the flange 801 may have relatively lowered rigidity, and the bent portion is a most vulnerable portion in terms of the structure of the frame body 800, it may be preferable to reinforce the corresponding portion with the fastening member 803.

As such, in the shoe care device 1 according to the embodiment, since the frame body 800 is formed in the structure in which the fastening member 803 is fastened to the overlapped portion of the flange 801 after bending the web 802, it is possible to prevent the bent portion of the C-shaped channel steel from being structurally vulnerable.

In the shoe care device 1 according to an embodiment of the present invention, in the upper frame 830, the lower frame 810, and the middle frame 820, the flange (801) portion overlapped after bending the web 802 is coupled by welding.

As illustrated in FIG. 15*b*, when a part of the flange 801 is cut, and then the web 802 of the corresponding part is bent, cut flanges 801 may partially overlap with each other. Therefore, the flange (801) portion overlapped after bending the web 802 is coupled by welding to stably maintain the bent portion in a stable state.

In particular, in that the cut part of the flange 801 may have relatively lowered rigidity, and the bent portion is a most vulnerable portion in terms of the structure of the frame body 800, it may be preferable to reinforce the corresponding portion with the weld bead 804.

As such, in the shoe care device 1 according to the embodiment, since the frame body 800 is formed in the structure in which the flange (801) portion overlapped after bending the web 802 is coupled by welding, it is possible to prevent the bent portion of the C-shaped channel steel from being structurally vulnerable.

In the shoe care device 1 according to an embodiment of the present invention, the frame body 800 may be placed inside the body 100.

As such, the frame body 800 need not be visually exposed to the user in that the frame body 800 is a member for reinforcing the structural vulnerable portion of the body 100.

In particular, when the frame body 800 is made of a metallic material such as the C-shaped channel steel, there is a risk that a problem such as corrosion of the frame body 800 exposed to the outside will occur.

Therefore, it may be preferable that the frame body 800 is placed inside the body 100 so as not to be exposed to the outside.

As such, in the shoe care device 1 according to the embodiment, since the frame body 800 is placed not to be exposed to the outside, the aesthetics may be visually provided by minimizing the exposure of a member not directly related to the function of the shoe care device 1.

In the shoe care device 1 according to an embodiment of the present invention, a plurality of frame bodies 800 may be placed in the left and right direction of the body 100.

It may be preferable to place the frame body 800 on an entire surface of the body 100 in order to reinforce the vulnerable portion of the body 100, but such a structure is uneconomical and there is a risk of increasing the load of the shoe care device 1.

Therefore, placing the plurality of frame bodies 800 at a predetermined interval within a range to securing the structural stability may be most effective by considering the structural rigidity and the economics of the product.

In this case, in order to prevent deformation such as structural distortions according to the rigidity imbalance of the shoe care device 1, it may be preferable that the frame body 800 is placed symmetric in the left and right direction of the body 100.

As such, in the shoe care device 1 according to the embodiment, since the plurality of frame bodies 800 are placed in the left and right direction of the body 100 to reinforce the body 100, the body 100 may be structurally reinforced more uniformly and stably.

In the shoe care device 1 according to an embodiment of the present invention, the moving body 200 further includes the turntable 230 coupled to the base 220 rotatably around the vertical axis, and forming the bottom of the accommodation space 10 jointly with the base 220 to rotate and display the shoe, and the air flow is formed in various direction of the shoe to achieve the uniform care throughout the shoe.

Further, in the shoe care device 1 according to an embodiment of the present invention, since the rotational axis 231 of the turntable 230 is positioned in front of the front end of the body 100 based on the state in which the moving body 200 is at the second location, sufficient opening for storing and withdrawing the shoe may be made while maintaining a stable state in the opening process of the accommodation space 10.

The shoe care device 1 according to an embodiment of the present invention further includes the stopping part 130*s* configured to restrict the sliding movement of the moving body 200 with respect to the body 100 to prevent separation of the body 100 and the moving body 200 or a reverse which occurs due to a change in center of gravity when the moving body 200 excessively moves for the opened state.

Meanwhile, as illustrated in FIGS. 16 to 20, for stable coupling of the body 100 and the frame body 800, each component of the body 100 and each component of the frame body 800 may be coupled in the following state.

The lower frame 810 may be configured to be long in the front and rear direction. The middle frame 820 may extend upward on the rear end of the lower frame 810. The upper frame 830 may extend upward on the upper end of the middle frame 820.

The upper body 130 may be coupled to the upper frame 830 of the frame body 800. In this case, while the member such as the bolt is fastened to the upper frame 830 and the upper body 130, the upper body 130 and the frame body 800 may be coupled. The member such as the bolt may be coupled to the upper body 130 in front of the upper frame 830 and further, coupled to the upper body 130 in the rear of the upper frame 830.

In addition, the middle body 120 and the middle frame 820 may be coupled in a form in which the inner wall of the middle body 120 is in close contact with the middle frame 820 inside the middle frame 820. In this case, the member such as the bolt may be fastened to the middle body 120 and the middle frame 820.

In addition, the lower body 110 may be coupled to the lower frame 810 of the frame body 800. The bottom plate of the lower body 110 may be coupled to the lower frame 810 in close contact with the lower side of the lower frame 810. In this case, while the member such as the bolt is fastened to the lower frame 810 and the bottom plate of the lower body 110, the lower body 110 and the frame body 800 may be coupled. The member such as the bolt may be coupled to the lower body 110 in front of the lower frame 810 and further, coupled to the lower body 110 in the rear of the lower frame 810.

An external cabinet of the body 100 may be coupled to the middle frame 820 of the frame body 800. The external cabinet may be divided into a first external cabinet 136 and a second external cabinet 125.

The external cabinet may be coupled to the middle frame 820 while being in close contact with the outside of the frame body 800. In this case, while the member such as the bolt is fastened to the middle frame 820 and the first external cabinet 136, the first external cabinet 136 and the frame body 800 may be coupled. The member such as the bolt may be coupled to the first external cabinet 136 above the middle frame 820 and further, coupled to the first external cabinet 136 below the middle frame 820.

Further, while the member such as the bolt is fastened to the middle frame 820 and the second external cabinet 125, the second external cabinet 125 and the frame body 800 may be coupled.

Figure 21:
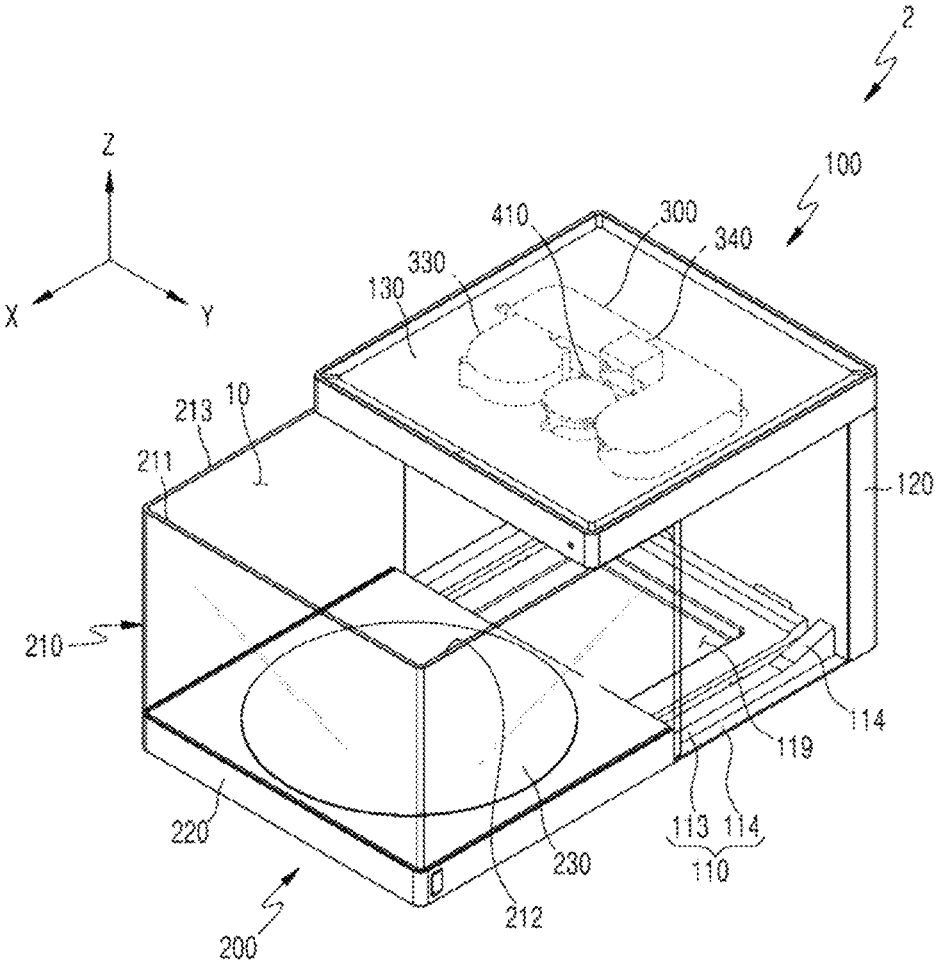
FIG. 21 is a perspective view of the opened state of the accommodation space of the shoe care device according to the embodiment of the present invention.

FIG. 21 is a perspective view illustrating the opened state of the accommodation space 10 of the shoe care device 2 according to the embodiment of the present invention.

Figure 22:
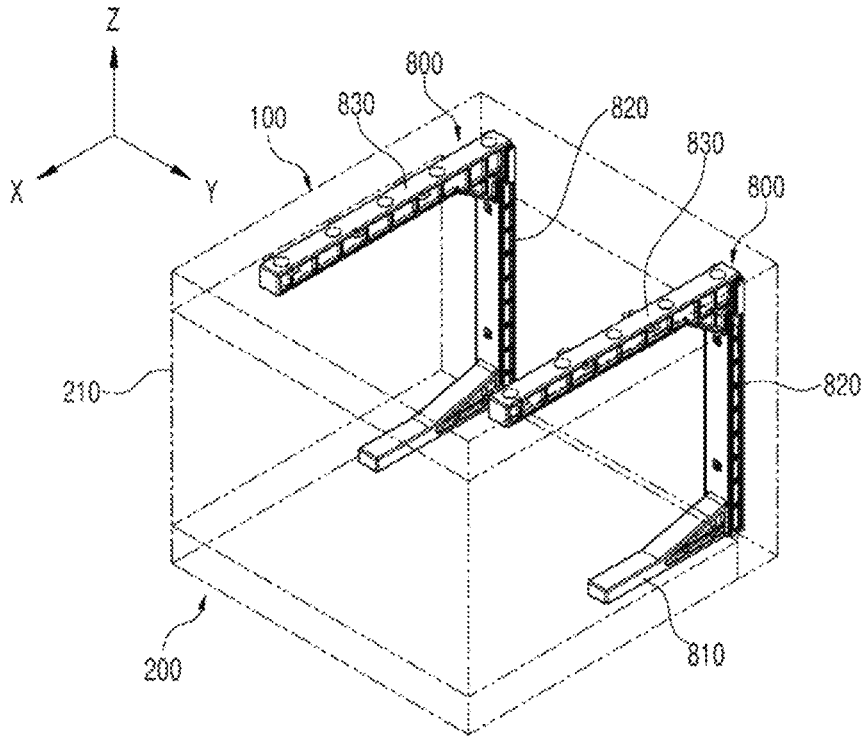
FIG. 22 is a perspective view illustrating a frame body in the closed state of the accommodation space of the shoe care device of FIG. 21.

FIG. 22 is a perspective view illustrating a frame body in the closed state of the accommodation space 10 of the shoe care device 2 of FIG. 21.

According to the embodiment of the present invention, the shoe care device 2 may include the body 100, the moving body 200, the blowing part 330, and the frame body 800.

The body 100 as a part that forms a part of the accommodation space 10 may constitute a reference location for the moving body 200 which slidably moves.

The moving body 200 is a part that forms the accommodation space 10 jointly with the body 100, and is coupled to the body 100 to slidably move between the first location and the second location in front of the first location.

That is, the moving body 200 is apart that forms the remaining part of the accommodation space, and while the moving body 200 slidably moves with respect to the body 100, the accommodation space 10 may be opened/closed.

In particular, the moving body 200 may be configured to reciprocally move between the first location and the second location in the front and rear direction with respect to the body 100. In this case, a state in which the moving body 200 is at the first location may be defined as a closed state and a state in which the moving body 200 is at the second location may be defined as an opened state.

In the opened state of the shoe care device 2, the accommodation space 10 may be sealed from outside air. Therefore, when the shoe is accommodated in the accommodation space 10 and the accommodation space 10 is closed, the contact of the shoe with dust and moisture of the outside air may be interrupted.

The blowing part 330 as a part configured to circulate the air in the accommodation space 10 may allow the shoe accommodated in the accommodation space 10 to be paced in an appropriate environment by adjusting an air state (in particular, humidity) of the accommodation space 10.

As such, in the shoe care device 2 according to the embodiment, the shoe is accommodated in the accommodation space 10 formed by both the body 100 and the moving body 200, and the state is switched to the closed state to display the shoe and the air is circulated in the accommodation space 10 through the blowing part 330 to adjust the state of the accommodation space 10, thereby effectively implementing both the shoe display effect and the shoe care effect.

The frame body 800 as a part that is coupled to the body 100 and supports the body 100 in a shape of connecting the upper surface, the lower surface, and the rear surface of the body 100 may reinforce each connection portion of the body 100 which has a relatively vulnerable rigidity structurally.

As described above, in order to for the moving body 200 to slidably move with respect to the body 100, the front surface of the body 100 needs to be opened to correspond to the shape of the moving body 200. Therefore, the body 100 should be formed in a structure to approximately support even a load applied to the opened front surface at portions other than the front surface.

However, in that the body 100 has various components placed therein, and it is possible to form the size or the rigidity to be unlimitedly large, it is necessary to reinforce a structurally vulnerable portion with a separate reinforcing member.

In particular, when the body 100 is formed in a shape in which the front surface is opened, it is necessary to support even the load applied to the front surface on the reaming upper surface, lower surface, and the rear surface, so it may be preferable to reinforce each connection portion of the parts.

As such, in the shoe care device 2 according to the embodiment, since the frame body 800 is coupled to the body 100 in a shape connecting the upper surface, the lower surface, and the rear surface of the body 100 to support the body 100, the shoe care device 2 may maintain a stable state by reinforcing a structural vulnerable part in the body 100.

The shoe care device 2 according to an embodiment of the present invention may further include the heating part 340 configured to heat the circulated air in the accommodation space 10 to appropriately maintain the environment of the accommodation space 10, thereby more effectively caring the shoe.

Further, in the shoe care device 2 according to an embodiment of the present invention, the body 100 includes the upper body 130 forming the top of the accommodation space 10, the lower body positioned below the accommodation space 10, and the middle body 120 forming the rear surface of the accommodation space 10 by connecting the rear sides of the upper body 130 and the lower body 110, and the moving body 200 includes the base 220 slidably coupled to the lower body 110 and the transparent window 210 extending upward on the base 220 and forming the front surface and both side surfaces of the accommodation space 10 to stably maintain the connection structure of the body 100 and the moving body 200 in the process of the sliding movement of the moving body 200 with respect to the body 100.

In the shoe care device 2 according to an embodiment of the present invention, the frame body 800 may be configured to include an upper frame 830 coupled to the upper body 130, a lower frame 810 coupled to the lower body 110, and a middle frame 820 connecting rear sides of the upper frame 830 and the lower frame 810 and coupled to the middle body 120.

As described above, the body 100 in which the lower body 110, the middle body 120, and the upper body 130 are combined is configured in the C shape when viewed from the side, so the body 100 may form three surfaces of the shoe care device 2 in the 3D space.

Therefore, since the upper body 130 and the lower body 110 are formed in a shape of being projected forward from the middle body 120, the structure for supporting the load there may not actually be present at the front ends of the upper body 130 and the lower body 110.

In particular, in that the upper body 130 is a kind of cantilever (C) structure formed to be projected from the middle body 120, if the middle body 120 does not appropriately support the upper body 130, there may be a problem in that the front end of the upper body 130 is drooped.

In this case, in that there is a structural limit to support the upper body 130 only with the middle body 120, it may be preferable to reinforce the connection portion of the lower body 110 and the middle body 120 through the frame body 800, and then reinforce both the middle body 120 and the upper body 130 through the frame body 800.

Therefore, it may be preferable to achieve reinforcement in a structure of connecting the upper body 130, the lower body 110, and the middle body 120 of the body 100 to each other through the upper frame 830, the lower frame 810, and the middle frame 820 of the frame body 800.

That is, the frame body 800 may also be formed in the C shape when viewed from the side, so it is possible to reinforce the structural vulnerable portion of the body 100 formed in the C shape.

As such, in the shoe care device 2 according to the embodiment, since the frame body 800 is configured to include the upper frame 830, the lower frame 810, and the middle frame 820, the vulnerable portion of the body 100 may be reinforced in the structure of connecting the upper body 130, the lower body 110, and the middle body 120 to each other.

In addition, in the shoe care device 2 according to the embodiment, the frame body 800 is configured to be concentratedly placed on the rear surface of the body 100 to support the body 100.

That is, an overall center of gravity may move backward by the frame body 800 placed concentratedly on the rear surface of the body 100, so stress can be prevented from being concentrated on a front surface portion of the upper body 130 of the shoe care device 2.

Meanwhile, when a plurality of shoe care devices 2 is provided, any one shoe care device 2 may be placed on the upper surface of the upper body 130 of the other one shoe care device 2, and both the shoe care devices 2 may be stacked on each other.

In this case, in that the upper body 130 is a kind of cantilever (C) structure formed to be projected from the middle body 120, if the load of the shoe care device 2 stacked at the upper portion is applied to the front surface of the upper body 130 of the shoe care device 2 positioned at the lower portion, there may be a problem in that the front end of the upper body 130 is drooped.

In the shoe care device 2 according to an embodiment of the present invention, the frame body 800 may be placed inside the body 100.

As such, the frame body 800 need not be visually exposed to the user in that the frame body 800 is a member for reinforcing the structural vulnerable portion of the body 100.

Therefore, it may be preferable that the frame body 800 is placed inside the body 100 so as not to be exposed to the outside.

As such, in the shoe care device 2 according to the embodiment, since the frame body 800 is placed not to be exposed to the outside, the aesthetics may be visually provided by minimizing the exposure of a member not directly related to the function of the display device 2.

In the shoe care device 2 according to an embodiment of the present invention, a plurality of frame bodies 800 may be placed in the left and right direction of the body 100.

It may be preferable to place the frame body 800 on an entire surface of the body 100 in order to reinforce the vulnerable portion of the body 100, but such a structure is uneconomical and there is a risk of increasing the load of the shoe care device 2.

Therefore, placing the plurality of frame bodies 800 at a predetermined interval within a range to securing the structural stability may be most effective by considering the structural rigidity and the economics of the product.

In this case, in order to prevent deformation such as structural distortions according to the rigidity imbalance of the shoe care device 2, it may be preferable that the frame body 800 is placed symmetric in the left and right direction of the body 100.

As such, in the shoe care device 2 according to the embodiment, since the plurality of frame bodies 800 are placed in the left and right direction of the body 100 to reinforce the body 100, the body 100 may be structurally reinforced more uniformly and stably.

Figure 23A:
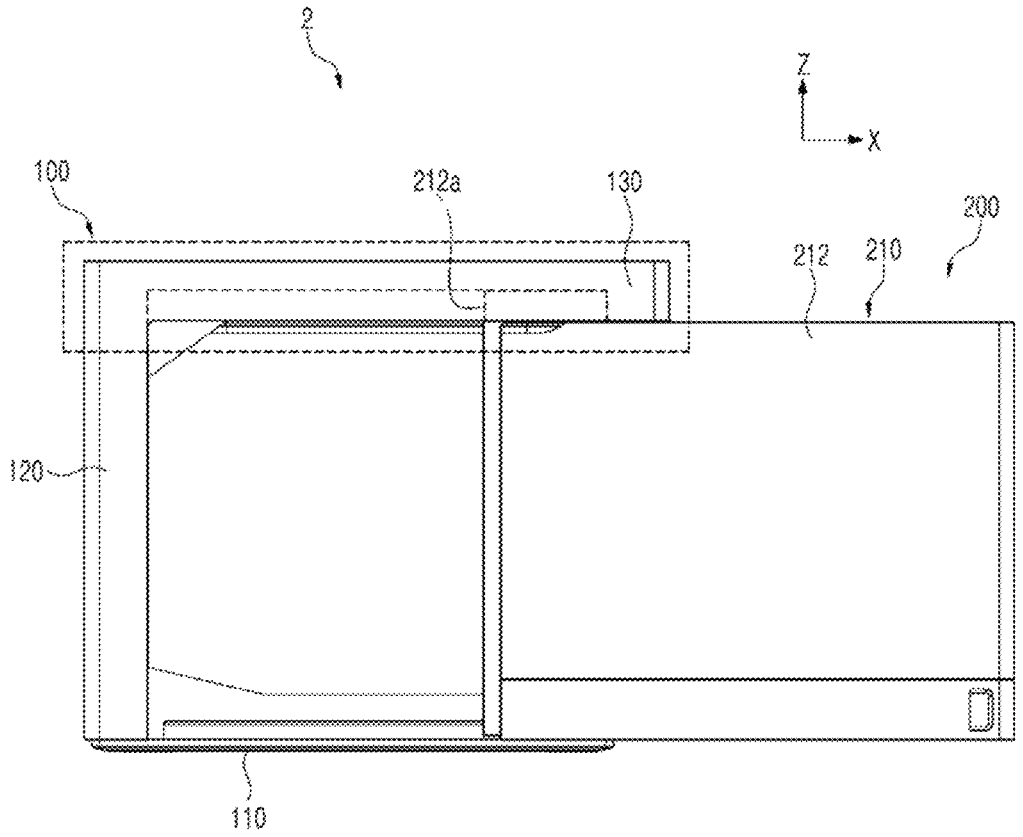
FIG. 23*a* is a side view illustrating the opened state of the accommodation space of the shoe care device according to the embodiment of the present invention.

FIG. 23*a* is a side view illustrating the opened state of the accommodation space 10 of the shoe care device 2 according to the embodiment of the present invention.

When the front end portion of the upper body 130 is drooped, a force (hereinafter, referred to as 'opening force') required for slidably moving the moving body 200 in the opened state may be increased.

Figure 28A:
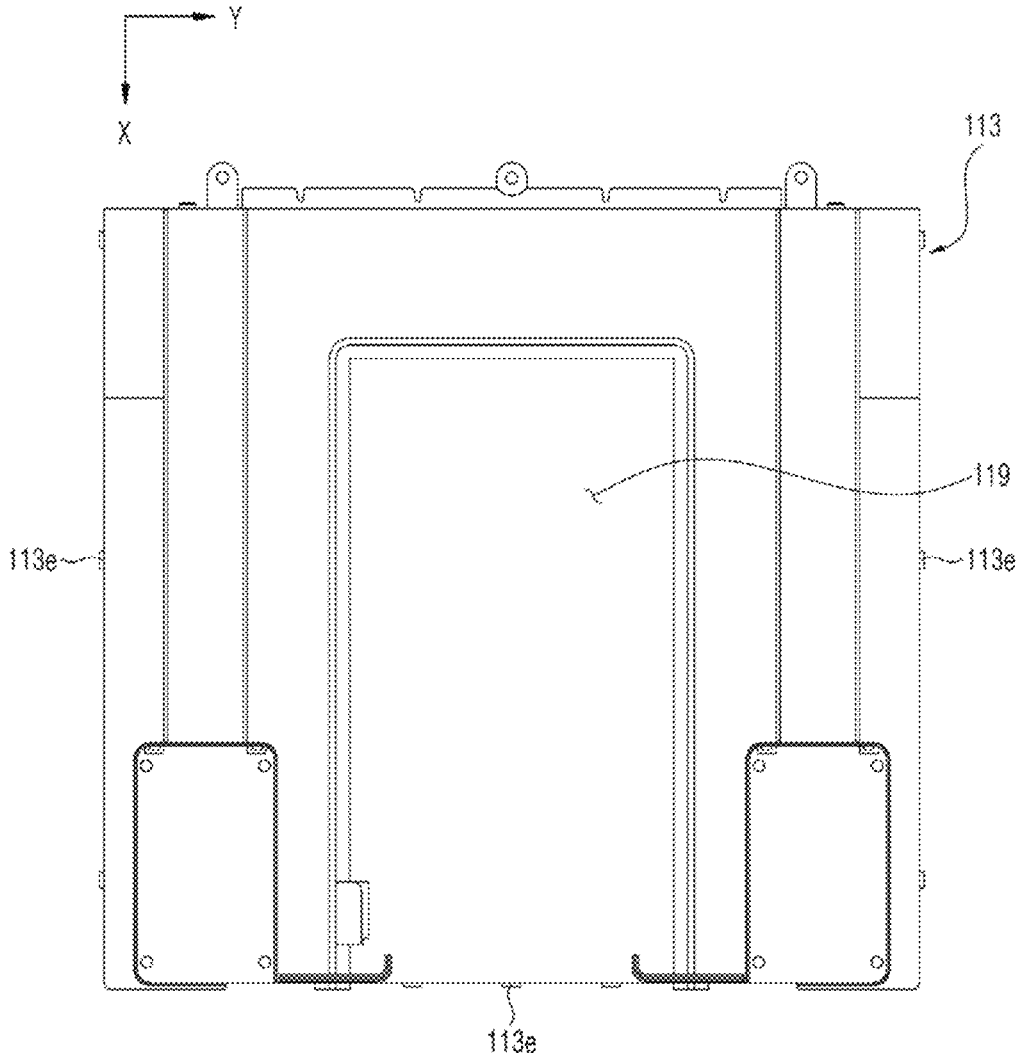
FIG. 28*a* is a diagram illustrating the third internal cabinet of the shoe care device viewed from the top according to the embodiment of the present invention.

The transparent window 210 may be configured to include a first pin portion 212*a* and a second pin portion 213*a* (see FIG. 28*a*). The first pin portion 212*a* extends to the upper side from the rear side of the second window 212. The second pin portion 213*a* extends upward on the rear side of the third window 213.

The upper surfaces of the first pin portion 212*a* and the second pin portion 213*a* may be spaced apart from the upper body 130 in the vertical direction by dl in a state in which external force is not applied (hereinafter, referred to as 'initial state'). Therefore, the transparent window may form a vertical gap (hereinafter, referred to as 'initial gap') of dl from the upper body 130 in the initial state.

Figure 23B:
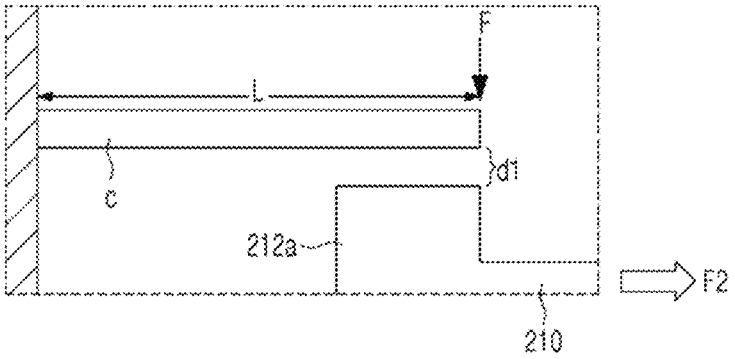
FIG. 23*b* as a diagram illustrating the upper body and the transparent window of FIG. 23*a* is a partial side view illustrating the upper body as a cantilever.

FIG. 23*b* as a diagram illustrating the upper body 130 and the transparent window 210 of FIG. 23*a* is a partial side view illustrating the upper body 130 which is simplified as a cantilever C. In FIG. 23*b*, L means a length of the cantilever C.

When a drooping amount of an end of the cantilever C exceeds dl by the load F applied to the end of the cantilever C, the upper body 130 and the transparent window 210 have a contact surface with each other. In this case, when the moving body 200 is slidably moved in the opened state, the friction force is generated on the contact surface and an opening force F2 thus increases.

Therefore, in order to reduce the opening force F2, a total drooping amount of the upper body 130 should be reduced. In order to achieve this, the frame body 800 which is coupled to the body 100 in the shape of connecting the upper surface, the lower surface, and the rear surface of the body 100 to each other to support the body 100 should have high flexural rigidity EI.

The flexural rigidity of the frame body 800 may be increased by increasing an elastic modulus E or a moment of inertia I of the frame body 800.

Figure 24A:
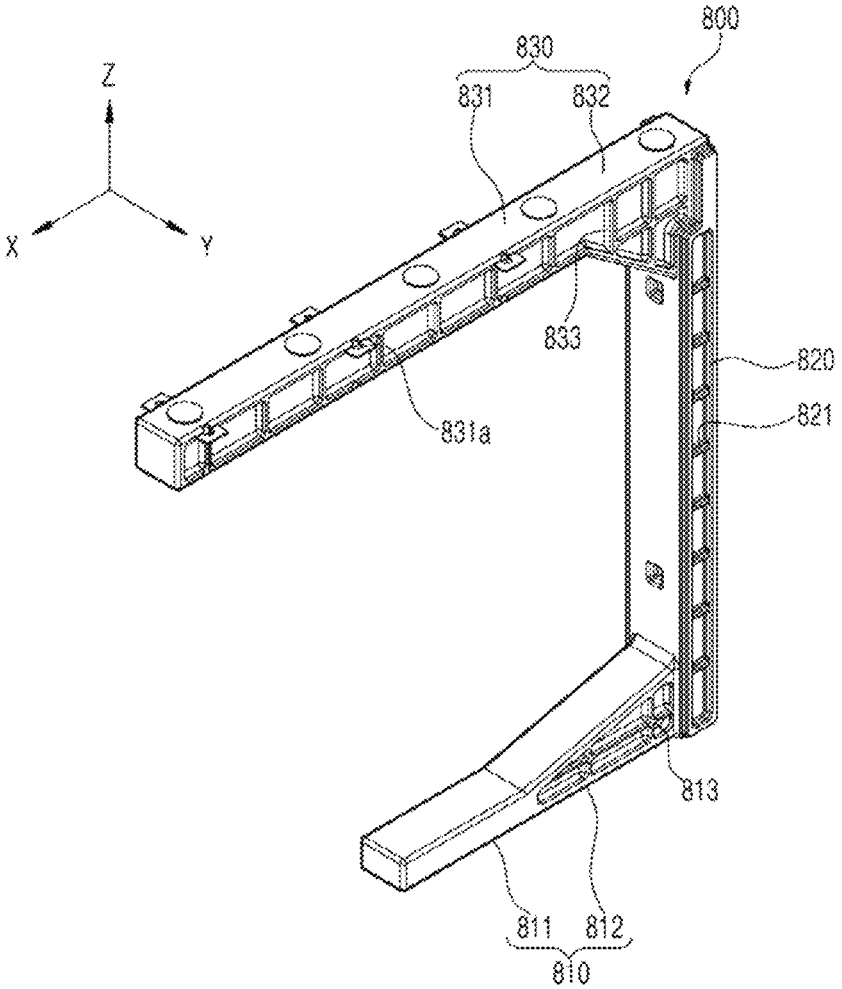
FIG. 24*a* is a front perspective view illustrating the frame body in the shoe care device of FIG. 22.
Figure 24B:
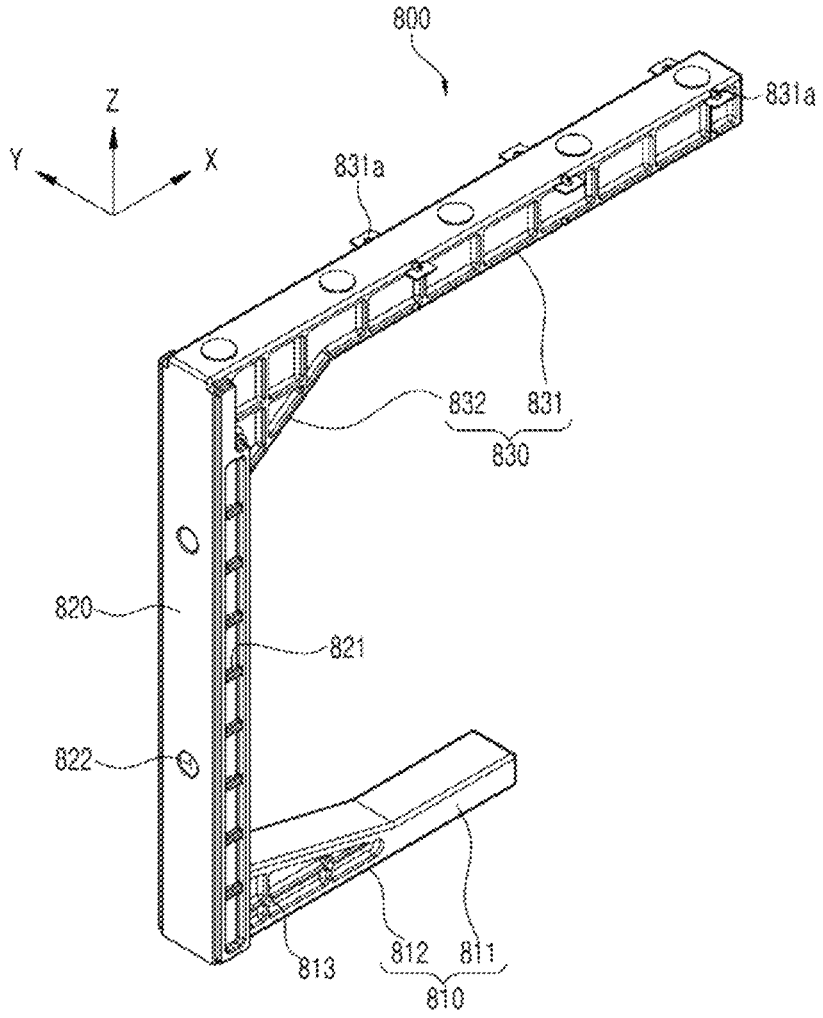
FIG. 24*b* is a bottom perspective view illustrating the frame body of FIG. 24*a*.

FIG. 24*a* is a front perspective view illustrating the frame body 800 in the shoe care device 2 of FIG. 22. FIG. 24*b* is a bottom perspective view illustrating the frame body 800 of FIG. 24*a*.

In the shoe care device 2 according to an embodiment of the present invention, the frame body 800 may be configured to include an upper frame 830 coupled to the upper body 130, a lower frame 810 coupled to the lower body 110, and a middle frame 820 connecting rear sides of the upper frame 830 and the lower frame 810 and coupled to the middle body 120.

The frame body 800 may be integrally manufactured by die casting. The die casting is a precision casting method that injects molten metal into a steel-made mold accurately machined to match a required casting shape to obtain the same casting as the mold. The die casting has a feature that a mechanical property is excellent and mass production is possible in addition to an advantage that a dimension is accurate, and thus there is no need to trim.

The frame body 800 may be made of an aluminum die cast (ALDC) material. As an example, the frame body 800 may be made of an Al—Si based alloy (ALDC1), Al—Si—Mg (ALDC2), an Al—Si—Cu based alloy (ALDC7,8), an Al—Mg based alloy (ALDC3,4), etc.

In the shoe care device 2 according to the embodiment of the present invention, the frame body 800 is manufactured in an integrated structure made of the ALDC material by the die casting, and as a result, each of the upper frame 830, the lower frame 810, and the middle frame 820 may have a cross-sectional shape without a hollow. Therefore, each of the upper frame 830, the lower frame 810, and the middle frame 820 may have high moment of inertia. Therefore, the total drooping amount of the upper body 130 is reduced to interrupt the increase in opening force of the moving body 200 even though the shoe care devices 2 are stacked in multiple stages.

The moment of inertia is a value by integrating a value acquired by multiplying a fine cross-sectional area of a cross section from any axis and a square of a distance up to the axis with respect to a whole cross section. Therefore, the moment of inertia means a property of the cross section sued for predicting resistance to flexure or drooping. For example, a material having a shape with a large moment of inertia with respect to a direction of applied force is resistant to the flexure.

Further, in the shoe care device 2 according to the embodiment of the present invention, the frame body 800 is manufactured in the integrated structure made of the ALDC material by the die casting, and as a result, the connection portion of the upper frame 830 and the middle frame 820, and the connection portion of the middle frame 820 and the lower frame 810 may secure the rigidity without bending processing or a separate fastening member. Therefore, the total drooping amount of the upper body 130 is reduced to interrupt the increase in opening force of the moving body 200 even though the shoe care devices 2 are stacked in multiple stages.

The middle frame 820 may have a pillar shape which is long in the vertical direction. A (longitudinal and orthogonal) cross section of the middle frame 820 may have a substantially rectangular shape. The cross section of the middle frame 820 may have a symmetric shape based on a neutral axis passing through a center of figure in a Y-axis direction.

The middle frame 820 may have recontouring grooves on the left surface and the right surface in the longitudinal direction. Therefore, the cross section of the middle frame 820 may have a shape in which a part close to the center of figure based on the neutral axis passing through the center of figure in the Y-axis direction has a relatively small horizontal width and a part distant from the center of figure has a relatively large horizontal width. Therefore, the middle frame 820 may have the high moment of inertia which is resistant to the drooping of the upper body 130 and flexure deformation of the middle body 120 based on the neutral axis even though the recontouring groove is formed in the longitudinal direction.

The middle frame 820 may have a plurality of middle ribs 821 inside the recontouring groove in the longitudinal direction in order to reinforce the rigidity. The middle ribs 821 may be spaced apart from each other at a predetermined interval in the longitudinal direction (vertical direction). The middle ribs 821 may connect the inner surface of the recontouring groove in the front and rear direction. Therefore, the moment of inertia of the middle frame 820 is increased by the middle ribs 821, and as a result, the middle frame 820 may have the high moment of inertia which is resistant to the drooping of the upper body 130 and flexure deformation of the middle body 120 based on the neutral axis.

As described above, the moment of inertia is the value by integrating the value acquired by multiplying the fine cross-sectional area of the cross section from any axis and the square of the distance up to the axis with respect to the whole cross section. A horizontal width of the middle frame 820 may be larger than the horizontal width of the upper frame 830. Therefore, even though a front and rear width of the middle frame 820 is formed to be equal to or smaller than the vertical width of the upper frame 830, the middle frame 820 may have the high moment of inertia which is resistant to the drooping of the upper body 130 and flexure deformation of the middle body 120 based on the neutral axis. Therefore, even though the second internal cabinet 124 and the second external cabinet 125 of the middle body 120 have a small spacing distance in the front and rear direction, the middle frame 820 may have the high moment of inertia which is resistant to the drooping of the upper body 130 and flexure deformation of the middle body 120 based on the neutral axis.

The upper frame 830 may have a beam shape which is long in the front and rear direction. The (longitudinal and orthogonal) cross section of the upper frame 830 may have the substantially rectangular shape. The cross section of the upper frame 830 may have the symmetric shape based on the neutral axis passing through the center of figure in the Y-axis direction.

The upper frame 830 may have recontouring grooves on the left surface and the right surface in the longitudinal direction. Therefore, the cross section of the upper frame 830 may have a shape in which a part close to the center of figure based on the neutral axis passing through the center of figure in the Y-axis direction has the relatively small horizontal width and a part distant from the center of figure has the relatively large horizontal width. Therefore, the upper frame 830 may have the high moment of inertia which is resistant to the drooping of the upper body 130 based on the neutral axis even though the recontouring groove is formed in the longitudinal direction.

The upper frame 830 may have a plurality of upper ribs 833 inside the recontouring groove in the longitudinal direction in order to reinforce the rigidity. The upper ribs 833 may be spaced apart from each other at a predetermined interval in the longitudinal direction (front and rear direction). The upper ribs 833 may connect the inner surface of the recontouring groove in the vertical direction. Therefore, the moment of inertia of the upper frame 830 is increased by the upper ribs 833, and as a result, the middle frame 830 may have the high moment of inertia which is resistant to the drooping of the upper body 130 based on the neutral axis.

As described above, the moment of inertia is the value by integrating the value acquired by multiplying the fine cross-sectional area of the cross section from any axis and the square of the distance up to the axis with respect to the whole cross section. A vertical width of the upper frame 830 may be larger than the horizontal width. Therefore, the upper frame 830 may have the high moment of inertia which is resistant to the drooping of the upper body 130 based on the neutral axis even though the horizontal width of the upper frame 830 is smaller than the horizontal width of the middle frame 820.

The upper frame 830 may include an upper extension portion 831 and an upper connection portion 832.

The upper extension portion 831 may have the beam shape which is long in the front and rear direction. The (longitudinal and orthogonal) cross section of the upper extension portion 831 may have the substantially rectangular shape. The vertical width of the upper extension portion 831 may be substantially constant in the longitudinal direction. A plurality of holes 831*s* into which the bolts are inserted may be formed at the upper extension portion 831 in the longitudinal direction of the upper extension portion 831. The upper extension portion 831 may be fastened to a boss of the first internal cabinet 135 by the bolts passing through the holes 831*a*.

The upper connection portion 832 is a part that connects the rear side of the upper extension portion 831 to the middle body 120. The vertical width of the upper connection portion 832 may increase rearwards. The top of the upper connection portion 832 may have a substantially constant height in the front and rear direction.

The shear force and flexure moment of an actual cantilever (C) type structure are formed to be the maximum primarily at a fixation end portion. Therefore, permanent deformation and breakage easily occur at the fixation end portion of the actual cantilever (C) type structure.

The bottom of the upper connection portion 832 may be lowered at a constant slope rearwards. That is, the vertical width of the upper connection portion 832 may increase downward rearwards. Therefore, the vertical width of the upper connection portion 832 may increase at a constant slope rearwards, and the center of figure of the upper connection portion 832 may be lowered at a constant slope rearwards. Therefore, the upper connection portion 832 may have a higher moment of inertia than the upper extension portion 831.

The moment of inertia is in proportion to a cross-sectional width, and is in proportion to a cubic of a cross-sectional height. Therefore, the moment of inertia of the upper connection portion 832 may increase rearwards. Therefore, the upper connection portion 832 may have a high moment of inertia which is resistant to the drooping of the upper body 130 based on the neutral axis. Further, the upper connection portion 832 may have high rigidity which is resistant to the permanent deformation and breakage.

In the cantilever (C) structure, the total drooping amount of the end of the cantilever C is in inverse proportion to the flexure rigidity of the cantilever C. The first internal cabinet 135 and the first external cabinet 126 constituting the upper body 130 are made of the plastic material. Further, since the first internal cabinet 135 and the first external cabinet 126 have an upper space formed therebetween, the first internal cabinet 135 and the first external cabinet 126 have a smaller thickness than the upper frame 830. Therefore, the upper body 130 has a smaller flexure rigidity than the upper frame 830. Therefore, as a distance by which the front surface of the upper frame 830 is spaced backward from the front surface of the upper body 130 increases, the drooping amount of the upper body 130 increases.

When the drooping of the upper frame 830 occurs, the lower frame 810 serves to fix and support the lower portion of the middle frame 820 against the moment generated in the middle frame 820. Therefore, the lower frame 810 may have only a solid coupling force to the lower body 110. Therefore, as the front surface of the lower frame 810 is spaced backward from the front surface of the lower body 110 by a predetermined interval, the drooping amount of the upper body 130 may not increase.

The upper frame 830 may extend more than the lower frame 810. In this case, a location where the upper frame 830 is coupled to the upper body 130 may be positioned in front of a location where the lower frame 810 is coupled to the lower body 110. The location where the upper frame 830 is coupled to the upper body 130 may mean a location of the hole 831*a* through which the upper frame 830 is coupled to the upper body 130 by the bolt. The location where the lower frame 810 is coupled to the lower body 110 may mean a location of the hole through which the lower frame 810 is coupled to the lower body 110 by the bolt. Therefore, the upper frame 830 and the upper body 130 have the solid coupling force while the front surface of the upper frame 830 is spaced to be small backward from the front surface of the upper body 130, and as a result, the drooping of the front end of the upper body 130 may be minimized.

The upper frame 810 may have the beam shape which is long in the front and rear direction. The (longitudinal and orthogonal) cross section of the lower frame 810 may have the substantially rectangular shape. The cross section of the lower frame 810 may have the symmetric shape based on the neutral axis passing through the center of figure in the Y-axis direction.

The lower frame 810 may have the recontouring grooves on the left surface and the right surface in the longitudinal direction. Therefore, the cross section of the lower frame 810 may have a shape in which a part close to the center of figure based on the neutral axis passing through the center of figure in the Y-axis direction has a relatively small horizontal width and a part distant from the center of figure has a relatively large horizontal width. Therefore, the lower frame 810 may have the high moment of inertia which is resistant to the drooping of the upper body 130 based on the neutral axis even though the recontouring groove is formed in the longitudinal direction.

The lower frame 810 may have a plurality of lower ribs 813 inside the recontouring groove in the longitudinal direction in order to reinforce the rigidity. The lower ribs 813 may be spaced apart from each other at a predetermined interval in the longitudinal direction (front and rear direction). The lower ribs 813 may connect the inner surface of the recontouring groove in the vertical direction. Therefore, the moment of inertia of the lower frame 813 is increased by the lower ribs 810, and as a result, the lower frame 810 may have the high moment of inertia which is resistant to the drooping of the upper body 130 based on the neutral axis.

A plurality of holes to which the bolts are screw-coupled may be formed on the bottom of the lower frame 810 in the longitudinal direction. The lower frame 810 may be fastened to a third external cabinet 114 by bolts passing through holes 114*c* of the third external cabinet 114.

The lower frame 810 may include a lower extension portion 811 and a lower connection portion 812.

The lower extension portion 811 may have the beam shape which is long in the front and rear direction. The (longitudinal and orthogonal) cross section of the lower extension portion 811 may have the substantially rectangular shape. The vertical width of the lower extension portion 811 may be substantially constant in the longitudinal direction.

The lower connection portion 812 is a part that connects the rear side of the lower extension portion 811 to the middle body 120. The vertical width of the lower connection portion 812 may increase rearwards. The bottom of the lower connection portion 812 may have a constant height in the front and rear direction.

The shear force and flexure moment of the actual cantilever (C) type structure are formed to be the maximum substantially at the fixation end portion. Therefore, permanent deformation and breakage easily occur at the fixation end portion of the actual cantilever (C) type structure.

The top of the lower connection portion 812 may be raised at a constant slope rearwards. That is, the vertical width of the lower connection portion 812 may increase upward rearwards. Therefore, the vertical width of the lower connection portion 812 may increase at a constant slope rearwards, and the center of figure of the lower connection portion 812 may be raised at a constant slope rearwards. Therefore, the lower connection portion 812 may have a higher moment of inertia than the lower extension portion 811.

The moment of inertia is in proportion to the cross-sectional width, and is in proportion to the cubic of the cross-sectional height. Therefore, the moment of inertia of the lower connection portion 812 may increase rearwards. Therefore, the lower connection portion 812 may have the high moment of inertia which is resistant to the drooping of the upper body 130 and flexure deformation of the middle body 120 based on the neutral axis. Further, the lower connection portion 812 may have high rigidity which is resistant to the permanent deformation and breakage.

Figure 25A:
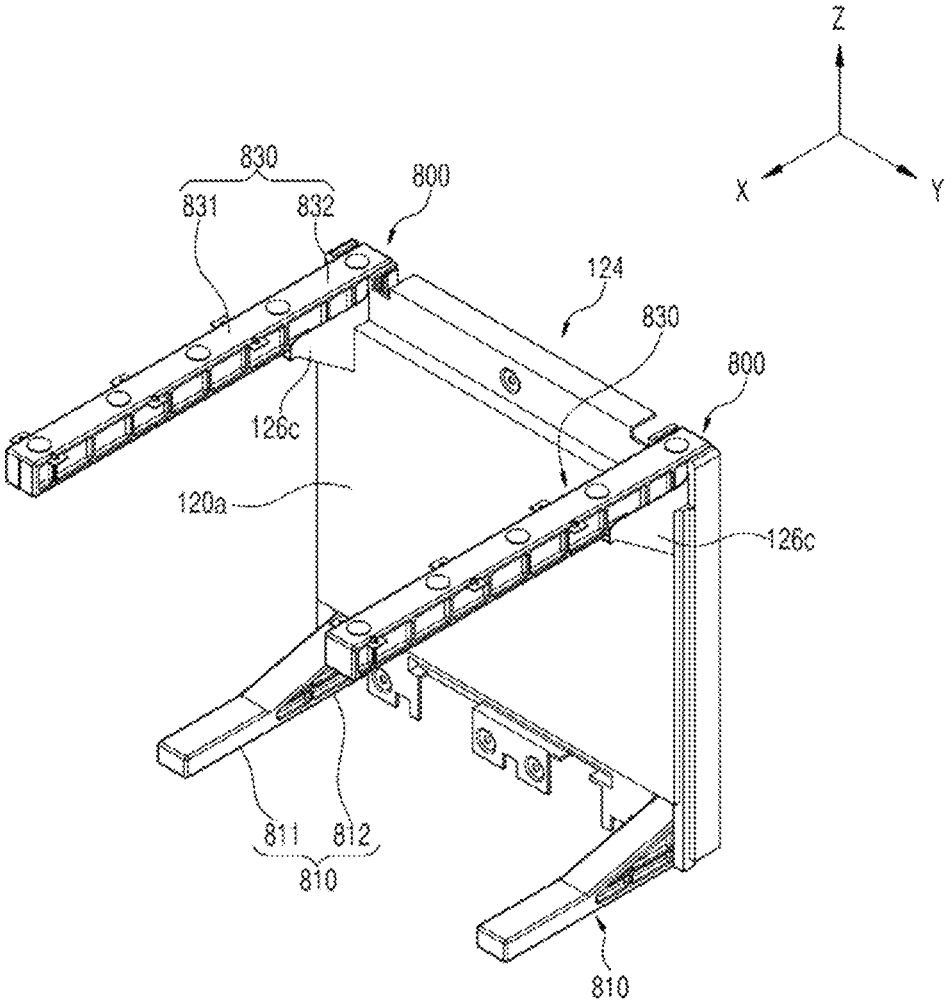
FIG. 25*a* is a perspective view illustrating the second internal cabinet and the frame body in the shoe care device of FIG. 1.
Figure 25B:
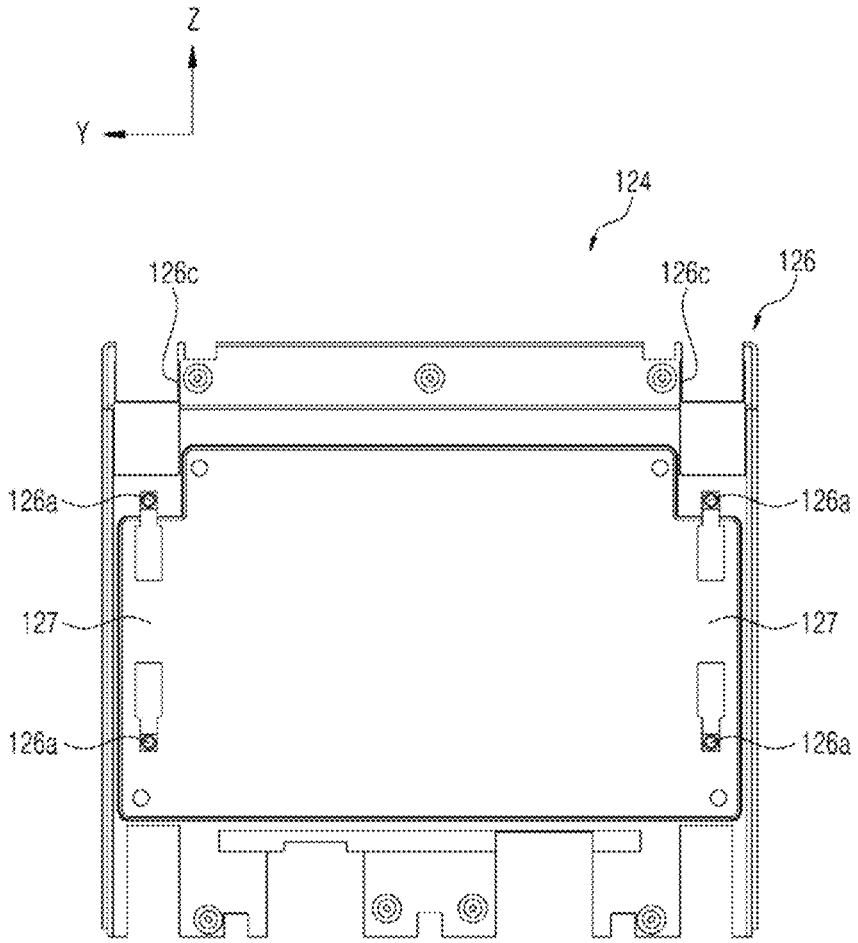
FIG. 25*b* is a bottom view illustrating the second internal cabinet in the shoe care device of FIG. 1.

FIG. 25*a* is a perspective view illustrating the second internal cabinet 124 and the frame body 800 in the shoe care device 2 of FIG. 21. FIG. 25*b* is a bottom view illustrating the second internal cabinet 124 in the shoe care device 2 of FIG. 21.

Figure 25C:
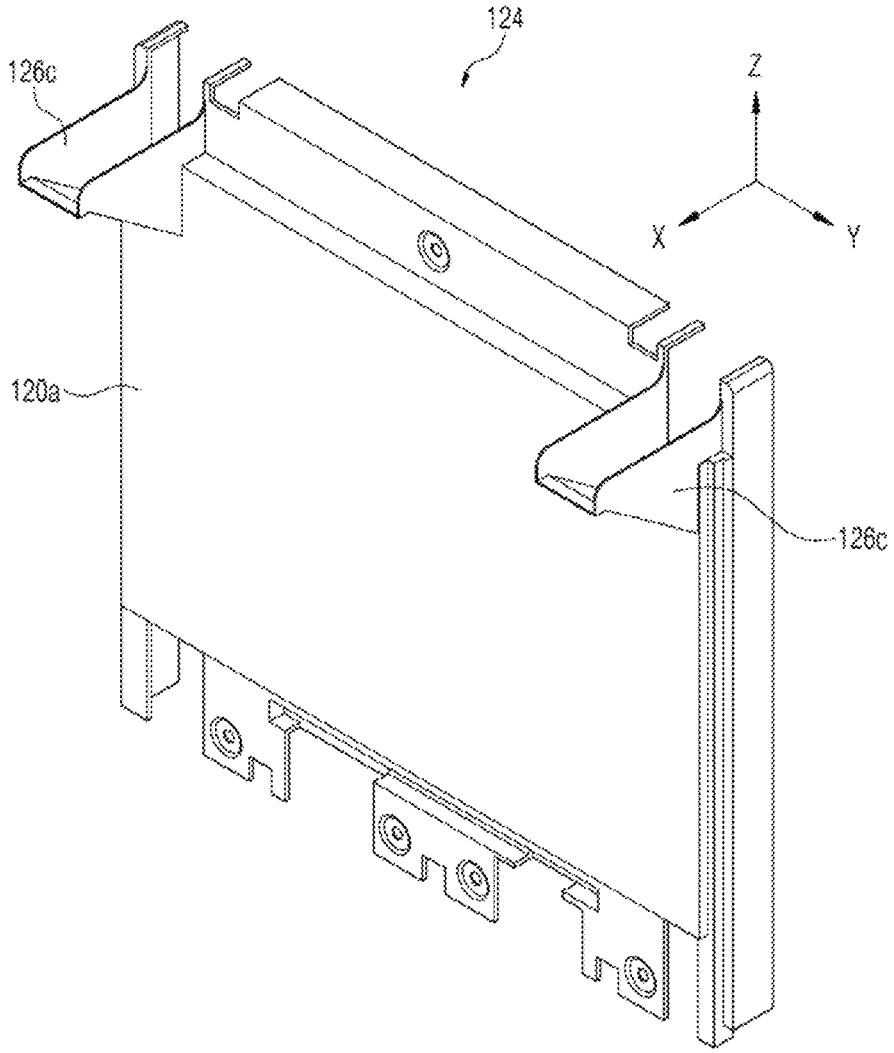
FIG. 25*c* is a perspective view illustrating the second internal cabinet of FIG. 25*a*.
Figure 25D:
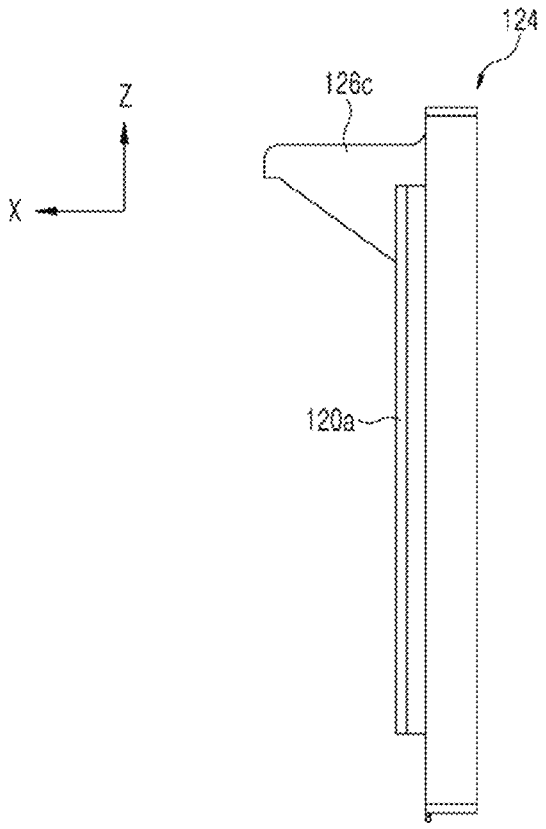
FIG. 25*d* is a side view illustrating the second internal cabinet of FIG. 25*a*.

FIG. 25*c* is a perspective view illustrating the second internal cabinet 124 of FIG. 25*a*. FIG. 25*d* is a side view illustrating the second internal cabinet 124 of FIG. 25*a*.

The middle body 120 may include a second internal cabinet 124 and a second external cabinet 125. The second external cabinet 125 may be coupled to the second internal cabinet 124 by a plurality of bolts.

The second internal cabinet 124 may include a magnetic body plate 127 and a resin panel 126.

The resin panel 126 may form the rear surface of the accommodation space 10. The magnetic body plate 127 may be coupled to the rear surface of the resin panel 126.

The magnetic body plate 127 may be configured by a ferromagnetic body strongly magnetized in the direction of a magnetic field when the magnetic field is applied. As an example, the magnetic body plate 127 may be made of iron, cobalt, nickel, and an alloy thereof. Therefore, the magnetic body plate 127 may have an attraction by magnetic force with a permanent magnet coupled to an information sheet.

The lower body 110, the middle body 120, and the upper body 130 may be coupled to the frame body 800. The frame body 800 may be a component that forms a frame of the body 100. The strength of the body 100 may be reinforced by the frame body 800.

The frame body 800 as a part that is coupled to the body 100 and supports the body 100 in a shape of connecting the upper surface, the lower surface, and the rear surface of the body 100 may reinforce each connection portion of the body 100 which has a relatively vulnerable rigidity structurally.

A plurality of bosses 126*a* with female screws may be projected backward on the rear surface of the resin panel 126. A plurality of holes 822 into which the bolts are inserted may be formed in the middle frame 820. The middle frame 820 may be fastened to the boss 126*a* by the bolt.

An upper cover portion 126*c* covering an upper connection portion 832 may be formed above the resin panel 126. The upper cover portion 126*c* may be projected to cover the upper connection portion 832 on the front surface of the resin panel. Aesthetics reduction of the shoe care device 2 by the exposure of the upper connection portion 832 may be prevented by the upper cover portion 126*c*.

Figure 26A:
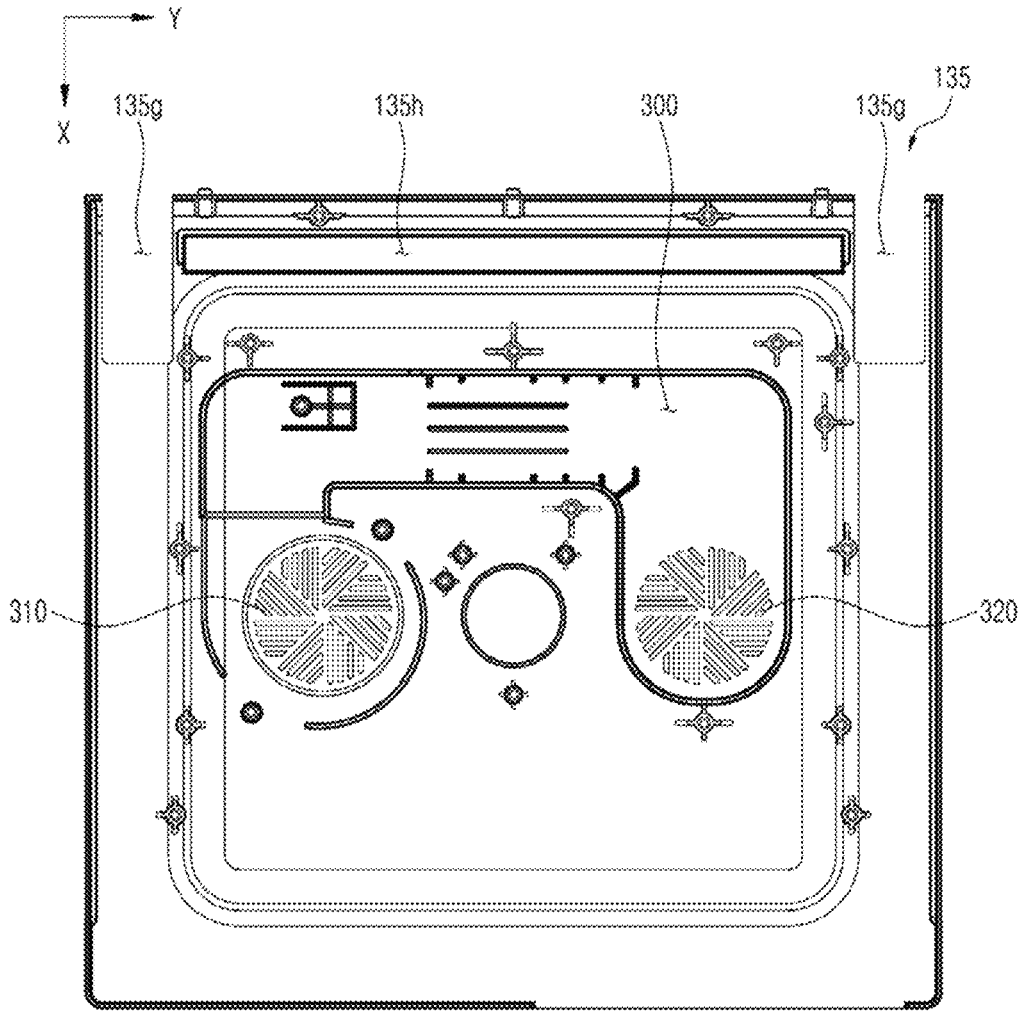
FIG. 26*a* is a diagram illustrating the first internal cabinet of the shoe care device viewed from the top according to the embodiment of the present invention.

FIG. 26*a* is a diagram illustrating the first internal cabinet 135 of the shoe care device 2 viewed from the top according to the embodiment of the present invention.

Figure 26B:
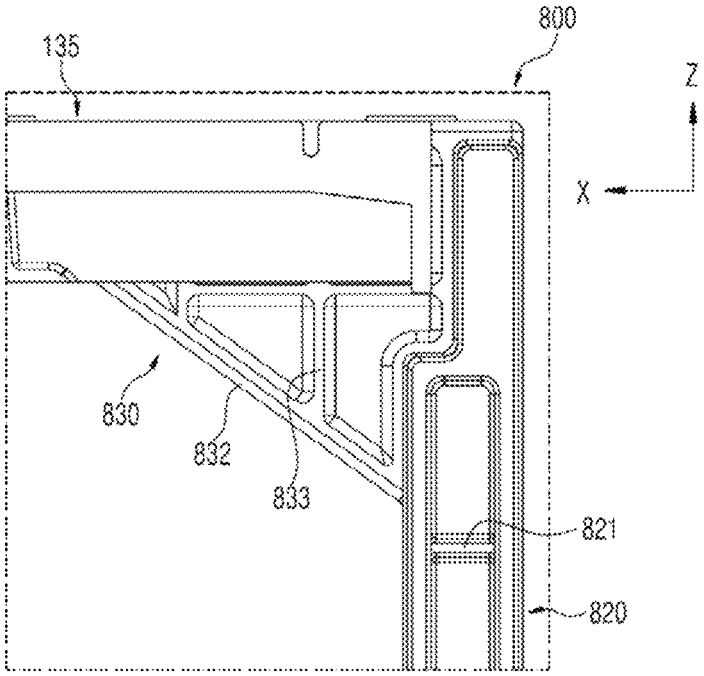
FIG. 26*b* is a side view illustrating the first internal cabinet and the frame body in the shoe care device of FIG. 1.
Figure 26C:
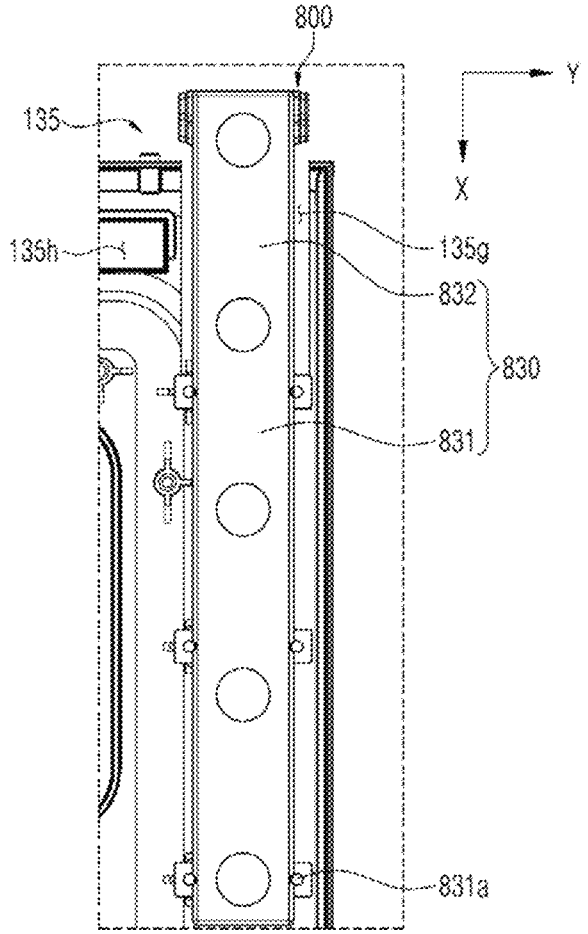
FIG. 26*c* is a plan view illustrating the first internal cabinet and the frame body in the shoe care device of FIG. 1.

FIG. 26*b* is a side view illustrating the first internal cabinet 135 and the frame body 800 in the shoe care device 2 of FIG. 21. FIG. 26*c* is a plan view illustrating the first internal cabinet 135 and the frame body 800 in the shoe care device 2 of FIG. 21.

The upper body 130 may include a first internal cabinet 135 and a first external cabinet 136. The first internal cabinet 135 and the first external cabinet 136 may form the upper space therebetween.

The plurality of bosses with the female screws may be projected upward in the first internal cabinet 135.

A plurality of holes 831*s* into which the bolts are inserted may be formed at the upper extension portion 831 in the longitudinal direction of the upper extension portion 831 (see FIG. 24*a*). The upper extension portion 831 may be fastened to the boss of the first internal cabinet 135 by the bolts passing through the holes 831*a*.

Insertion grooves 135*g* into which upper sides of the upper cover portion 126*c* and the upper connection portion 832 are inserted may be formed at a left side and a right side of the rear of the first internal cabinet 135. An entrance hole 10 through which the light of the second light 420 enters the accommodation space 10 may be formed in the rear of the first internal cabinet 135. The entrance hole 135*h* may be formed to be long in the horizontal direction between the insertion grooves 135*g*.

Figure 27A:
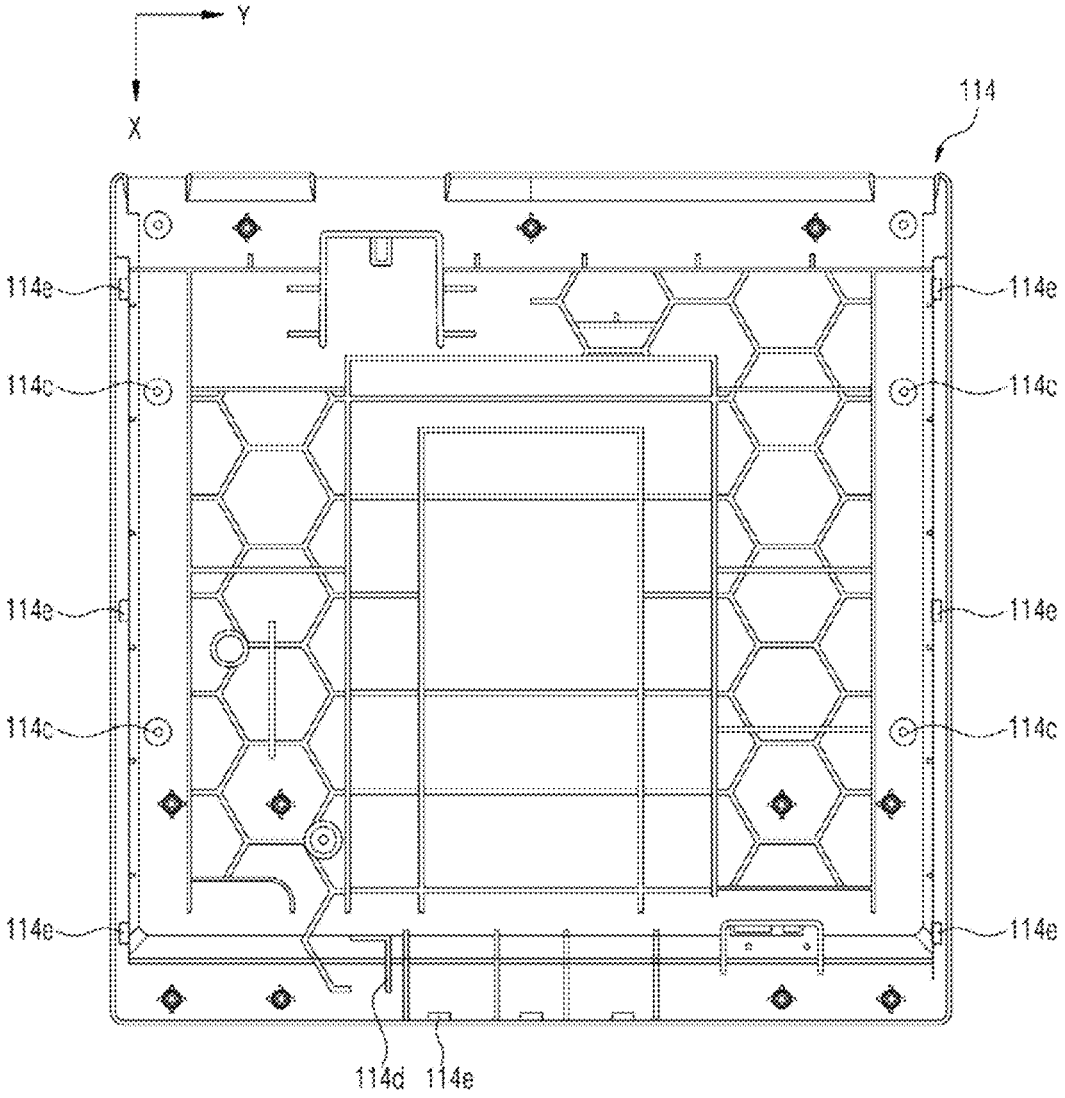
FIG. 27*a* is a diagram illustrating the third external cabinet of the shoe care device viewed from the top according to the embodiment of the present invention.

FIG. 27*a* is a diagram illustrating the third external cabinet 114 of the shoe care device 2 viewed from the top according to the embodiment of the present invention.

Figure 27B:
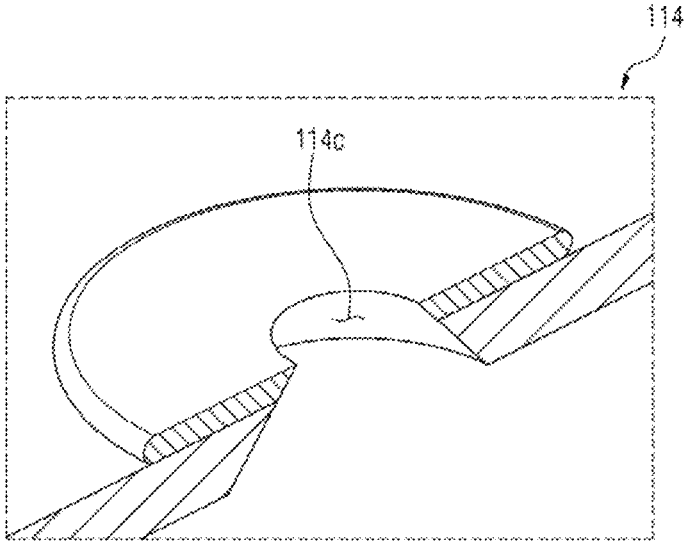
FIG. 27*b* is a partial enlarged diagram illustrating a part where the frame body is coupled to the third external cabinet of FIG. 27*a*.
Figure 27C:
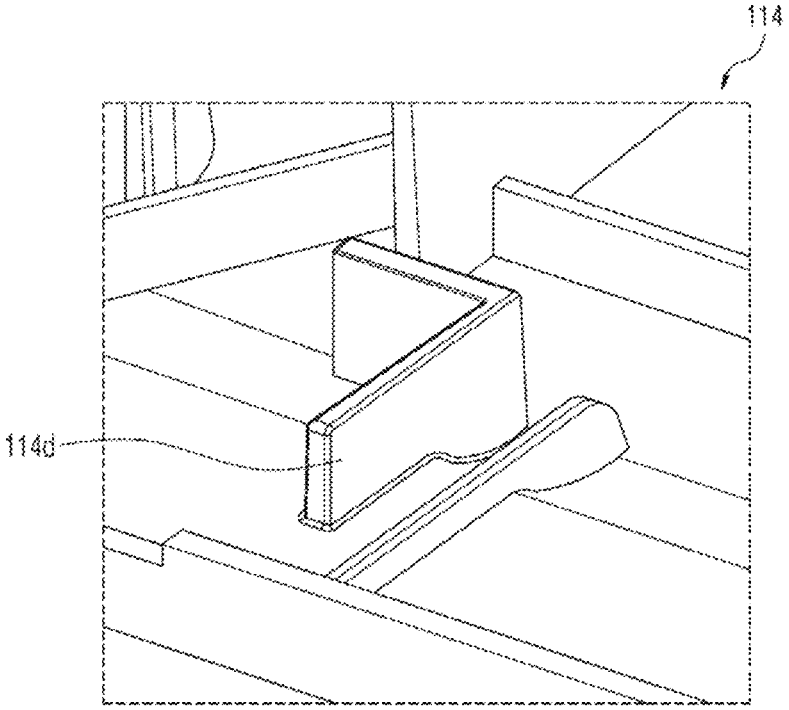
FIG. 27*c* is a partial enlarged diagram illustrating a rib of the third external cabinet of FIG. 27*a*.

FIG. 27*b* is a partial enlarged diagram illustrating a part where the frame body 800 is coupled to the third external cabinet 114 of FIG. 27*a*. FIG. 27*c* is a partial enlarged diagram illustrating a rib 114*d* of the third external cabinet 114 of FIG. 27*a*.

A plurality of holes to which the bolts are screw-coupled may be formed on the bottom of the lower frame 810 in the longitudinal direction. In addition, a plurality of through holes 114*c* through which the bolts pass may be formed in the third external cabinet 114. The bolt may be screw-coupled to the bottom of the lower frame 810 through the through hole 114*c*.

A reinforcing rib 114*d* may be formed in the third external cabinet 114. The reinforcing rib 114*d* is formed at a point where harness of the motor 290 enters the inside of the lower body 110 to form the rigidity at an entrance point.

A plurality of locking holes 114*e* may be formed at front, left, and right edges of the third external cabinet 114. When the third internal cabinet 113 descends from the top of the third external cabinet 114, a hook 113*e* of the third internal cabinet 113 is locked to a locking hole 114*e*. The third internal cabinet 113 and the third external cabinet 114 may have the coupling force by a simple hook coupling structure.

Figure 28B:
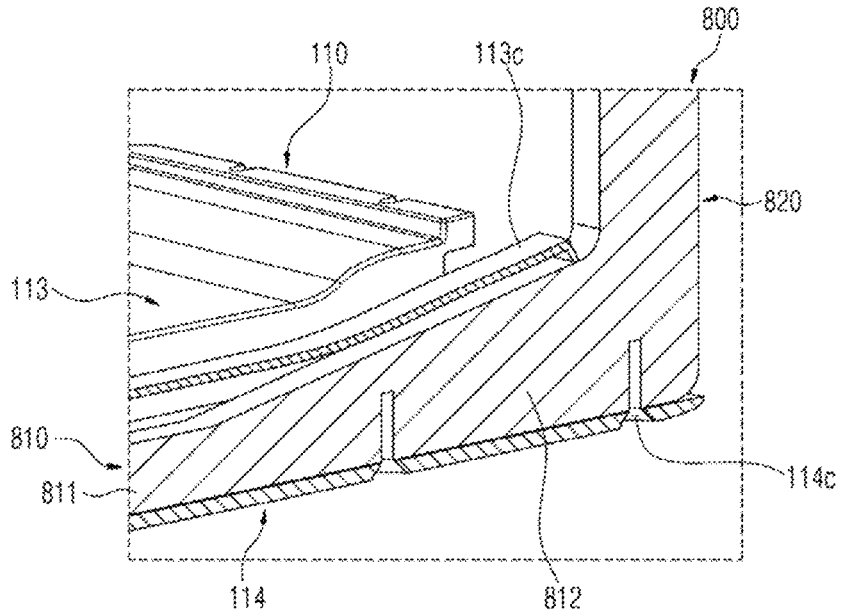
FIG. 28*b* is a partial cross-sectional view illustrating a part where the frame body is coupled to the lower body of the shoe care device of FIG. 1*a*.

FIG. 28*a* is a diagram illustrating the third internal cabinet 113 of the shoe care device 2 viewed from the top according to the embodiment of the present invention. FIG. 28*b* is a partial cross-sectional view illustrating a part where the frame body 800 is coupled to the lower body 110 of the shoe care device 2 of FIG. 21*a*.

A lower cover portion 113*c* covering the lower connection portion 812 may be formed in the rear of the third internal cabinet 113. The lower cover portion 113*c* may be projected to cover the lower connection portion 812 on the top of the third internal cabinet 113. Aesthetics reduction of the shoe care device 2 by the exposure of the lower connection portion 812 may be prevented by the lower cover portion 113*c*.

Figure 28C:
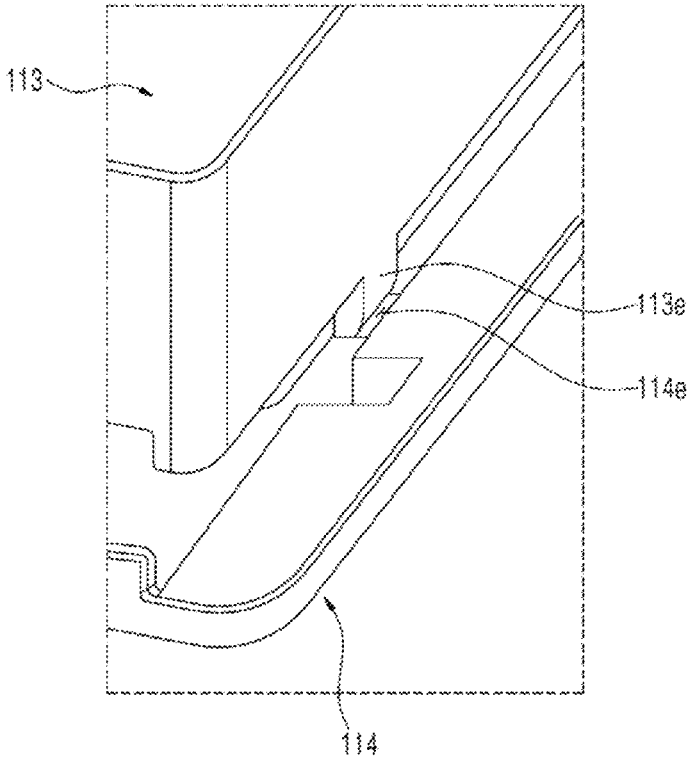
FIG. 28*c* is a partial enlarged diagram illustrating a hook coupling portion of the third internal cabinet and the third external cabinet of the lower body in the shoe care device of FIG. 1*a*.
Figure 28D:
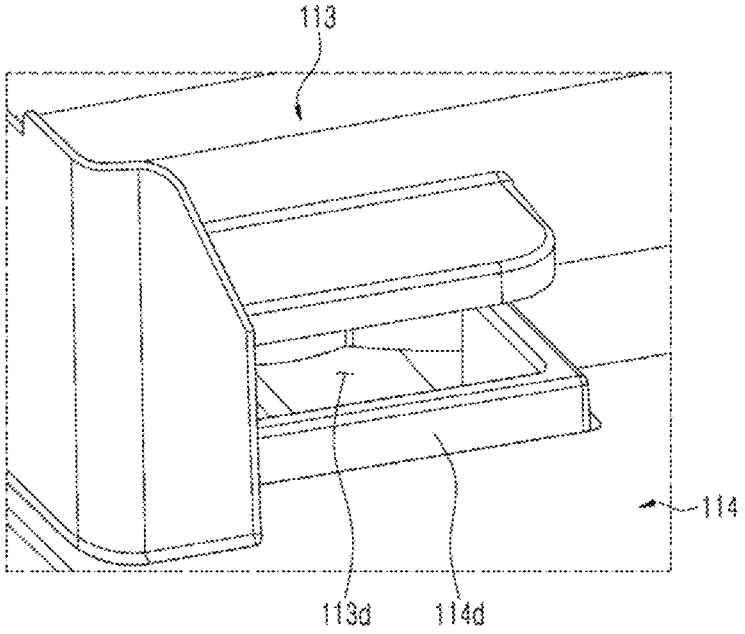
FIG. 28*d* is a partial enlarged diagram of the lower body of the shoe care device of FIG. 1*a*.

FIG. 28*c* is a partial enlarged diagram illustrating a hook coupling portion of the third internal cabinet 113 and the third external cabinet 114 of the lower body 110 in the shoe care device 2 of FIG. 21*a*. FIG. 28*d* is a partial enlarged diagram of the lower body 110 of the shoe care device 2 of FIG. 21*a*.

The through hole 113*d* may be formed in the third internal cabinet 113. The reinforcing rib 114*d* may be formed in the third external cabinet 114. The reinforcing rib 114*d* may be inserted into the through hole 113*d*. The harness of the motor 290 may enter the inside of the lower body 110 through the through hole 113*d*. The reinforcing rib 114*d* is formed at a point where harness of the motor 290 enters the inside of the lower body 110 to form the rigidity at an entrance point.

A plurality of hooks 113*e* may be formed at the front, left, and right edges of the third internal cabinet 113. When the third internal cabinet 113 descends from the top of the third external cabinet 114, the hook 113*e* is locked to the locking hole 114*e* of the third external cabinet 114. The third internal cabinet 113 and the third external cabinet 114 may have the coupling force by the simple hook coupling structure.

Figure 29A:
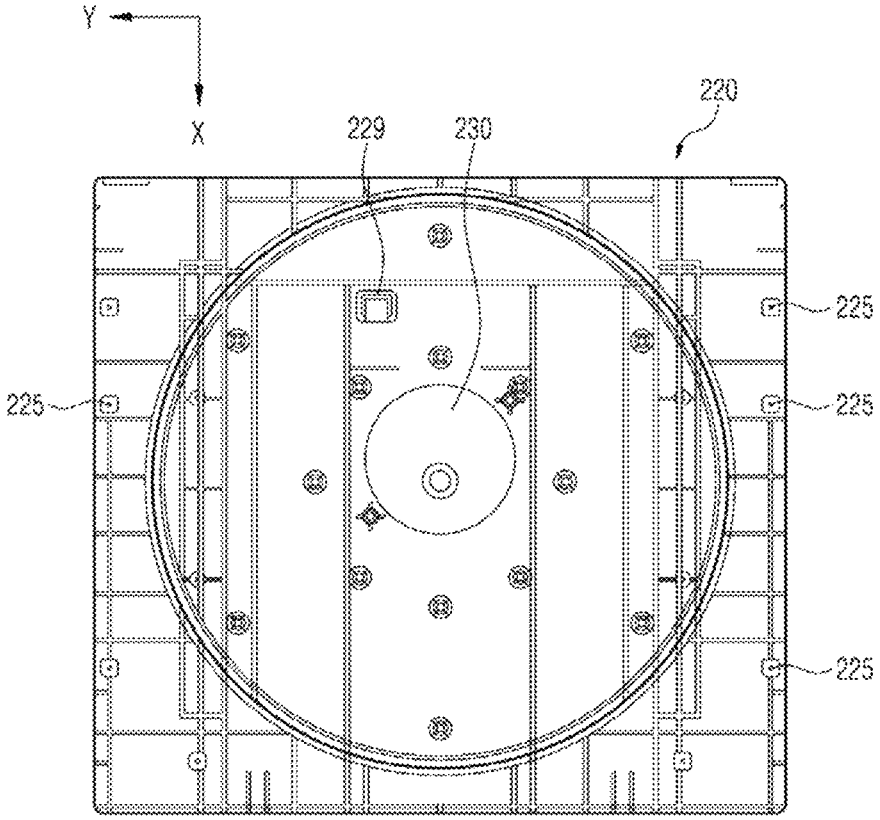
FIG. 29*a* is a bottom view illustrating the moving body of the shoe care device according to the embodiment of the present invention.
Figure 29B:
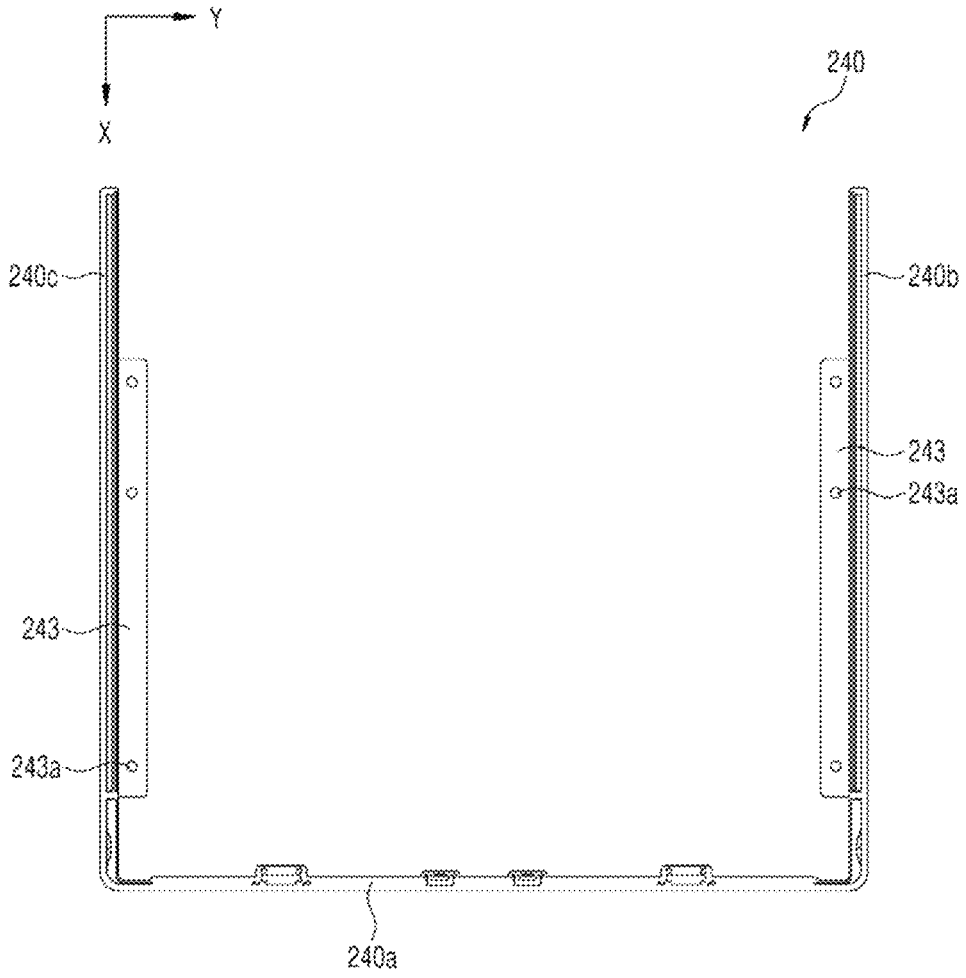
FIG. 29*b* is a plan view illustrating the lower guard of the shoe care device according to the embodiment of the present invention.

FIG. 29*a* is a bottom view illustrating the moving body 200 of the shoe care device 2 according to the embodiment of the present invention. FIG. 29*b* is a plan view illustrating the lower guard 240 of the shoe care device 2 according to the embodiment of the present invention.

A rib 228 may be formed along the edge on the bottom of the base 220. The rib 228 may assign the rigidity along the edge of the bottom of the base 220. The rib 228 may not be formed at the left and right sides of the rear of the base 220. Therefore, the rib 228 and the lower cover portion 113*c* may not interfere with each other at the first location of the moving body 200.

When the moving body 200 slidably moves between the first location and the second location, the harness of the motor 290 may move. In this case, the harness of the motor 290 may generate noise in contact with the bottom of the base 220 and the top of the third internal cabinet 113. Further, the harness of the motor 290 may be damaged by the friction force. A fixation hook 229 to which the harness of the motor 290 is locked may be formed on the bottom of the base 220. The friction of the harness of the motor 290, and the resulting noise and damage may be prevented by the fixation hook 229.

The moving body 200 may be configured to include a lower guard 240. The lower guard 240 is fixedly coupled to an outer side of a border of the base 220. The lower guard 240 is fixedly coupled to a front surface 220*b*, a left surface 220*c*, and a right surface 220*d* of the base 220.

The lower guard 240 may be configured substantially in the C shape (or ⊂ shape, π shape, or ⊓ shape) on the plan view. On the plan view, the shape of the lower guard 240 may be configured to correspond to the shape of the transparent window 210.

The lower guard 240 may be positioned outside the lower body 110.

The lower guard 240 is configured to include a first lower guard 240*a*, a second lower guard 240*b*, and a third lower guard 240*c*. The lower guard 240 may be integrally configured.

The first lower guard 240*a* forms the front surface of the lower guard 240. The outer surface and the inner surface of the first lower guard 240*a* may be configured to be orthogonal to the first direction X. The second lower guard 240*b* forms the left surface of the lower guard 240. The outer surface and the inner surface of the second lower guard 240*b* may be configured to be orthogonal to the second direction Y. The third lower guard 240*c* forms the right surface of the lower guard 240. The outer surface and the inner surface of the third lower guard 240*c* may be configured to be orthogonal to the second direction Y.

The first lower guard 240*a* may be positioned at the front side of a front end of the lower body 110. The second lower guard 240*b* may be positioned at the left side of a left end of the lower body 110. The third lower guard 240*c* may be positioned at the right side of a right end of the lower body 110.

The lower guard 240 may be configured to include a pair of seating ribs 243. The seating rib 243 protrudes inward on the inner surface of the rear of the lower guard 240. The seating rib 243 protrudes in an inner direction on the inner surface of each of the second lower guard 240*b* and the third lower guard 240*c*. A pair of seating ribs 243 may be spaced forward from the rear end of the lower guard 240. Therefore, the seating rib 243 and the lower cover portion 113*c* may not interfere with each other at the first location of the moving body 200. A pair of seating ribs 243 may be provided at opposite locations based on the reference plane RP.

The base 220 may be seated on a pair of seating ribs 243. The through hole 243*a* may be formed in the seating rib 243. A plurality of fastening bosses 225 may be formed in the base 220. The plurality of fastening bosses 225 may be spaced forward from the rear end of the base 220. The bolt may be screw-coupled to the fastening boss 225 through the through hole 243*a*. As a result, the base 220 and the lower guard 240 may have the solid coupling force.

Figure 30A:
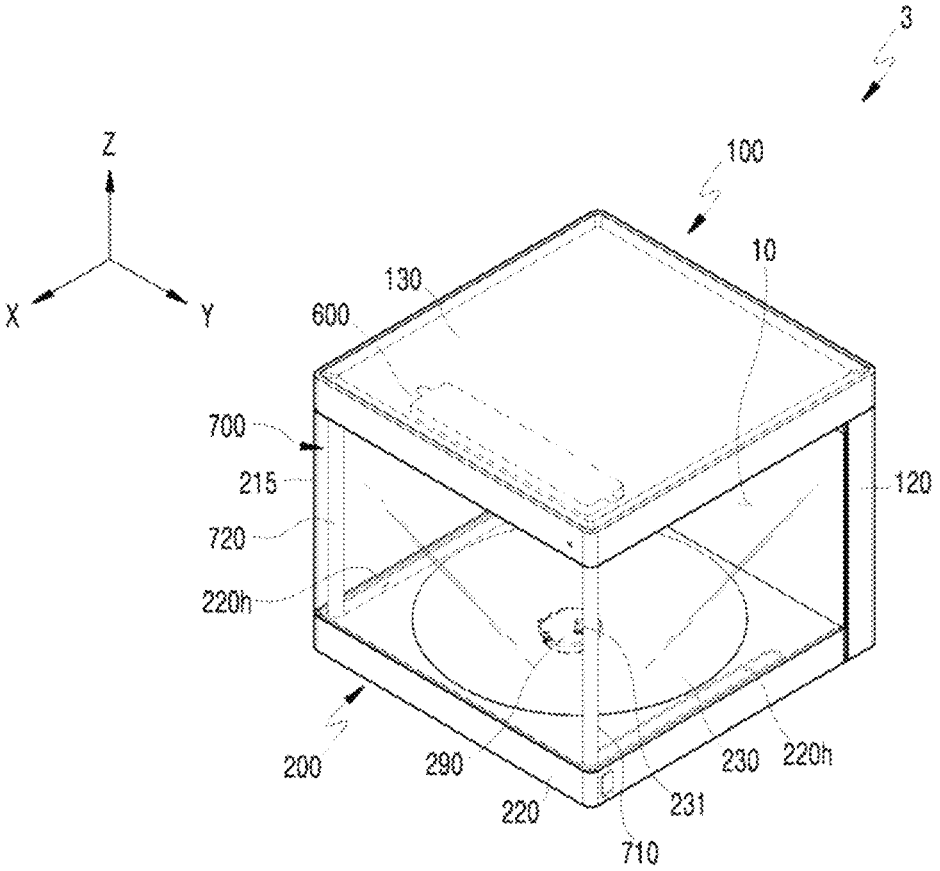
FIG. 30*a* is a perspective view illustrating a shoe care device according to an embodiment of the present invention.
Figure 30B:
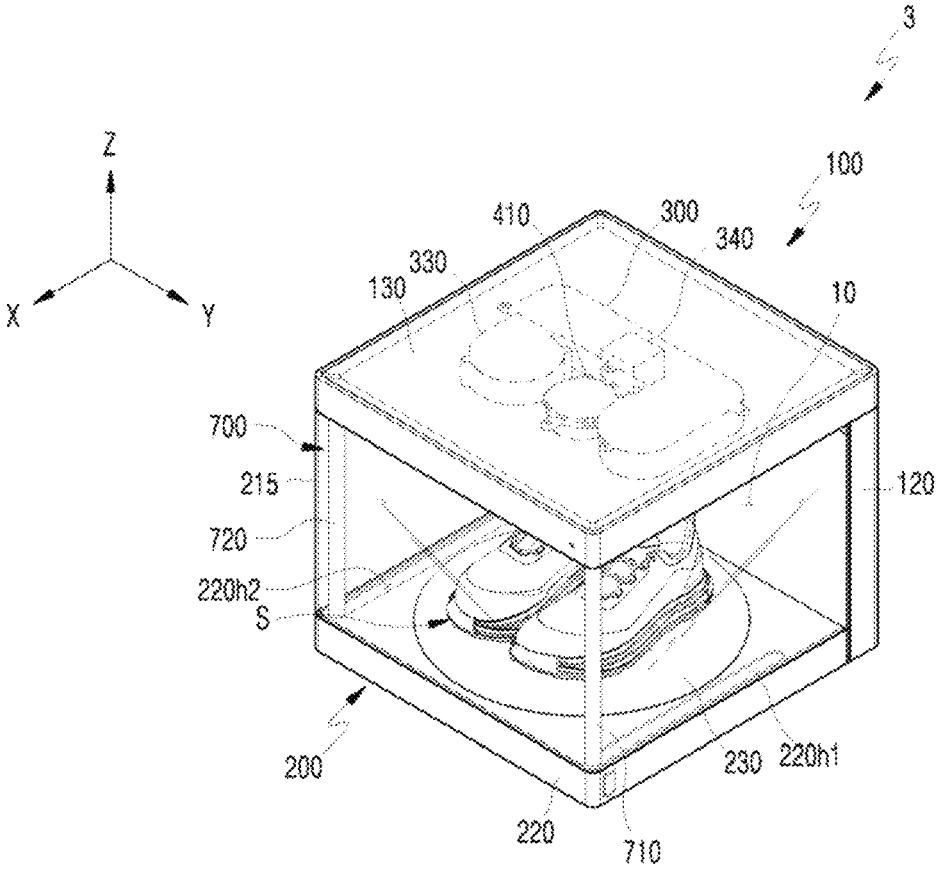
FIG. 30*b* is a perspective view illustrating a state in which a shoe is stored in the accommodation space of the shoe care device of FIG. 30*a*.

FIG. 30*a* is a perspective view illustrating a shoe care device 3 according to an embodiment of the present invention. FIG. 30*a* illustrates a state in which an internal space (hereinafter, referred to as 'accommodation space 10') of the shoe care device 3 is closed. FIG. 30*b* is a perspective view illustrating a state in which a shoe S is stored in the accommodation space 10 of the shoe care device 3 of FIG. 30*a*.

Figure 31A:
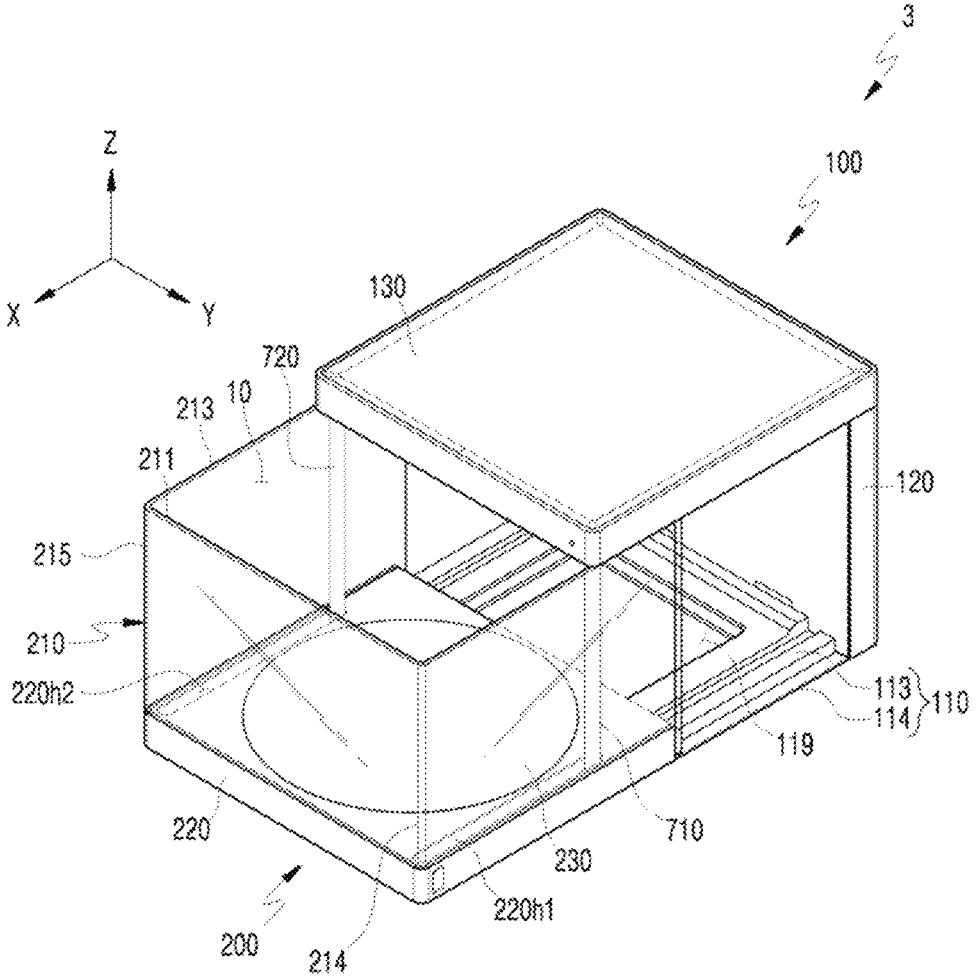
FIG. 31*a* is a perspective view illustrating a state in which the accommodation space of the shoe care device of FIG. 30*a* is opened.
Figure 31B:
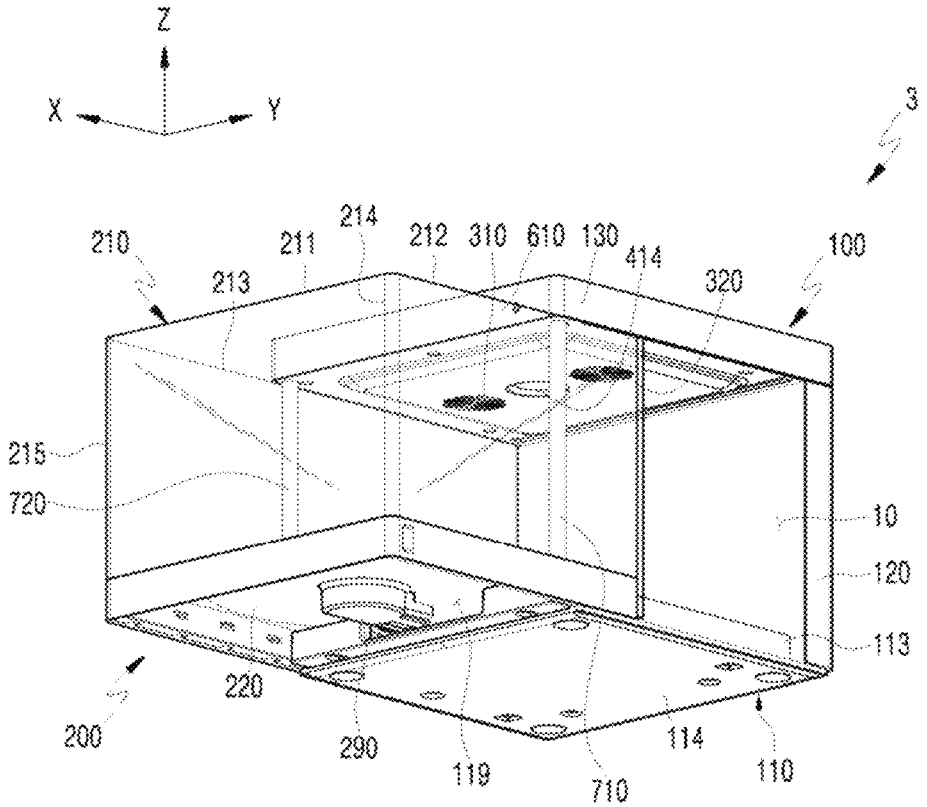
FIG. 31*b* is a perspective view illustrating a view of the shoe care device of FIG. viewed in another direction.

FIG. 31*a* is a perspective view illustrating a state in which the accommodation space 10 of the shoe care device 3 of FIG. 30*a* is opened. FIG. 31*b* is a perspective view illustrating a view of the shoe care device 3 of FIG. 31*a* viewed in another direction.

As illustrated in FIGS. 30*a* and 30*b*, the shoe care device 3 according to the embodiment of the present invention is configured to include a body 100 and a moving body 200.

The body 100 and the moving body 200 form the accommodation space 10 accommodating the shoe S jointly. The body 100 and the moving body 200 are coupled to move with respect to each other. The moving body 200 may be coupled to the body 100 to reciprocally move in a horizontal direction.

The shoe care device 3 illustrated in FIG. 30*a* may be changed like the shoe care device 3 illustrated in FIG. 31*a*. That is, the moving body 200 may slidably move in a first direction X with respect to the body 100, and the shoe care device 3 is transformed from the closed state to the opened state, and the accommodation space 10 may be opened.

The shoe care device 3 illustrated in FIG. 31*a* may be changed like the shoe care device 3 illustrated in FIG. 30*a* again. That is, the moving body 200 may slidably move in an opposite direction to the first direction X with respect to the body 100, and the shoe care device 3 is transformed from the opened state to the closed state, and the accommodation space 10 may be closed.

As such, in the shoe care device 3 according to the embodiment of the present invention, the moving body 200 may move the first direction X or the opposite direction to the first direction X with respect to the body 100, and reciprocally move in the front and rear directions.

In the state in which the accommodation space 10 is closed, the accommodation space 10 may be sealed from outside air. Therefore, when the shoe S is accommodated in the accommodation space 10 and the accommodation space 10 is closed, a contact of the shoe S with dust and moisture of the outside air may be interrupted.

The body 100 may form an upper surface and a rear surface of the accommodation space 10.

The moving body 200 may form a front surface, a lower surface, and both side surfaces of the accommodation space 10.

The accommodation space 10 may be formed in a hexahedral form. However, the accommodation space 10 of the shoe care device 3 according to the embodiment of the present invention is not limited to such a shape, and may be configured in various three-dimensional shapes.

The body 100 and the moving body 200 may form an overall appearance of the shoe care device 3. An exterior of the shoe care device 3 may be configured in the hexahedral form. That is, in the state in which the body 100 and the moving body 200 are coupled to each other and the accommodation space 10 is closed, the external appearance of the shoe care device 3 may be configured in the hexahedral form.

The body 100 may include an upper body 130, a middle body 120, and a lower body 110.

The upper body 130 is positioned at an upper side of the accommodation space 10. The upper body 130 forms the upper surface of the accommodation space 10. The upper body 130 may form an uppermost portion of the shoe care device 3. The upper surface of the upper body 130 may form a flat surface along a substantially horizontal surface. When a plurality of shoe care devices 3 is provided, any one shoe care device 3 may be placed on the upper surface of the upper body 130 of the other one shoe care device 3, and both the shoe care devices 3 may be stacked on each other.

The lower body 110 is positioned below the accommodation space 10. The lower body 110 may confirm the lower portion of the shoe care device 3. The lower body 110 may include a third internal cabinet 113 and a third external cabinet 114.

The third external cabinet 114 may form a lowermost portion of the shoe care device 3. The third internal cabinet 113 may be coupled to the upper side of the third external cabinet 114. A power supply capable of supplying the power to the motor 290 may be provided between the third internal cabinet 113 and the third external cabinet 114.

The middle body 120 is positioned behind the accommodation space 10. The middle body 120 forms the rear surface of the accommodation space 10. The middle body 120 may connect the upper body 130 and the lower body 110 behind the accommodation space 10. The middle body 120 may form a rear wall surface of the shoe care device 3.

The body 100 is configured to include the upper body 130, the middle body 120, and the lower body 110, and as a result, the body 100 may form a substantially 'C' form on the side view.

As described above, the moving body 200 is configured to move forward and backward with respect to the body 100. The moving body 200 may include a base 220, a transparent window 210, and a turntable 230.

The base 220 may be coupled to the lower body 110 to be slidably movable in the first direction X. The base 220 may form the bottom portion of the moving body 200. The base 220 may be positioned at the upper side of the lower body 110. A bottom surface of the base 220 may be positioned in close contact with or in proximity to the upper surface of the lower body 110.

The transparent window 210 may form of extending upward from the base 220. The transparent window 210 may form the front surface, and both side surfaces (the left surface and the right surface) of the accommodation space 10. The transparent window 210 may be made of a transparent or translucent material.

Light inside and outside the accommodation space 10 may pass through the transparent window 210. The transparent window 210 may be made of a material which is weather-resistant to prevent discoloration. The transparent window 210 may be made of an acrylic (PMMA) material which is weather-resistant and scratch-resistant.

The transparent window 210 may prevent a beam having a predetermined wavelength from being introduced into the accommodation space 10. As an example, the transparent window 210 may be configured to block ultraviolet rays. The ultraviolet rays as an electromagnetic wave in which a wavelength corresponds to 10 to 397 nm shorter than visible rays are light which has a strong chemical action and causes getting sunburn or discoloration.

As an example, an ultraviolet-proof film may be attached to an inner surface or an outer surface of the transparent window 210. Alternatively, the inner surface or the outer surface of the transparent window 210 may be UV-coated with an ultraviolet-proof agent.

The transparent window 210 includes a first window 211, a second window 212, and a third window 213. The first window 211 may form the front surface of the accommodation space 10. The second window 212 may form the left surface of the accommodation space 10. The third window 213 may form the right surface of the accommodation space 10.

When the moving body 200 is at the first location, both left and right sides at the upper side and both left and right sides at the lower side of the moving body 200 are supported by the body 100. When the moving body 200 is at the second location, both left and right sides at the upper side and both left and right sides at the lower side of the moving body 200 may be supported by the body 100.

The first window 211, the second window 212, and the third window 213 may have a small gap from the upper body 130. Therefore, external air may not be introduced into the accommodation space 10.

In the state in which the shoe S is accommodated in the accommodation space 10, a user may view the shoe S through the transparent window 210. As a result, the shoe care device 3 may be used as a device which may display the shoe S while keeping and caring the shoe S.

As illustrated in FIGS. 30*a* and 30*b*, in the state in which the moving body 200 is positioned relatively at a rearmost side, the accommodation space 10 may be sealed from the outside air. In this case, the accommodation space 10 may be formed in the hexahedral form. In this case, the moving body 200 may be at the first location, and the shoe care device 3 may be in the closed state.

As illustrated in FIGS. 31*a* and 31*b*, in the state in which the moving body 200 moves in the first direction X, the accommodation space 10 may be opened. In this case, an upper portion of the first window 211 is spaced to a front side in the first direction X from the front surface of the upper body 130 to form a gap (hereinafter, referred to as 'first gap').

In this case, an upper portion of the first window 212 is spaced to a front side in the first direction X from the front surface of the upper body 120 to form a gap (hereinafter, referred to as 'first gap'). The third window 213 is spaced to the front side in the first direction X from a right side surface of the middle body 120 to form a gap (hereinafter, referred to as 'third gap').

In the state in which the moving body 200 moves in the first direction X as much as possible, i.e., in the state in which the moving body 200 is positioned relatively at a frontmost side, the moving body 200 may be present at a second location and the shoe care device 3 may be in the opened state.

The user may put the shoe S into the accommodation space 10 or withdraw the shoe S from the accommodation space 10 through the first gap.

The user may put a sheet (hereinafter, referred to as 'information sheet') indicating information into the accommodation space 10 or withdraw the shoe S from the accommodation space 10 through the first gap. The information may mean a set of broad-sense symbols such as letters, figures, or images. As an example, the information sheet may be a sheet printed with a photo, a picture, or a letter. The information sheet may be manufactured by various sheets such as a rectangle, a circle, etc.

One or more magnets may be provided in the information sheet. The information sheet may be coupled to or decoupled from the inner surface of the middle body 120 by the magnetic force.

The information sheet may be exposed to the vision of the person who sees the shoe S accommodated in the shoe care device 3. Therefore, the user of the shoe care device 3 may display the photo and the picture on the rear surface of the accommodation space 10 by attaching the information sheet onto the front surface of the middle body 120.

The turntable 230 may form the upper surface on which the shoe S is placed. The upper surface of the turntable 230 may have a circular shape. The turntable 220 may form the lower surface of the accommodation space 10 jointly with the base 220.

The turntable 230 may be rotatably coupled to the base 220 around a vertical axis 231, i.e., an axis parallel to a third direction Z.

For the rotation of the turntable 230, a motor 290 may be provided in the moving body 200. The vertical axis 231 may mean the rotational axis 231 of the motor 290. The motor 290 may be coupled to the bottom of the base 220. The turntable 230 may rotate in conjunction with the rotation of the motor 290. Rotational force of the motor 290 may be delivered to the turntable 230 through a reducer. The motor 290 may rotate unidirectionally or reciprocally rotate bidirectionally.

The turntable 230 is provided, and as a result, the shoe S may rotate in the accommodation space 10 or a display effect of the shoe S may be enhanced.

The shoe care device 3 according to the embodiment of the present invention may include a front frame 700. The front frame 700 may connect the lower body 110 and the upper body 130 at the front of the body 100. The front frame 700 may be positioned at the front of the body 100 regardless of the location of the moving body 200.

The front frame 700 may have a pipe shape which is long in the vertical direction. The front frame 700 may have a round bar shape which is long in the vertical direction. The front frame 700 may be manufactured by an aluminum alloy which is light and has a large rigidity. As an example, the front frame 700 may be manufactured by using an aluminum alloy to which silicon is added.

As described above, the body 100 is configured to include the upper body 130, the middle body 120, and the lower body 110, and as a result, the body 100 may form a substantially 'C' form on the side view. Therefore, in the body 100, a drooping phenomenon may occur at the front of the upper body 130 by the load of the upper body 130.

When a plurality of shoe care devices 3 is provided, any one shoe care device 3 may be placed on the upper surface of the upper body 130 of the other one shoe care device 3, and both the shoe care devices 3 may be stacked on each other. When the plurality of shoe care devices 3 are stacked on each other, the drooping phenomenon of the upper body 130 may be rapidly progressed by the loads of one or more shoe care devices 3 which are stacked at the upper portion.

The drooping of the upper body 130 may serve as a cause of disturbing the aesthetics of the shoe care device 3. The front frame 700 may support the upper body 130 based on the lower body 110 at the front of the body 100. Therefore, a vertical interval between the lower body 110 and the upper body 130 may be maintained at the front of the body 100 by the front frame 700. That is, the drooping phenomenon of the upper body 130 may be interrupted by the front frame 700. Therefore, the body 100 continuously maintains the 'C' shape on the side view, and as a result, the aesthetics reduction of the shoe care device 3 by the drooping phenomenon of the upper body 130 may be prevented.

As described above, the moving body 200 may be coupled to the lower body 110 to be slidably movable in the first direction X. In addition, the upper end of the transparent window 210 may have a small gap from the upper body 130. When the drooping phenomenon of the upper body 130 occurs, the gap between the upper end of the transparent window 210 and the upper body 130 decreases or converges, so the upper end of the transparent window 210 may be in contact with the upper body 130. Therefore, the drooping of the upper body 130 increases the opening force of the moving body 200 to serve as a main cause of disturbing the sliding movement of the moving body 200 between the first location (see FIG. 30*a*) and the second location (see FIG. 31*a*).

The front frame 700 may support the upper body 130 based on the lower body 110 at the front of the body 100. Therefore, a vertical interval between the lower body 110 and the upper body 130 may be maintained at the front of the body 100 by the front frame 700. That is, the drooping phenomenon of the upper body 130 may be interrupted by the front frame 700. Therefore, the gap between the upper end of the transparent window 210 and the upper body 130 may be continuously maintained. Therefore, the increase in opening force of the moving body 200 by the drooping of the upper body 130 is interrupted, so the moving body 200 may continuously maintain the same opening force between the first location (see FIG. 30*a*) and the second location (see FIG. 31*a*).

As described above, the base 220 may be positioned above the lower body 110. The base 220 may be positioned between the lower body 110 and the upper body 130 at the first location.

The front frame 700 may connect the lower body 110 and the upper body 130 inside the transparent window 210. Therefore, a flow portion hole 220*h* through which the front frame 700 passes in the vertical direction may be formed in the base 220. The flow portion hole 220*h* may penetrate the base 200 vertically.

The base 220 may be coupled to the lower body 110 to be slidably movable in the first direction X. Therefore, the flow portion hole 220*h* may be formed to be long in the first direction X. The moving body 200 may be movably coupled to the body 100 between the first location and the second location.

The front frame 700 may be positioned at the front of the flow portion hole 220*h* at the first location. The front frame 700 may be positioned at the rear of the flow portion hole 220*h* at the second location. Based on the moving body 200, the front frame 700 may relatively move forward and backward along the flow portion hole 220*h* between the first location and the second location.

A front inner surface of the flow portion hole 220*h* may be spaced apart from an outer surface of the front frame 700 by a predetermined interval at the first location (see FIG. 30*a*). The front frame 700 may have the round bar which is long in the vertical direction. Therefore, the front inner surface of the flow portion hole 220*h* may have a semicircular shape on the plan view.

A rear inner surface of the flow portion hole 220*h* may be spaced apart from an outer surface of the front frame 700 by a predetermined interval at the second location (see FIG. 31*a*). The front frame 700 may have the round bar which is long in the vertical direction. Therefore, the rear inner surface of the flow portion hole 220*h* may have the semicircular shape on the plan view.

A first-direction length of the flow portion hole 220*h* may be larger than an interval between the first location (see FIG. 30*a*) and the second location (see FIG. 31*a*). In addition, a horizontal width of the flow portion hole 220*h* may be larger than a diameter of the front frame 700. Therefore, in the process in which the moving body 200 moves between the first location and the second location, the front frame 700 may not be in contact with the base 220.

Therefore, in the process in which the moving body 200 moves between the first location and the second location, the increase in opening force of the moving body 200 by the interference between the front frame 700 and the base 220 may be interrupted. Therefore, the moving body 200 may continuously maintain the same opening force between the first location (see FIG. 30*a*) and the second location (see FIG. 31*a*).

The shoe care device 3 may include an operating button 610 and a controller 600. The operating button 610 may be formed in the body 100. As an example, the operating button 610 may be formed on the front surface of the upper body 130.

When the user manipulates the operating button 610, the turntable 230 may rotate or stop. The user manipulates the operating button 610 to adjust a rotational speed of the turntable 230. The user may input a rotation time of the turntable 230 into the controller 600 through the operating button 610.

The body 100 may be configured to include the lower body 110 positioned below the accommodation space 10, and having the lower body groove 119 having a shape in which the front side is opened.

The moving body 200 may be configured to include the base 220 slidably coupled to the lower body 110, the turntable 230 rotatably coupled to the base 220 around the vertical axis 231, and forming the bottom of the accommodation space 10 jointly with the base 220, and the motor 290 placed in the lower body groove 119 and coupled to apply the rotational force to the turntable 230.

An extension line of the vertical axis 231 may be positioned within the reference plane RP which is parallel to the first direction X which is the horizontal direction and which is the vertical surface.

That is, the lower body groove 119 which is concave downward and opened forward is formed at the central portion of the lower body 110 to prevent interference with the body 100 in the process of the sliding movement of the moving body 200.

In particular, the motor 290 also needs to be coupled to the base 220 in order to rotate the turntable 230 coupled to the base 220 of the moving body 200, and it may be preferable to place the motor 290 below the base 220 in appearance.

Therefore, when the motor 290 is placed below the base 220, it may be more preferable to place the motor 290 at the lower body groove 119 so as to prevent the motor 290 from interfering with the body 100 in the process of the sliding movement of the moving body 200.

As such, in the shoe care device 3 according to the embodiment, since the motor 290 applying the rotational force to the turntable 230 is placed at the lower body groove 119 formed in the lower body 110, the motor 290 may be prevented from interfering in the body 100 in the process of the sliding movement of the moving body 200.

The moving body 200 forms the accommodation space 10 jointly with the body 100. The moving body 200 may be movably coupled to the body 100 between the first location and the second location. The second location is a location before the first location. The moving body 200 may be coupled to the body 100 to be movable forward and backward with respect to the body 100.

When the moving body 200 is at the first location, the accommodation space 10 is closed and when the moving body 200 is at the second location, the accommodation space 10 is opened.

When the moving body 200 is at the second location, the accommodation space 10 of the shoe care device 3 is opened at the upper side, the left side, and the right side.

When the moving body 200 moves forward and backward with respect to the body 100, the moving body 200 may be supported by the lower body 110 and the upper body 130.

When the moving body 200 is at the first location, both left and right sides at the upper side and both left and right sides at the lower side of the moving body 200 are supported by the body 100. When the moving body 200 is at the second location, both left and right sides at the upper side and both left and right sides at the lower side of the moving body 200 may be supported by the body 100.

In the embodiment of the present invention, the transparent window 210 may be integrally configured.

The transparent window 210 includes a first window 211, a second window 212, and a third window 213. Each of the first window 211, the second window 212, and the third window 213 is configured to be transparent. Each of the first window 211, the second window 212, and the third window 213 may be configured in a flat plate form.

The first window 211 forms the front surface of the shoe care device 3, the second window 212 forms the left surface of the shoe care device 3, and the third window 213 forms the right surface of the shoe care device 3. The second window 212 extends to a rear side from a left end of the first window 211, and the third window 213 extends to the rear side from a right end.

The first window 211 forms the front surface of the transparent window 210, the second window 212 forms the left surface of the transparent window 210, and the third window 213 forms the right surface of the transparent window 210.

The inner surface of the first window 211 forms the front surface of the accommodation space 10. The inner surface of the second window 212 forms the left surface of the accommodation space 10. The inner surface of the third window 213 forms the right surface of the accommodation space 10.

The transparent window 210 may be parallel to the first direction X which is the horizontal direction and form the symmetry based on the reference surface RP which is the vertical surface. The second window 212 and the third window 213 may be configured symmetric to each other around the reference plane RP.

In the shoe care device 3, the upper body 130 and the first window 211 may be opened/closed to each other, the middle body 120 and the second window 212 may be opened/closed to each other, and the middle body 120 and the third window 213 may be opened/closed to each other.

In the shoe care device 3 according to the embodiment of the present invention, the transparent window 210 may be integrally formed. In addition, the transparent window 210 may form an area of substantial parts of the front surface, the left surface, and the right surface of the shoe care device 3.

An area of the first window 211 may be configured to correspond to the area of the front surface of the accommodation space 10. The area of the second window 212 may be configured to correspond to the area of the left surface of the accommodation space 10. The area of the third window 213 may be configured to correspond to the area of the right surface of the accommodation space 10.

According to the embodiment of the present invention, the area of the transparent window 210 may be maximized, the shoe S accommodated in the accommodation space 10 may be well viewed at all of the front side, the left side, and the right side, and the display effect of the shoe may be increased.

The transparent window 210 includes a first curved surface portion 214 and a second curved surface portion 215. Each of the first curved surface portion 214 and the second curved surface portion 215 forms a vertical corner portion of the transparent window 210.

The first curved surface portion 214 is a portion connecting the first window 211 and the second window 212. A cross section of the first curved surface portion 214 may be constantly configured in an upper and lower direction (or third direction). The first curved surface portion 214 is configured in a curved surface structure. Each of the outer surface and the inner surface of the first curved surface portion 214 is configured in a curved surface form which is convex to the outside of the transparent window 210.

The first window 211 and the first curved surface portion 214 may be configured so that a curvature radius is continuously changed. Further, the second window 212 and the first curved surface portion 214 may be configured so that the curvature radius is continuously changed. That is, on an inner surface and an outer surface of a portion connected from the first window 211 to the first curved surface portion 214 and the second window 212, the curvature radius may not be discontinuously changed, but a bent surface may not be formed.

When the inner surfaces and the outer surfaces of the first window 211 and the second window 212 are configured by planes in the transparent window 210, and the transparent window 210 is configured to include the first curved surface portion 214, the curvature radii of the inner surface and the outer surface of the first curved surface portion 214 may be configured as 1 to 50 mm.

The second curved surface portion 215 is a portion connecting the first window 211 and the third window 213. The cross section of the second curved surface portion 215 may be constantly configured in the upper and lower direction (or third direction). The second curved surface portion 215 is configured in the curved surface structure. Each of the outer surface and the inner surface of the second curved surface portion 215 is configured in the curved surface form which is convex to the outside of the transparent window 210.

The first window 211 and the second curved surface portion 215 may be configured so that the curvature radius is continuously changed. Further, the third window 213 and the second curved surface portion 215 may be configured so that the curvature radius is continuously changed. That is, on the inner surface and the outer surface of a portion connected from the first window 211 to the second curved surface portion 215 and the third window 213, the curvature radius may not be discontinuously changed, but the bent surface may not be formed.

When the inner surfaces and the outer surfaces of the first window 211 and the third window 213 are configured by the planes in the transparent window 213, and the transparent window 210 is configured to include the second curved surface portion 215, the curvature radii of the inner surface and the outer surface of the first curved surface portion 214 may be configured as 1 to 50 mm.

As described above, according to an embodiment of the present invention, any gap is not formed at a connection portion of the first window 211 and the second window 212 and a connection portion of the first window 211 and the third window 213, and the aesthetics at the portions are excellent, and foreign substances such as dust can be prevented from being inserted into the accommodation space 10 through the portions.

The transparent window 210 integrally configured in the shoe care device 3 according to the embodiment of the present invention is made of polymethyl methacrylate (PMMA), and includes the first curve portion 214 and the second curve portion 215. As a result, the aesthetics of the transparent window 210 itself may be excellent, and the shoe care device 3 may be easily assembled. Further, discoloration of the transparent window 210 may be prevented, and a solid transparent window 210 may be formed.

The front frame 700 may connect the lower body 110 and the upper body 130 inside the transparent window 210.

The front frame 700 may be positioned at a shortest distance from the first window 211 at the first location (see FIG. 30*a*). The front frame 700 may be positioned at a longest distance from the first window 211 at the second location (see FIG. 31*a*).

The front frame 700 may include a first front frame 710 and a second front frame 720.

The first front frame 71 may connect the lower body 110 and the upper body 130 at the front of the left side of the body 100. The front frame 710 may be positioned at a longest distance from the first curved surface portion 214 at the second location (see FIG. 31*a*).

The first front frame 710 may be positioned at a shortest distance from the first window 211 at the first location (see FIG. 30*a*). In addition, the first front frame 710 may form a predetermined distance from the second window 212 between the first location and the second location. Therefore, the first front frame 710 may be positioned at a corner portion where the first window 211 and the second window 212 meet at the first location (see FIG. 30*a*), i.e., at a shortest distance from the first curved surface portion 214. The shortest distance between the first front frame 710 and the first curved surface portion 214 may mean less than 10 mm.

Each of the first window 211, the second window 212, and the third window 213 may be configured in a flat plate form. Therefore, incident on the first window 211, the second window 212, or the third window 213 and light which is refracted inside the window, and emitted may be parallel throughout an entire area. Therefore, the user may substantially observe the object in the accommodation space 10 without distortion of the shape through the first window 211, the second window 212, and the third window 213.

That is, the user positioned at the front of the first window 211 may observe the shoes in the accommodation space 10 without distortion of the shape through the first window 211. The user positioned at the front of the second window 212 may observe the shoes in the accommodation space 10 without distortion of the shape through the second window 212. The user positioned at the front of the third window 213 may observe the shoes in the accommodation space 10 without distortion of the shape through the third window 213.

The first curved surface portion 214 is configured in a curved surface structure. Each of the outer surface and the inner surface of the first curved surface portion 214 is configured in a curved surface form which is convex to the outside of the transparent window 210. Therefore, light incident on the first curved surface portion 214, and light refracted inside the first curved surface portion, and emitted may not be substantially parallel to each other. Therefore, the object in the accommodation space 10 may be observed as a slightly distorted shape through the first curved surface portion 214.

As the first front frame 710 is positioned at a shortest distance from the first curved surface portion 214 at the first location (see FIG. 30*a*), when the vision of the user is positioned in a direction in which the X axis and the Y axis form an angle of approximately 45 degrees (see FIG. 30*b*), the vision of the user may reach the first front frame 710 through the first curved surface portion 214. That is, the first front frame 710 may be observed through the first curved surface portion 214.

When the first front frame 710 is positioned between the first window 211 or the second window 212 based on the vision of the user, the visibility of the shoes in the accommodation space 10 may be reduced by each of the first front frame 710 and the first curved surface portion 214. As the first front frame 710 is positioned primarily between the shoe and the first curved surface portion 214 based on the vision of the user, even though the first front frame 710 is provided in the accommodation space 10, a visibility lowering phenomenon of the shoe by the first front frame 710 may be minimized.

The second front frame 720 may connect the lower body 110 and the upper body 130 at the front of the right side of the body 100. The second front frame 720 may be positioned at a longest distance from the second curved surface portion 215 at the second location (see FIG. 31*a*).

The second front frame 720 may be positioned at a shortest distance from the first window 211 at the first location (see FIG. 30*a*). In addition, the second front frame 720 may form a predetermined distance from the third window 213 between the first location and the second location. Therefore, the second front frame 720 may be positioned at a corner portion where the first window 211 and the third window 213 meet at the first location (see FIG. 30*a*), i.e., at a shortest distance from the second curved surface portion 215. The shortest distance between the second front frame 720 and the second curved surface portion 215 may mean less than 10 mm.

Each of the first window 211, the second window 212, and the third window 213 may be configured in a flat plate form. Therefore, incident on the first window 211, the second window 212, or the third window 213 and light which is refracted inside the window, and emitted may be parallel throughout an entire area. Therefore, the user may substantially observe the object in the accommodation space 10 without distortion of the shape through the first window 211, the second window 212, and the third window 213.

That is, the user positioned at the front of the first window 211 may observe the shoes in the accommodation space 10 without distortion of the shape through the first window 211. The user positioned at the front of the second window 212 may observe the shoes in the accommodation space 10 without distortion of the shape through the second window 212. The user positioned at the front of the third window 213 may observe the shoes in the accommodation space 10 without distortion of the shape through the third window 213.

The second curved surface portion 215 is configured in the curved surface structure. Each of the outer surface and the inner surface of the second curved surface portion 215 is configured in the curved surface form which is convex to the outside of the transparent window 210. Therefore, light incident on the second curved surface portion 215, and light refracted inside the first curved surface portion, and emitted may not be substantially parallel to each other. Therefore, the object in the accommodation space 10 may be observed as a slightly distorted shape through the second curved portion 215.

As the second front frame 720 is positioned at a shortest distance from the first curved portion 215 at the first location (see FIG. 30*a*), when the vision of the user is positioned in a direction in which the X axis and the −Y axis form an angle of approximately 45 degrees, the vision of the user may reach the second front frame 720 through the second curved surface portion 215. That is, the second front frame 720 may be observed through the second curved surface portion 215.

When the second front frame 720 is positioned between the first window 211 or the third window 213 based on the vision of the user, the visibility of the shoes in the accommodation space 10 may be reduced by each of the second front frame 720 and the second curved surface portion 215. As the second front frame 720 is positioned primarily between the shoe and the second curved surface portion 215 based on the vision of the user, even though the second front frame 720 is provided in the accommodation space 10, the visibility lowering phenomenon of the shoe by the second front frame 720 may be minimized.

The flow portion hole 220*h* may include first flow portion hole 220*h*1 and a second flow portion hole 220*h*2.

The first front frame 710 may pass through the first flow portion hole 220*h*1 in the vertical direction. The first flow portion hole 220*h*1 may penetrate the base 200 vertically. The first flow portion hole 220*h*1 may be formed to be long in the first direction X.

The first front frame 710 may be positioned at the front of the first flow portion hole 220*h*1 at the first location. The first front frame 710 may be positioned at the rear of the first flow portion hole 220*h*1 at the second location. Based on the moving body 200, the first front frame 710 may relatively move forward and backward along the first flow portion hole 220*h*1 between the first location and the second location.

The second front frame 720 may pass through the second flow portion hole 220*h*2 in the vertical direction. The second flow portion hole 220*h*2 may penetrate the base 200 vertically. The second flow portion hole 220*h*2 may be formed to be long in the first direction X.

The second front frame 720 may be positioned at the front of the second flow portion hole 220*h*2 at the first location. The second front frame 720 may be positioned at the rear of the second flow portion hole 220*h*2 at the second location. Based on the moving body 200, the second front frame 720 may relatively move forward and backward along the second flow portion hole 220*h*2 between the first location and the second location.

The first flow portion hole 220*h*1 and the second flow portion hole 220*h*2 may be positioned at opposite sides to each other based on the turntable.

The base 220 is fixedly coupled to the lower side of the transparent window 210 to form a lower portion of the moving body 200. An entire form of the base 220 may be configured as a flat form in the horizontal direction. The base 220 may have the rectangular shape in plan view.

The base 220 may be configured so that the shoe S is placed at the upper side of the base 220. The top of the base 220 may be configured substantially in the rectangular shape.

The top of the base 220 may be positioned along the circumference of the turntable 230 in the accommodation space 10. The top of the base 220 may form the bottom of the accommodation space 10 jointly with the top of the turntable 230.

The base 220 is positioned at the upper side of the lower body 110. The top of the base 220 is positioned at the upper side of the lower body 110. The base 220 is coupled to the lower body 110 to be movable forward and backward.

The moving body 200 may be configured to include the turntable 230. The turntable 230 is rotatably coupled around a perpendicular rotational axis 231 at the upper side of the base 220. The turntable 230 is configured in a circular plate form. The upper surface of the turntable 230 may be configured to be in parallel to the first direction X and the second direction Y. The vertical rotational axis 231 may mean the rotational axis 231 of the motor 290.

While the transparent window 210 and the base 220 move forward with respect to the body 100, the shoe may be seated on the base 220 or the shoe may be withdrawn from the base 220 through the space between the upper body 130 and the first window 211.

Further, in this case, the user may access the shoe or an upper space through the space between the middle body 120 and the second window 212 or between the middle body 120 and the third window 213. Further, in this case, the user easily accesses the inner surface of each of the lower body 110, the middle body 120, and the upper body 130 (see FIGS. 31*a* and 31*b*).

Figure 32:
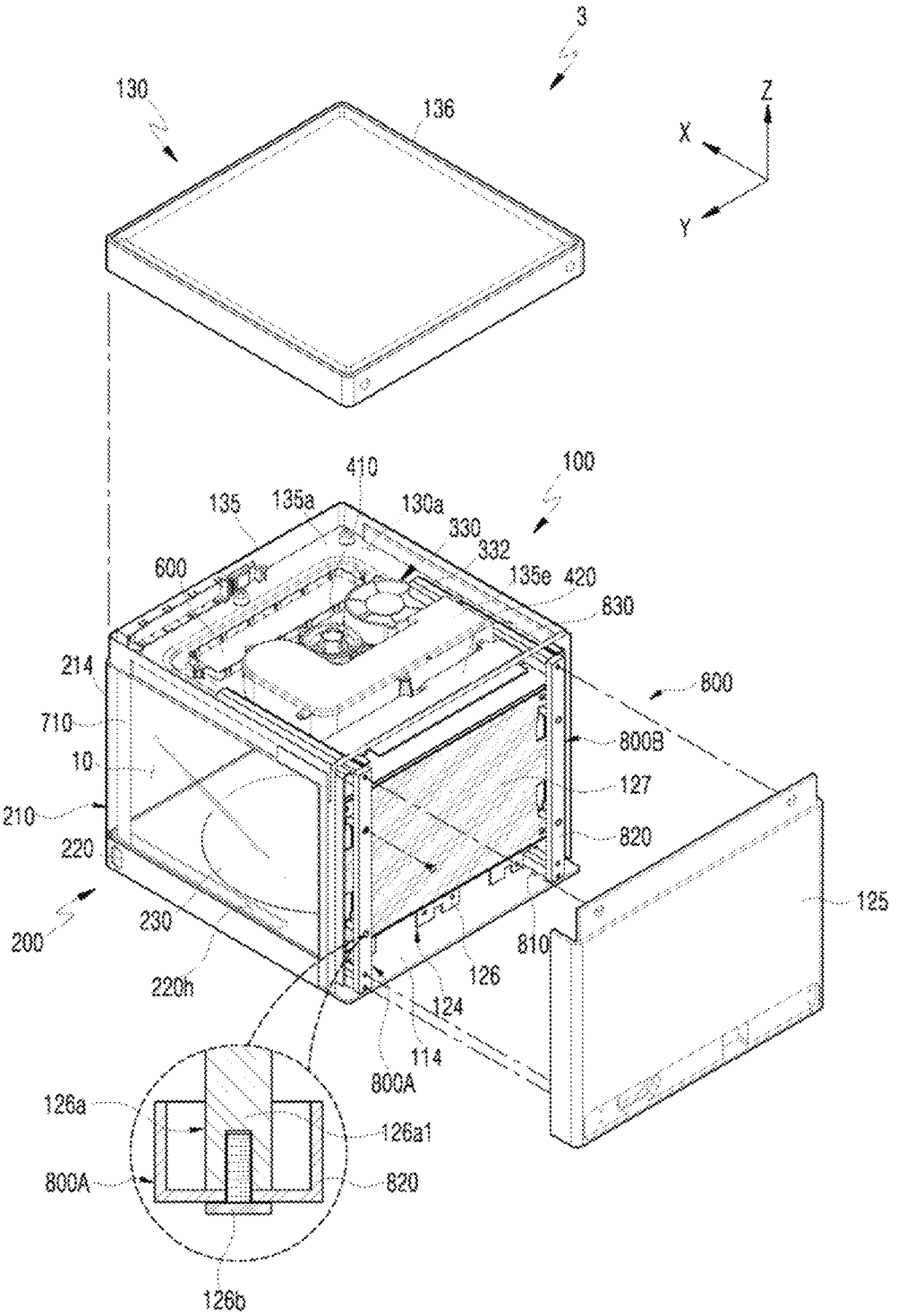
FIG. 32 is a perspective view illustrating a state in which a first external cabinet and a second external cabinet are separated from the body of the shoe care device of FIG. 30*a*.

FIG. 32 is a perspective view illustrating a state in which a first external cabinet 136 and a second external cabinet 125 are separated from the body 100 of the shoe care device 3 of FIG. 30*a*.

The body 100 may include the upper body 130. The upper body 130 may be positioned above the accommodation space 10. The upper body 130 may have an upper space 130*a* of which gas flow is disconnected from the accommodation space therein. The upper space 130*a* may have a hexahedral shape in which lengths in the first direction X and the second direction Y are larger than a length in the third direction Z.

The upper body 130 may include a first internal cabinet 135 and a first external cabinet 136. The first internal cabinet 135 and the first external cabinet 136 may form the upper space 130*a* jointly.

The first internal cabinet 135 may have a rectangular box form opened upward. The first internal cabinet 135 may have the air path 300 connected to the accommodation space 10 (see FIG. 30*b*). The path cover 135*e* may close an upper opening of the air path 300. The first internal cabinet 135 may include an upper bottom plate 135*a*.

The upper bottom plate 135*a* may partition the accommodation space 10 and the upper space 130*a*. The lower surface of the upper bottom plate 135*a* may form the upper surface of the accommodation space 10. The upper surface of the top bottom plate 135*a* may form the bottom of the upper space 130*a*. The upper bottom plate 135*a* may have a plate shape which is wide in the horizontal direction.

The blowing part 330 is a component that circulates air in the accommodation space 10. The blowing part 330 and the air flow path 300 may be provided on the upper surface of the upper bottom plate 135*a*.

The blowing part 330 may include a fan and a fan housing 332. The fan may be provided inside the fan housing 332. The fan 331 may pressure-feed the air by the rotary movement of the impeller. The fan housing 332 may constitute a part of the air flow path 300.

The heating part 340 may be configured to directly or indirectly heat the air in the accommodation space 10. The heating part 340 may be placed in the body 100. The heating part 340 may be placed in the air path 300.

As illustrated in FIG. 31*b*, the suction port 310 and the discharge port 320 may be formed on the upper bottom plate 135*a*.

The air in the accommodation space 10 may be suctioned into the air path 300 through the suction port 310. The air in the air flow path 300 may be discharged to the accommodation space 10 through the discharge port 320. Therefore, air forcibly blown by the blowing part 330 may be circulated in the accommodation space 10 and the air path 300.

The first light 410 may irradiate light to the top of the turntable 230 on which the shoe S is placed on the extension line of the vertical axis 231. The second light 420 may be configured to illuminate the front surface of the middle body 120 behind the first light 410. The first light 410 and the second light 420 may be coupled to the upper bottom plate 135*a*.

The controller 600 may be coupled to the upper bottom plate 135*a*.

The middle body 120 may include a second internal cabinet 124 and a second external cabinet 125. The first external cabinet 136 and the second external cabinet 125 may be coupled to the second internal cabinet 124 by a plurality of bolts 126.

The second internal cabinet 124 may include a magnetic body plate 127 and a resin panel 126.

The resin panel 126 may form the rear surface of the accommodation space. The magnetic body plate 127 may be coupled to the rear surface of the resin panel 126.

The magnetic body plate 127 may be configured by a ferromagnetic body strongly magnetized in the direction of a magnetic field when the magnetic field is applied. As an example, the magnetic body plate 127 may be made of iron, cobalt, nickel, and an alloy thereof. Therefore, the magnetic body plate 127 may have an attraction by magnetic force with a permanent magnet coupled to an information sheet.

The lower body 110, the middle body 120, and the upper body 130 may be coupled to the frame body 800. The frame body 800 may be a component that forms a frame of the body 100. The strength of the body 100 may be reinforced by the frame body 800.

The frame body 800 as a part that is coupled to the body 100 and supports the body 100 in a shape of connecting the upper surface, the lower surface, and the rear surface of the body 100 may reinforce each connection portion of the body 100 which has a relatively vulnerable rigidity structurally.

As described above, in order to for the moving body 200 to slidably move with respect to the body 100, the front surface of the body 100 needs to be opened to correspond to the shape of the moving body 200. Therefore, the body 100 should be formed in a structure to approximately support even a load applied to the opened front surface at portions other than the front surface.

However, in that the body 100 has various components placed therein, and it is possible to form the size or the rigidity to be unlimitedly large, it is necessary to reinforce a structurally vulnerable portion with a separate reinforcing member.

In particular, when the body 100 is formed in a shape in which the front surface is opened, it is necessary to support even the load applied to the front surface on the reaming upper surface, lower surface, and the rear surface, so it may be preferable to reinforce each connection portion of the parts.

As such, in the shoe care device 3 according to the embodiment, since the frame body 800 is coupled to the body 100 in a shape connecting the upper surface, the lower surface, and the rear surface of the body 100 to support the body 100, the shoe care device 3 may maintain a stable state by reinforcing a structural vulnerable part in the body 100.

Figure 33A:
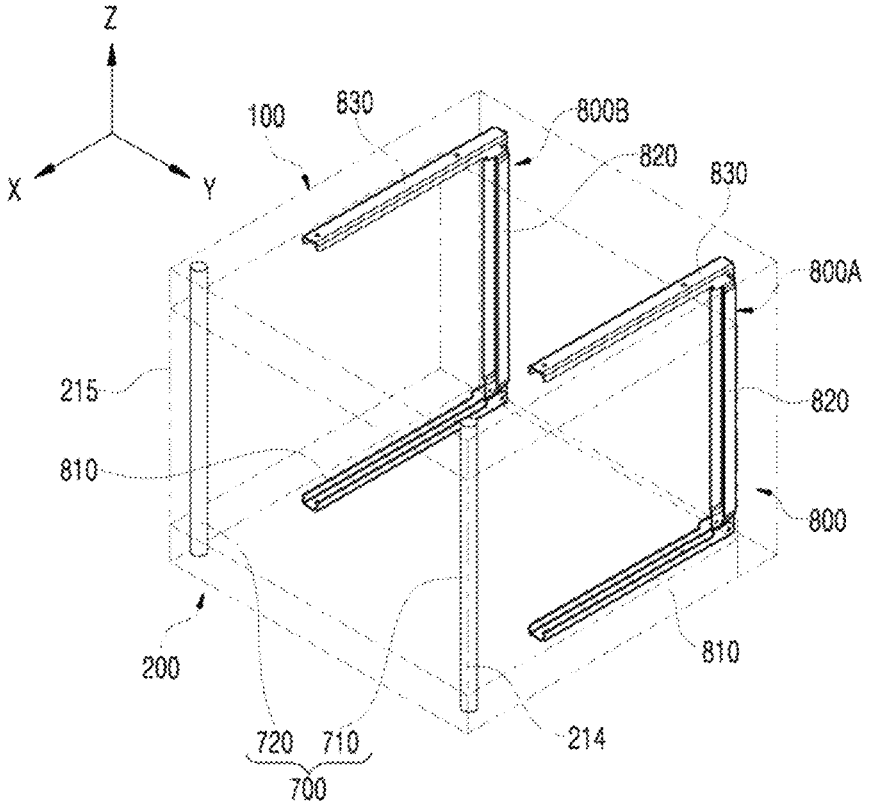
FIG. 33*a* is a perspective view illustrating the frame body and the front frame in the shoe care device of FIG. 30*a*.
Figure 33B:
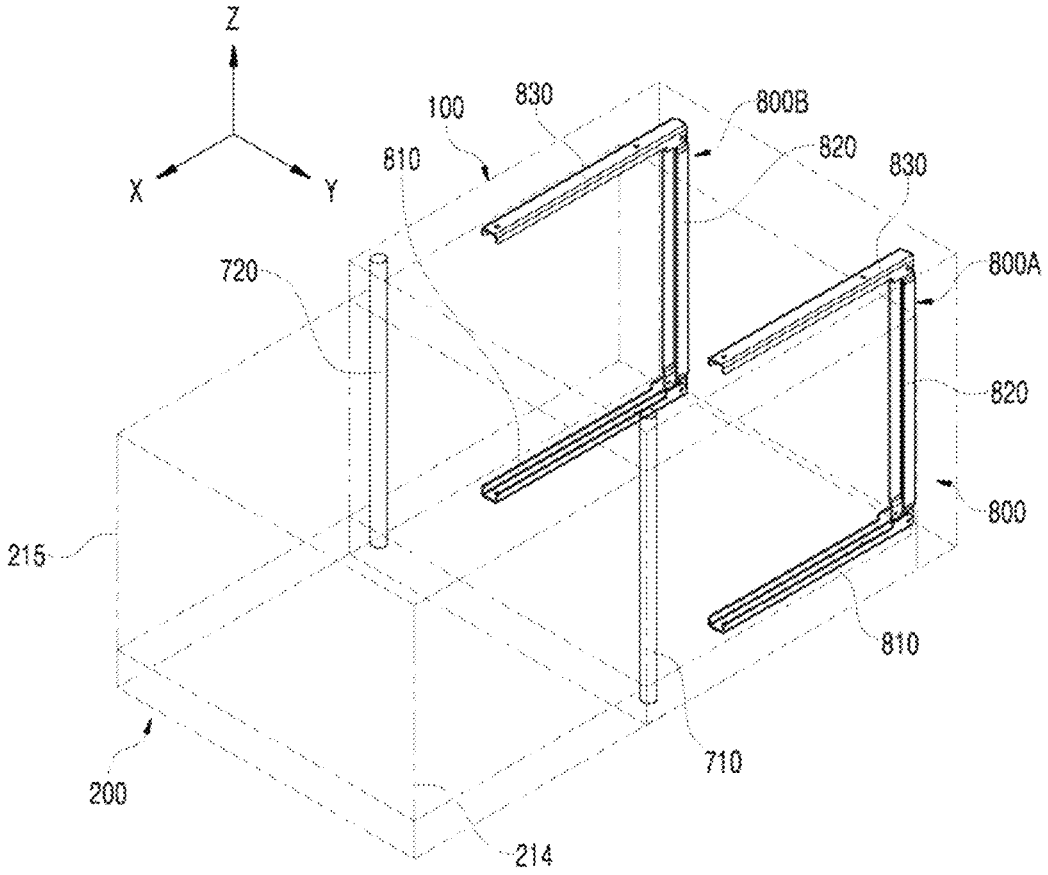
FIG. 33*b* is a perspective view illustrating the frame body and the front frame in the shoe care device of FIG. 31*a*.

FIG. 33*a* is a perspective view illustrating the frame body 800 and the front frame 700 in the shoe care device 3 of FIG. 30*a*. FIG. 33*b* is a perspective view illustrating the frame body 800 and the front frame 700 in the shoe care device 3 of FIG. 31*a*.

In the shoe care device 3 according to the embodiment of the present invention, the frame body 800 may be configured to include an upper frame 830 coupled to the upper body 130, a lower frame 810 coupled to the lower body 110, and a middle frame 820 connecting rear sides of the upper frame 830 and the lower frame 810 and coupled to the middle body 120.

A plurality of bosses 126*a* with female screws may be projected backward on the rear surface of the resin panel 126 (see FIG. 32). The middle frame 820 may be fastened to the boss 126*a* by the bolt 126*b*.

The plurality of bosses with the female screws may be projected upward in the first internal cabinet 135. The upper frame 830 may be fastened to the boss by the bolt.

The plurality of bosses with the female screws may be projected upward in the third external cabinet 114. The lower frame 810 may be fastened to the boss by the bolt.

The body 100 in which the lower body 110, the middle body 120, and the upper body 130 are combined is configured in the C shape when viewed from the side, so the body 100 may form three surfaces of the shoe care device 3 in the 3D space.

In that the upper body 130 is a kind of cantilever structure formed to be projected from the middle body 120, if the middle body 120 does not appropriately support the upper body 130, there may be a problem in that the front end of the upper body 130 is drooped.

In that there is a structural limit to support the upper body 130 only with the middle body 120, it may be preferable to reinforce the connection portion of the lower body 110 and the middle body 120 through the frame body 800, and then reinforce both the middle body 120 and the upper body 130 through the frame body 800.

Therefore, it may be preferable to achieve reinforcement in a structure of connecting the upper body 130, the lower body 110, and the middle body 120 of the body 100 to each other through the upper frame 830, the lower frame 810, and the middle frame 820 of the frame body 800.

That is, the frame body 800 may also be formed in the C shape when viewed from the side, so it is possible to reinforce the structural vulnerable portion of the body 100 formed in the C shape.

As such, in the shoe care device 3 according to the embodiment, since the frame body 800 is configured to include the upper frame 830, the lower frame 810, and the middle frame 820, the vulnerable portion of the body 100 may be reinforced in the structure of connecting the upper body 130, the lower body 110, and the middle body 120 to each other.

In the shoe care device 3 according to an embodiment of the present invention, the upper frame 830, the lower frame 810, and the middle frame 820 may be formed by bending one member which is formed to extend in a longitudinal direction.

In the shoe care device 3 according to the embodiment, since the frame body 800 including the upper frame 830, the lower frame 810, and the middle frame 820 is formed by bending one member which is formed to extend in the longitudinal direction, the frame body 800 may be easily manufactured, and a cutting surface of the frame body 800 corresponding to a reinforcing member may be minimized.

In the shoe care device 3 according to the embodiment of the present invention, the frame body 800 may be placed inside the body 100. Since the frame body 800 is placed not to be exposed to the outside, the aesthetics may be visually provided by minimizing the exposure of a member not directly related to the function of the shoe care device 3.

In the shoe care device 3 according to the embodiment of the present invention, a plurality of frame bodies 800 may be placed in the left and right direction of the body 100.

The frame body 800 may include a first frame body 800A and a second frame body 800B. The first frame body 800A may be placed at the left side of the body 100. The second frame body 800B may be placed at the right side of the body 100.

It may be preferable to place the frame body 800 on an entire surface of the body 100 in order to reinforce the vulnerable portion of the body 100, but such a structure is uneconomical and there is a risk of increasing the load of the shoe care device 3.

Therefore, placing the first frame body 800A and the second frame body 800B at a predetermined interval within a range to securing the structural stability may be most effective by considering the structural rigidity and the economics of the product.

In this case, in order to prevent deformation such as structural distortions according to the rigidity imbalance of the shoe care device 3, it may be preferable that the first frame body 800A and the second frame body 800B are placed symmetric in the left and right direction of the body 100.

As such, in the shoe care device 3 according to the embodiment, since the plurality of frame bodies 800 are placed in the left and right direction of the body 100 to reinforce the body 100, the body 100 may be structurally reinforced more uniformly and stably.

However, even though the frame body 800 reinforces the vulnerable part of the body 100 by the structure of connecting the upper body 130, the lower body 110, and the middle body 120 to each other, the drooping amount of the front end of the upper body 130 is just reduced, and the drooping phenomenon of the upper body 130 may not be fundamentally interrupted in that the upper body 130 is a kind of cantilever structure which is formed to be projected from the middle body 120.

In particular, when a plurality of shoe care devices 3 is provided, any one shoe care device 3 may be placed on the upper surface of the upper body 130 of the other one shoe care device 3, and both the shoe care devices 3 may be stacked on each other. When the plurality of shoe care devices 3 are stacked on each other, the drooping phenomenon of the upper body 130 may be rapidly progressed by the loads of one or more shoe care devices 3 which are stacked at the upper portion.

The shoe care device 3 according to the embodiment of the present invention may include a front frame 700. The front frame 700 may connect the lower body 110 and the upper body 130 at the front of the body 100. The front frame 700 may be positioned at the front of the body 100 regardless of the location of the moving body 200.

The front frame 700 may support the upper body 130 based on the lower body 110 at the front of the body 100. Therefore, a vertical interval between the lower body 110 and the upper body 130 may be maintained at the front of the body 100 by the front frame 700. Therefore, the drooping phenomenon of the upper body 130 may be completely interrupted by the front frame 700.

The front frame 700 may include a first front frame 710 and a second front frame 720.

The first front frame 71 may connect the lower body 110 and the upper body 130 at the front of the left side of the body 100. The second front frame 720 may connect the lower body 110 and the upper body 130 at the front of the right side of the body 100. Therefore, each corner portion of the upper body 130 may have the same height based on the lower body 110. Therefore, the body 100 continuously maintains the 'C' shape on the side view, and as a result, the aesthetics reduction of the shoe care device 3 by the drooping phenomenon of the upper body 130 may be prevented. Further, the increase in opening force of the moving body 200 by the drooping of the upper body 130 is interrupted, so the moving body 200 may continuously maintain the same opening force between the first location (see FIG. 30*a*) and the second location (see FIG. 31*a*).

Figure 34A:
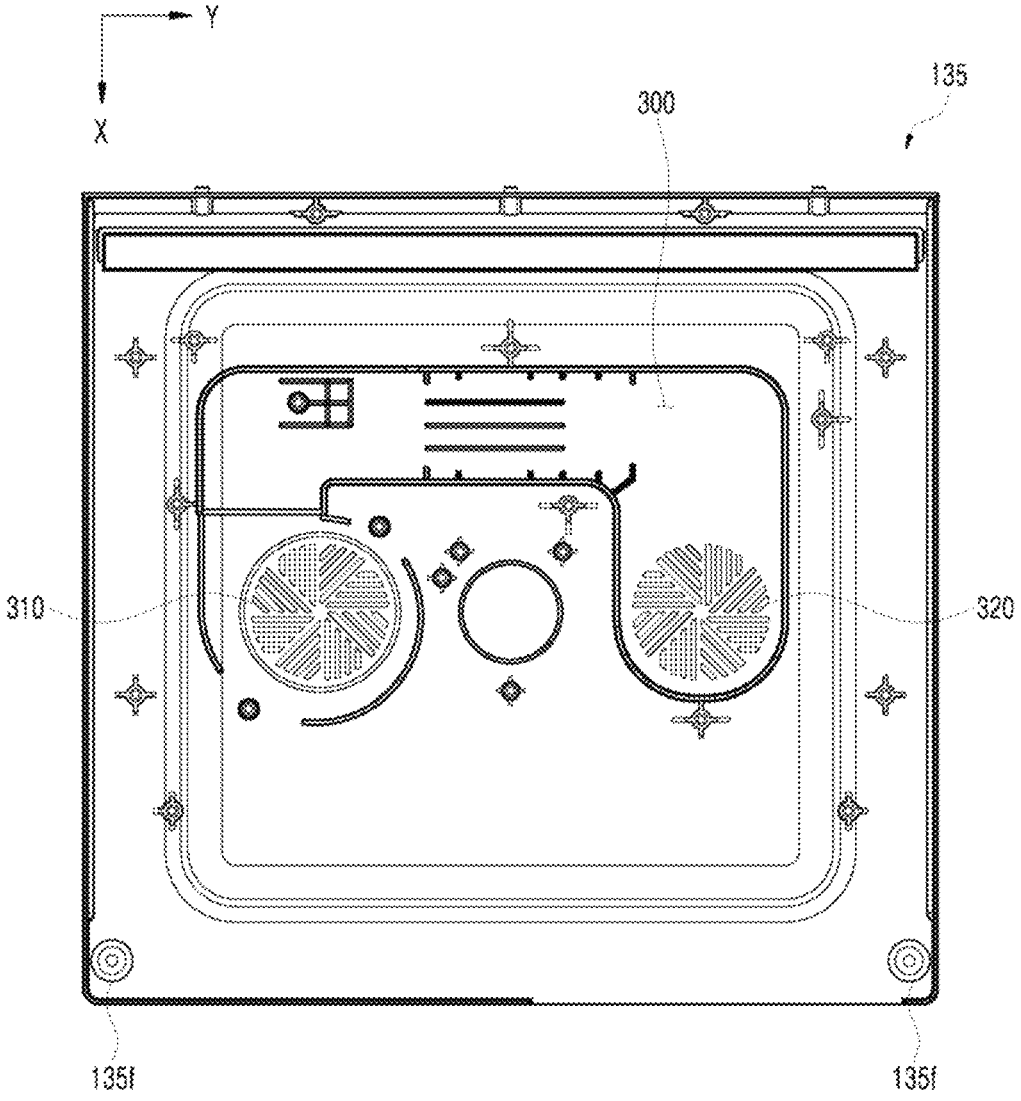
FIG. 34*a* is a diagram illustrating the first internal cabinet of the shoe care device viewed from the top according to the embodiment of the present invention.
Figure 34B:
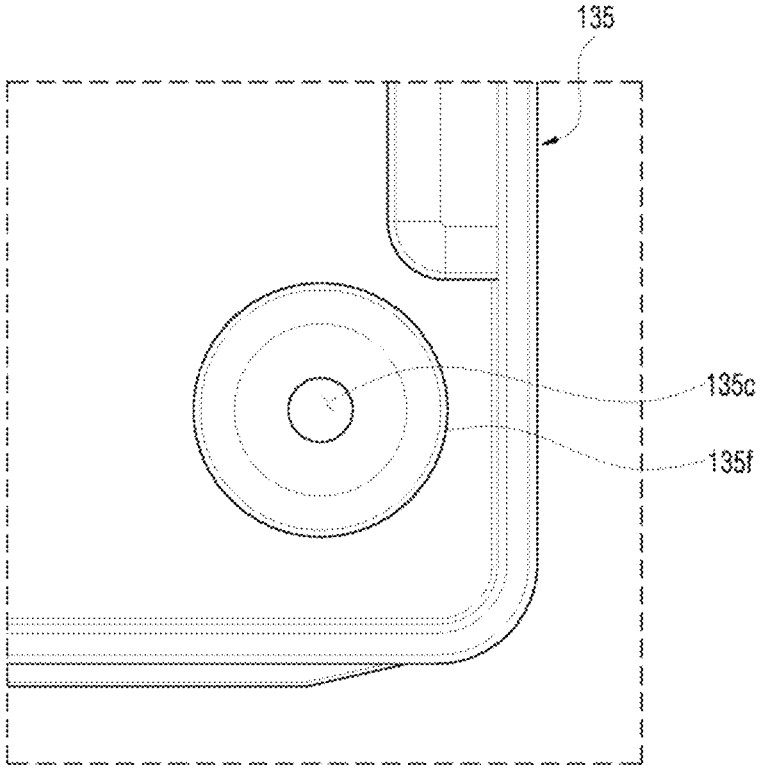
FIG. 34*b* is a partial enlarged diagram of the first internal cabinet of FIG. 34*a*.

FIG. 34*a* is a diagram illustrating the first internal cabinet 135 of the shoe care device 3 viewed from the top according to the embodiment of the present invention. FIG. 34*b* is a partial enlarged diagram of the first internal cabinet 135 of FIG. 34*a*.

A pair of first frame insertion portions 135*f* may be formed at the front of the first internal cabinet 135.

Any one (hereinafter, referred to as '1Ath frame insertion portion') of a pair of first frame insertion portions 135*f* may be formed at the front of the left side of the first internal cabinet 135. The 1Ath frame insertion portion 135*b* may be projected upward from the bottom of the first internal cabinet 135. The 1Ath frame insertion portion 135*b* may form a cylindrical space opened downward. An upper end portion of the first front frame 710 may be inserted into the 1Ath frame insertion portion 135*b*.

A female screw hole may be formed at the upper end portion of the first front frame 710. A through hole 135*c* into which a screw portion of the bolt is insertable may be formed in the 1Ath frame insertion portion 135*b*. The bolt may be screw-coupled to the female screw hole through the through hole 135*c*. As a result, the upper end portion of the first front frame 710 may be fastened to the front of the upper body 130 by the bolt.

The other one (hereinafter, referred to as '1Bth frame insertion portion') of a pair of first frame insertion portions 135*f* may be formed at the front of the right side of the first internal cabinet 135. The 1Bth frame insertion portion 135*b* may be projected upward from the bottom of the first internal cabinet 135. The 1Bth frame insertion portion 135*b* may form a cylindrical space opened downward. An upper end portion of the second front frame 720 may be inserted into the 1Bth frame insertion portion 135*b*.

The female screw hole may be formed at the upper end portion of the second front frame 720. The through hole 135*c* into which the screw portion of the bolt is insertable may be formed in the 1Bth frame insertion portion 135*b*. The bolt may be screw-coupled to the female screw hole through the through hole 135*c*. As a result, the upper end portion of the second front frame 720 may be fastened to the front of the upper body 130 by the bolt.

Figure 35A:
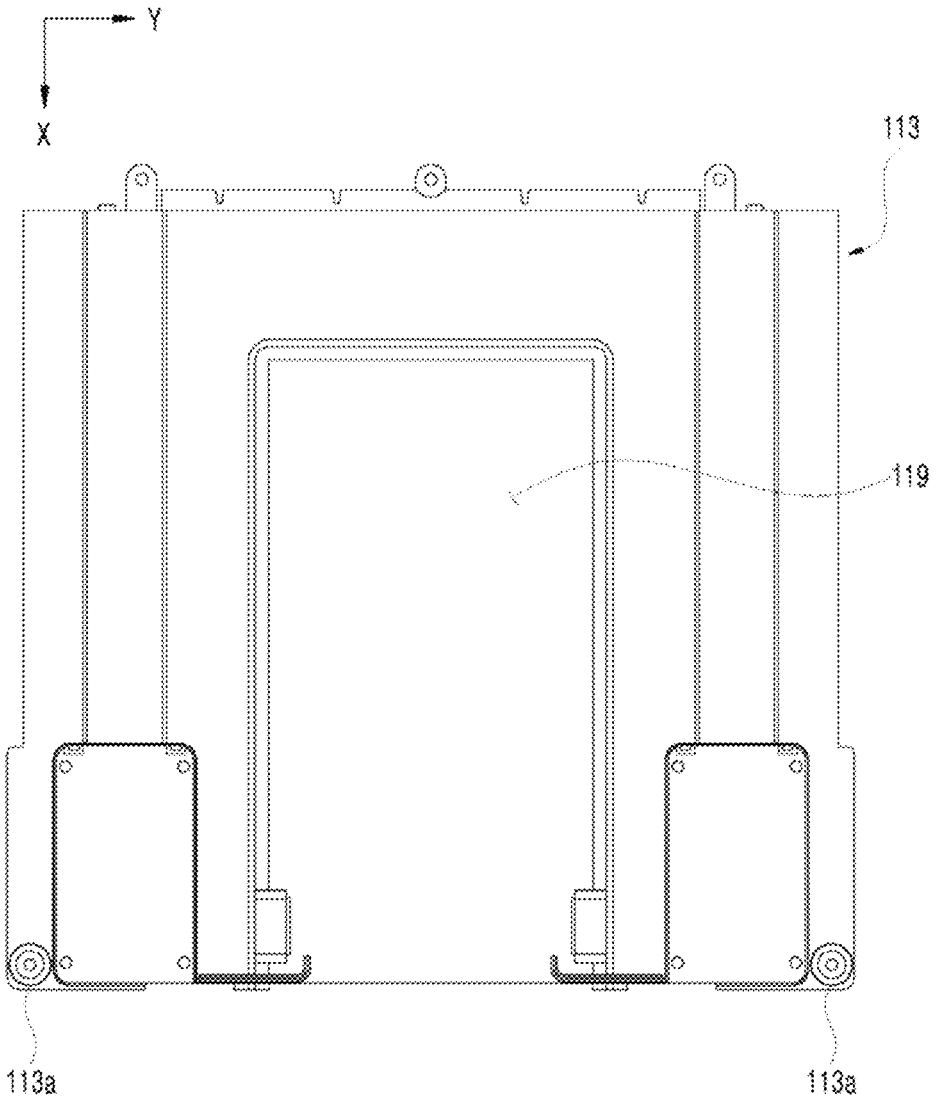
FIG. 35*a* is a diagram illustrating the third internal cabinet of the shoe care device viewed from the top according to the embodiment of the present invention.
Figure 35B:
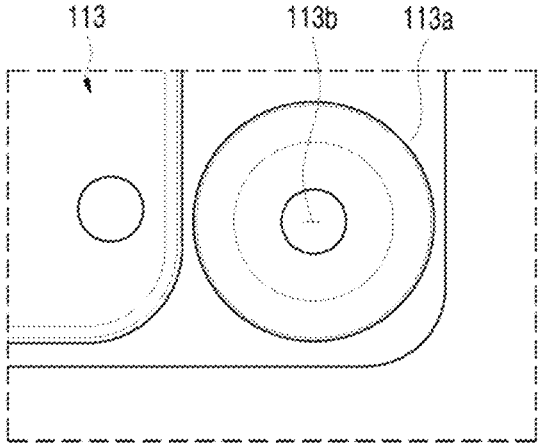
FIG. 35*b* is a partial enlarged diagram of the third internal cabinet of FIG. 35*a*.

FIG. 35*a* is a diagram illustrating the third internal cabinet 113 of the shoe care device 3 viewed from the top according to the embodiment of the present invention. FIG. 35*b* is a partial enlarged diagram of the third internal cabinet 113 of FIG. 35*a*.

Figure 36A:
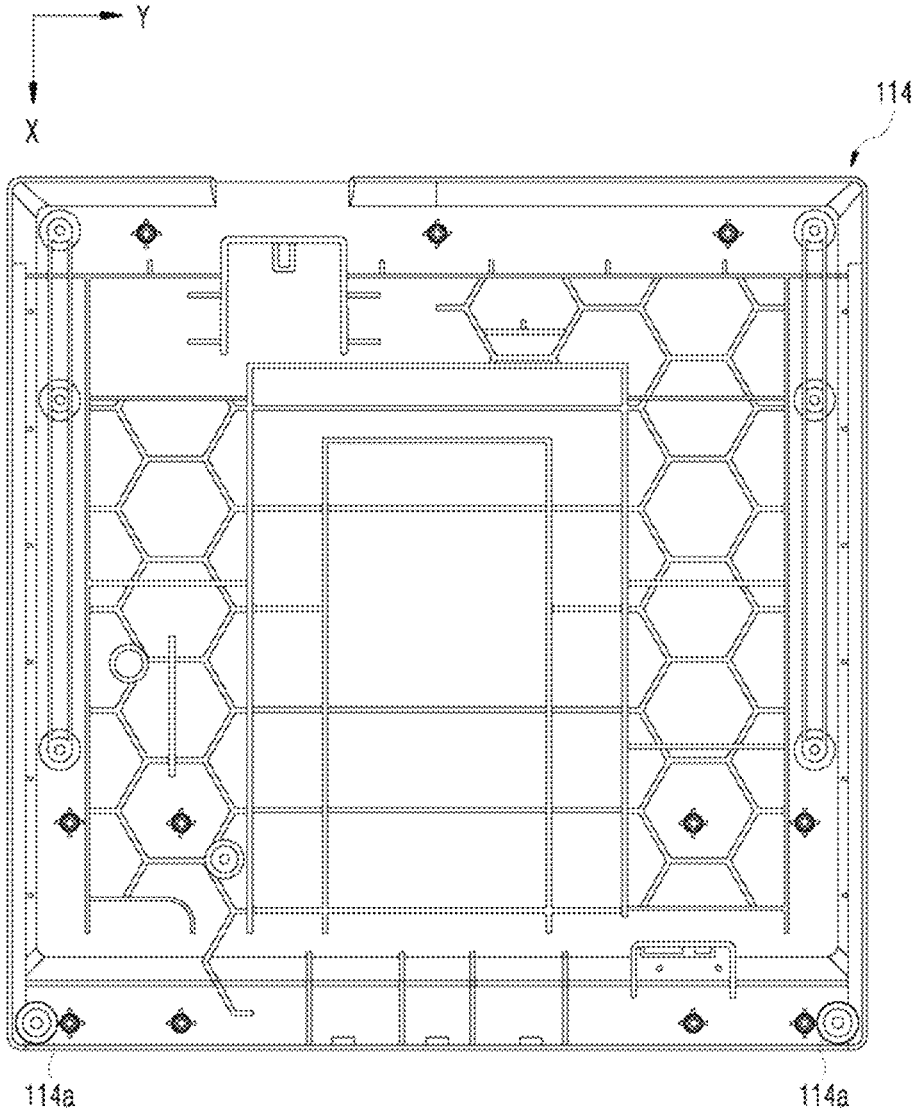
FIG. 36*a* is a diagram illustrating the third external cabinet of the shoe care device viewed from the top according to the embodiment of the present invention.
Figure 36B:
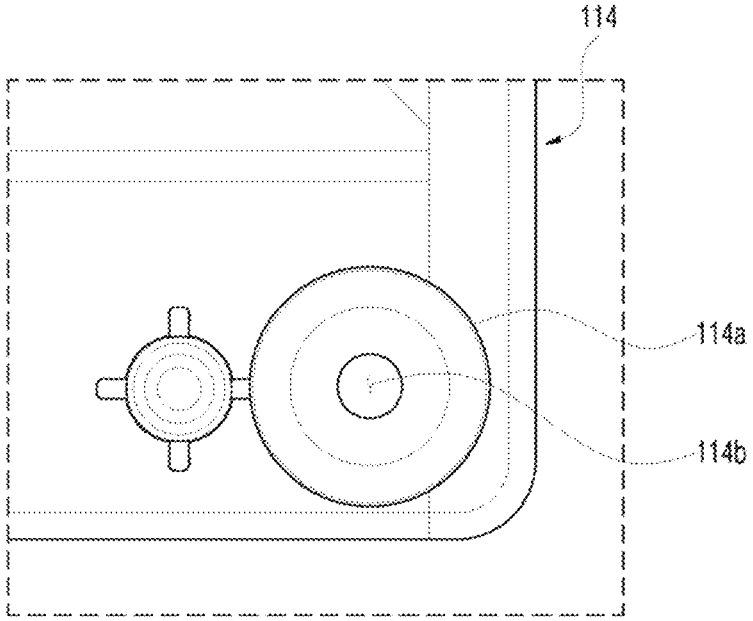
FIG. 36*b* is a partial enlarged diagram of the third internal cabinet of FIG. 36*a*.
Figure 36C:
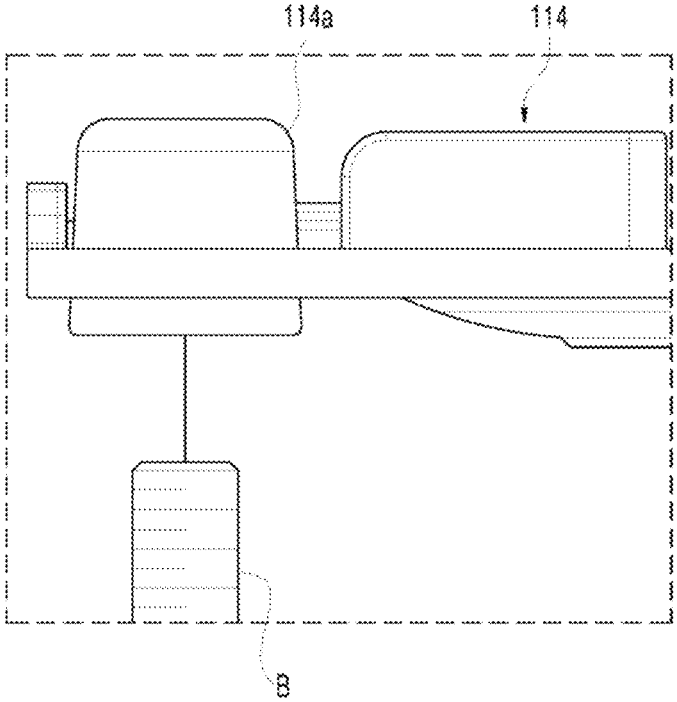
FIG. 36*c* is a side view of FIG. 36*b*.

FIG. 36*a* is a diagram illustrating the third external cabinet 114 of the shoe care device 3 viewed from the top according to the embodiment of the present invention. FIG. 36*b* is a partial enlarged diagram of the third internal cabinet 114 of FIG. 36*a*. FIG. 36*c* is a side view of FIG. 36*b*.

A pair of second frame insertion portions 135*a* may be formed at the front of the third internal cabinet 113.

Any one (hereinafter, referred to as '2Ath frame insertion portion') of a pair of second frame insertion portions 113*a* may be formed at the front of the left side of the third internal cabinet 113. The 2Ath frame insertion portion 113*a* may be projected downward from the bottom of the third internal cabinet 113. The 2Ath frame insertion portion 113*a* may form a cylindrical space opened upward. A lower end portion of the first front frame 710 may be inserted into the 2Ath frame insertion portion 113*a*.

A pair of third frame insertion portions 114*a* may be formed at the front of the third external cabinet 114.

Any one (hereinafter, referred to as '3Ath frame insertion portion 114*a*') of a pair of third frame insertion portions 114*a* may be formed at the front of the left side of the third external cabinet 114. The 3Ath frame insertion portion 114*a* may form a cylindrical space opened downward.

The female screw hole may be formed at the lower end portion of the first front frame 710. Through holes 113*b* and 112*b* into which the screw portion of the bolt B is insertable may be formed in the 2Ath frame insertion portion 113*a* and the 3A frame insertion portion 114*a*. The bolt B may be screw-coupled to the female screw hole through the through holes 113*b* and 112*b*. In this case, a head of the bolt B may be inserted into the inside of the 3Ath frame insertion portion 114*a*. As a result, the lower end portion of the first front frame 710 may be fastened to the front of the lower body 110 by the bolt.

Any one (hereinafter, referred to as '2Bth frame insertion portion') of a pair of second frame insertion portions 113*a* may be formed at the front of the right side of the third internal cabinet 113. The 2Bth frame insertion portion 113*a* may be projected downward from the bottom of the third internal cabinet 113. The 2Bth frame insertion portion 113*a* may form a cylindrical space opened upward. The lower end portion of the second front frame 720 may be inserted into the 2Bth frame insertion portion 113*a*.

The other one (hereinafter, referred to as '3Bth frame insertion portion 114*a*') of a pair of third frame insertion portions 114*a* may be formed at the front of the right side of the third external cabinet 114. The 3Bth frame insertion portion 114*a* may form a cylindrical space opened downward.

The female screw hole may be formed at the lower end portion of the second front frame 720. The through holes 113*b* and 112*b* into which the screw portion of the bolt B is insertable may be formed in the 2Ath frame insertion portion 113*a* and the 3B frame insertion portion 114*a*. The bolt B may be screw-coupled to the female screw hole through the through holes 113*b* and 112*b*. In this case, the head of the bolt B may be inserted into the inside of the 3Bth frame insertion portion 114*a*. As a result, the lower end portion of the second front frame 720 may be fastened to the front of the lower body 110 by the bolt.

Figure 37A:
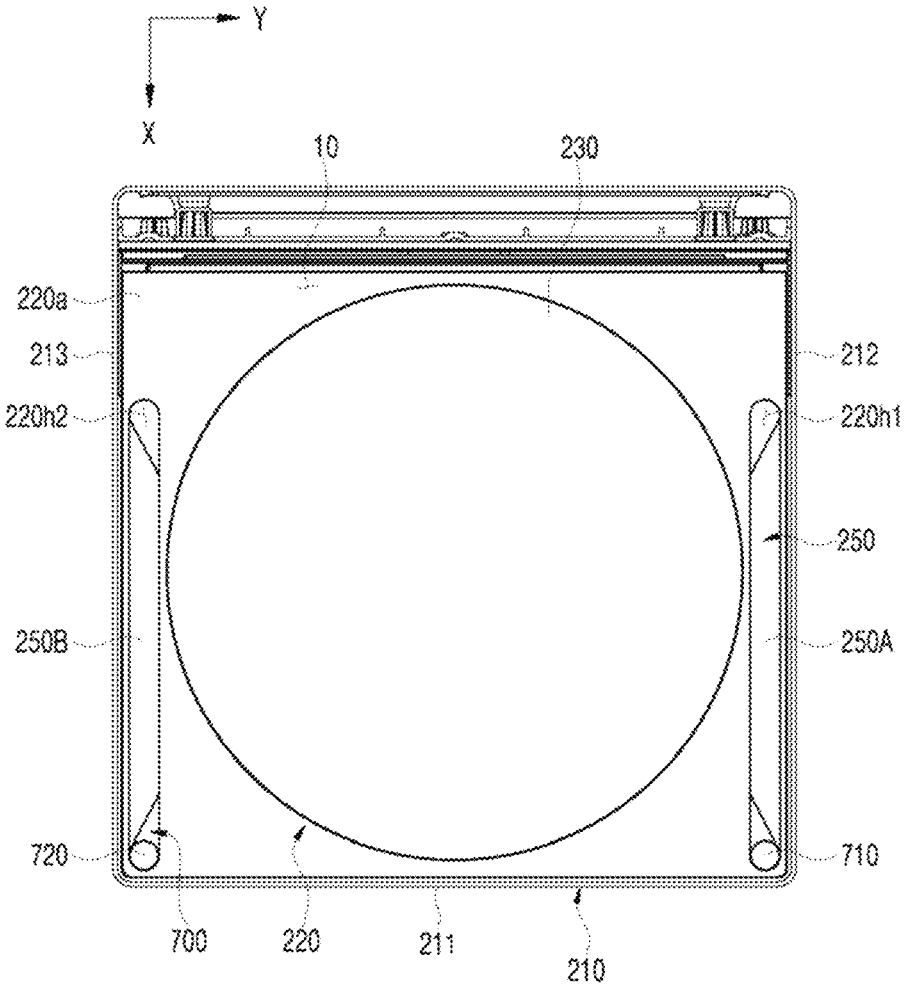
FIG. 37*a* is a plan cross-sectional view illustrating a closed state of the shoe care device according to the embodiment of the present invention.
Figure 37B:
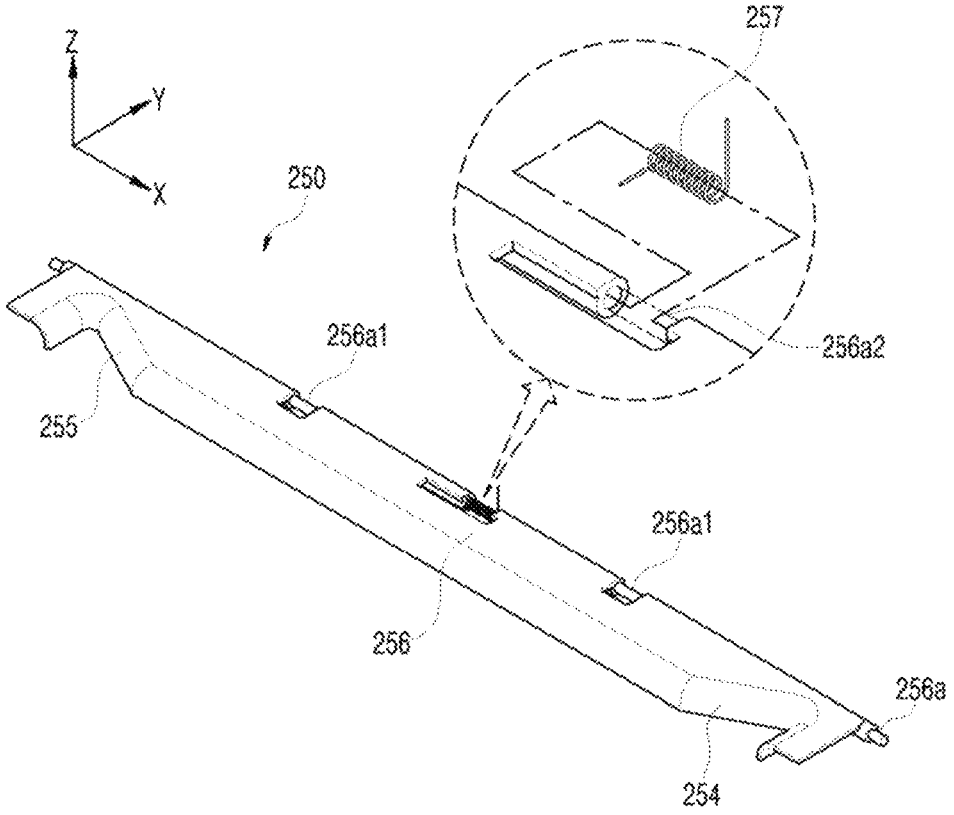
FIG. 37*b* is a perspective view illustrating a flip cover of the shoe care device viewed from the top according to the embodiment of the present invention.

FIG. 37*a* is a plan cross-sectional view illustrating a closed state of the shoe care device 3 according to the embodiment of the present invention. FIG. 37*b* is a perspective view illustrating a flip cover 250 of the shoe care device 3 viewed from the top according to the embodiment of the present invention.

Figure 37C:
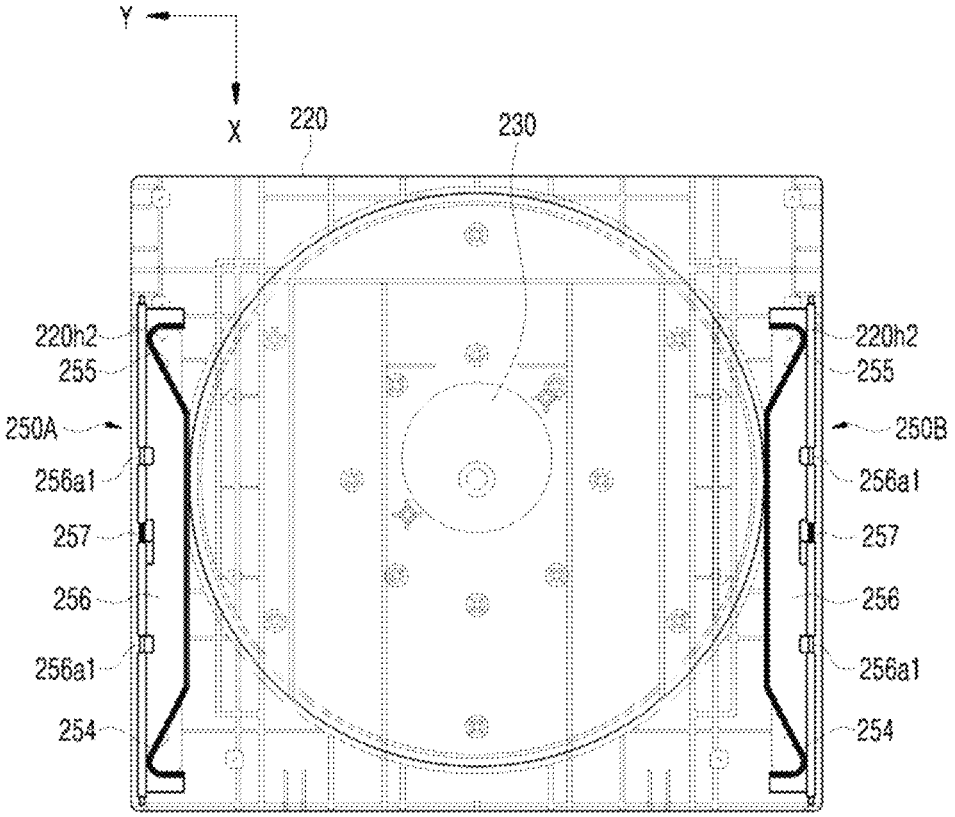
FIG. 37*c* is a bottom view illustrating the moving body of the shoe care device according to the embodiment of the present invention.
Figure 37D:
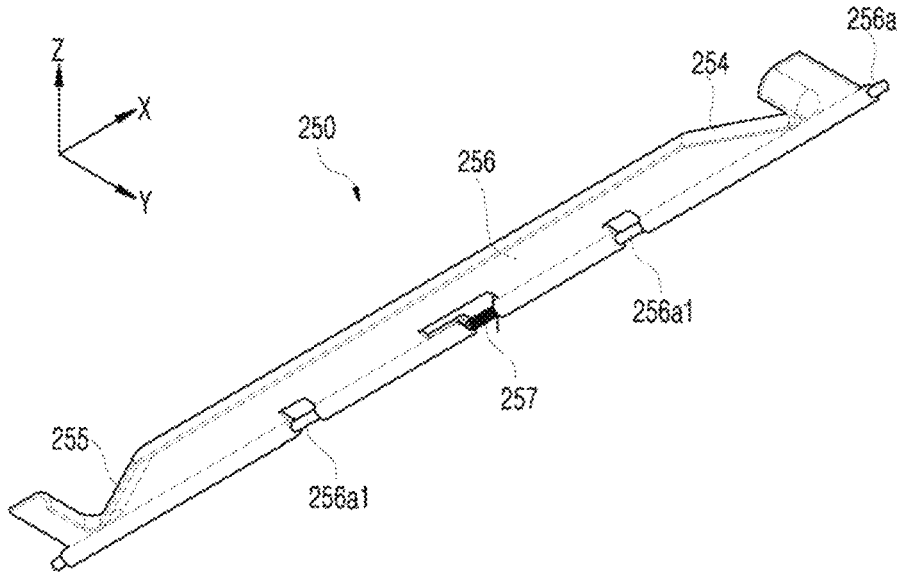
FIG. 37*d* is a perspective view illustrating a flip cover of the shoe care device viewed from the bottom according to the embodiment of the present invention.

FIG. 37*c* is a bottom view illustrating the moving body 200 of the shoe care device 3 according to the embodiment of the present invention. FIG. 37*d* is a perspective view illustrating a flip cover 250 of the shoe care device 3 viewed from the bottom according to the embodiment of the present invention.

In the shoe care device 3 according to the embodiment of the present invention, the moving body 200 may include a flip cover 250 and an elastic member 257.

The flip cover 250 may be rotatably coupled to the bottom of the base 220 below the flow portion hole 220*h*. The flow portion hole 220*h* may include first flow portion hole 220*h*1 and a second flow portion hole 220*h*2. Therefore, the flip cover 250 may include a flip cover 250A (hereinafter, referred to as 'first flip cover') rotatably coupled to the bottom of the base 220 below the first flow portion hole 220*h*1 and a flip cover 250B (hereinafter, referred to as 'second flip cover') rotatably coupled to the bottom of the base 220 below the second flow portion hole 220*h*2.

The flip cover 250 may have a substantially flat plate form. The flip cover 250 may open or cover the flow portion hole 220*h* in the form of a door hinge.

The flip cover 250 may include a first inclination portion 254, a second inclination portion 255, and a cover portion 256.

The first inclination portion 254 is a part that is pushed by the front frame 700 to rotate to open the flow portion hole 220*h* when the moving body 200 moves forward at the first location (see FIG. 30*a*).

Figure 38A:
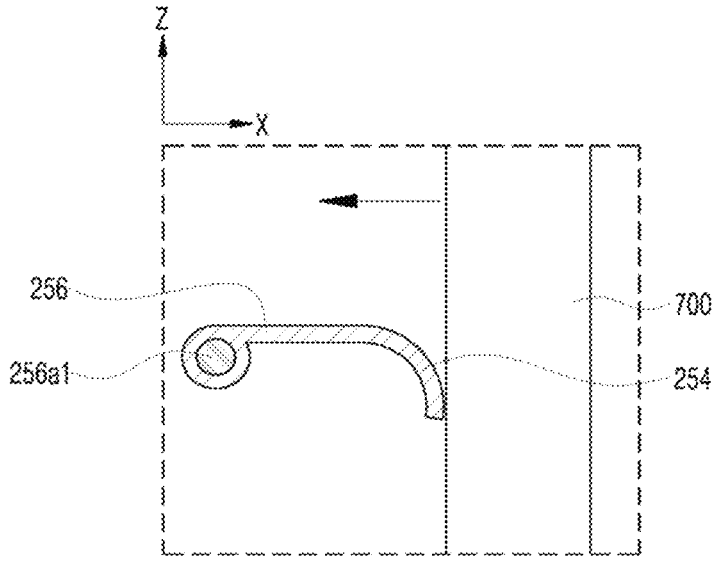
FIG. 38*a* is a diagram illustrating the front frame and the flip cover at the first location of the moving body.

FIG. 38*a* is a diagram illustrating the front frame 700 and the flip cover 250 at the first location of the moving body 200.

At the first location of the moving body 200, the first inclination portion 254 may be positioned immediately behind the front frame 700 (see FIG. 37*a*). At the first location of the moving body 200, the first inclination portion 254 may be provided in contact with the front frame 700 immediately behind the front frame 700 (see FIG. 38*a*). Alternatively, at the first location of the moving body 200, the first inclination portion 254 may be spaced apart from the front frame 700 by a comparative small gap immediately behind the front frame 700.

The second inclination portion 255 is a part that is pushed by the front frame 700 to rotate to open the flow portion hole 220*h* when the moving body 200 moves backward at the second location (see FIG. 31*a*).

At the second location of the moving body 200, the second inclination portion 255 may be positioned immediately before the front frame 700. At the second location of the moving body 200, the second inclination portion 255 may be provided in contact with the front frame 700 immediately before the front frame 700. Alternatively, at the second location of the moving body 200, the second inclination portion 255 may be spaced apart from the front frame 700 by a comparative small gap immediately behind the front frame 700.

The cover portion 256 is a part that covers the flow portion hole 220*h* at the first location and the second location. The cover portion 256 may form a flat plate form connecting the first inclination portion 254 and the second inclination portion 255.

A cover pin portion 256*a*1 and a connection axis portion 256*a*2 may be formed at a left end portion and a right end portion of the cover portion 256. One long pin 256*a* may be coupled to the left end portion or the right end portion of the cover portion 256, and the cover pin portion 256*a*1 and the connection axis portion 256*a*2 may be formed as a part of the pin 256*a*.

In the case of the first flip cover 250A, the cover pin portion 256*a*1 and the connection axis portion 256*a*2 may be formed at the left end portion of the cover portion 256. In the case of the second flip cover 250B, the cover pin portion 256*a*1 and the connection axis portion 256*a*2 may be formed at the right end portion of the cover portion 256.

The first flip cover 250A and the second flip cover 250B may be manufactured to have the same shape. That is, when the first flip cover 250A is rotated at 180 degrees around the Z axis, the first flip cover 250A may be used as the second flip cover 250B. Similarly to this, when the second flip cover 250B is rotated at 180 degrees around the Z axis, the second flip cover 250B may be used as the first flip cover 250A.

That is, when the first flip cover 250A is rotated at 180 degrees around the Z axis, the first inclination portion 254 of the first flip cover 250A may be used as the second inclination portion 255 of the second flip cover 250B. Similarly to this, when the second flip cover 250B is rotated at 180 degrees around the Z axis, the first inclination portion 254 of the second flip cover 250B may be used as the second inclination portion 255 of the first flip cover 250A.

The flip cover 250 may be rotatably coupled to the bottom of the base 220 around the cover pin portion 256*a*1. The cover pin portion 256*a*1 may be provided as a part of the pin 256*a* which is in line with the front and rear direction. Alternatively, the cover pin portion 256*a*1 may have a pin form which is in line with the front and rear direction. A part into which the cover pint portion 256*a*1 is rotatably inserted may be formed in the base 220. A pair of cover pin portions 256*a*1 may be provided. Extension lines of the cover pin portions 256*a*1 may match each other.

The connection axis portion 256*a*2 may be provided as a part of the pin 256*a* which is in line with the front and rear direction. Alternatively, the cover pin portion 256*a*1 may have a pin form which is in line with the front and rear direction. The extension lines of the cover pin portions 256*a*1 and the connection axis portion 256*a*2 may match each other.

The elastic member 257 is a component that rotates the flip cover 250 so that the flip cover 250 covers the flow portion hole 220*h*. The elastic member 257 may be provided as a torsion spring. The elastic member 257 may be coupled to the connection axis portion 256*a*2. That is, the connection axis portion 256*a*2 may be inserted into the inside of a cylindrical portion of the torsion spring.

Any one leg (or arm) of the torsion spring may be in contact with the base 220. The other leg of the torsion spring may be in contact with the bottom of the cover pin portion 256*a*1. The torsion spring may rotate the flip cover 250 in a direction in which the flip cover 250 covers the flow portion hole 220*h* by elastic energy.

When the moving body 200 is positioned at the first location (see FIG. 37*a*) and the second location, the front frame 700 and the flip cover 250 do not physically interfere with each other. Therefore, when the moving body 200 is positioned at the first location (see FIG. 37*a*) and the second location, the flip cover 250 may cover the flow portion hole 220*h* on the bottom of the base 220.

Figure 38B:
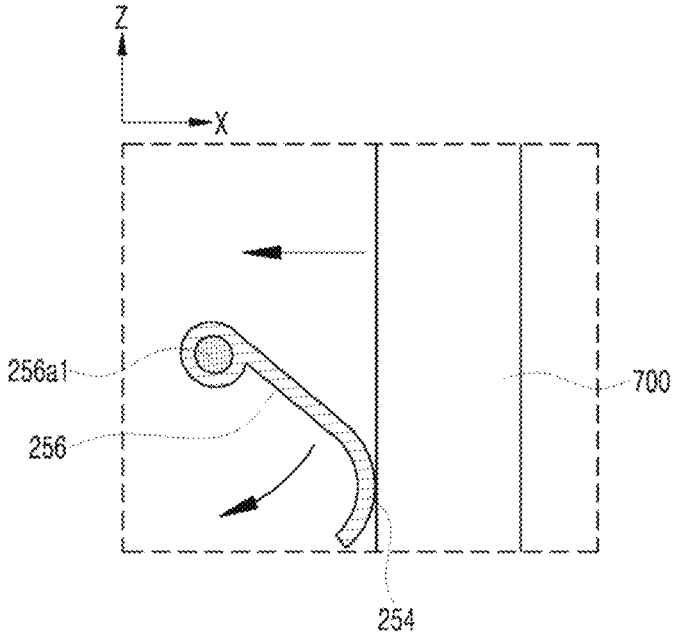
FIG. 38*b* is a diagram illustrating the first inclination portion which is pushed by the front frame and rotates to open the flow portion hole.

FIG. 38*b* is a diagram illustrating the first inclination portion 254 which is pushed by the front frame 700 and rotates to open the flow portion hole 220*h*.

The first inclination portion 254 is in contact with the front frame 700 below the rotational axis of the flip cover 250, i.e., the cover pin portion 256*a*1 (see FIG. 38*a*). In addition, the rotational axis of the flip cover 250 may have the same height as the cover portion 256. Therefore, when the moving body 200 moves forward at the first location (see FIG. 37*a*), the front frame 700 pushes the first inclination portion 254 below the rotational axis of the flip cover 250, and a moment to rotate to open the flow portion hole 220*h* acts on the flip cover 250 (see FIG. 38*b*).

A contact surface of the first inclination portion 254 which contacts the front frame 700 may be distant from the rotational axis of the flip cover 250 as going backward. Therefore, when the moving body 200 moves forward at the first location (see FIG. 37*a*), a movement distance of the moving body 200 increases, so a rotational angle of the flip cover 250 may increase. When the moving body 200 moves forward at the first location (see FIG. 37*a*), the rotational angle of the flip cover 250 may become the maximum (hereinafter, referred to as 'maximum rotational angle') at a rear end of the first inclination portion 254.

The contact surface of the first inclination portion 254 which contacts the front frame 700 is connected to the cover portion 256 at the rear end of the first inclination portion 254. A contact surface of the cover portion 256 which is in contact with the front frame 700 may be in line with the front and rear direction. That is, the contact surface of the cover portion 256 which is in contact with the front frame 700 may form the same distance from the rotational axis of the flip cover 250 in the front and rear direction. Therefore, in the process in which the moving body 200 moves from the first location (see FIG. 37*a*) to the second location, the rotational angle of the flip cover 250 may maintain the maximum rotational angle while the cover portion 256 is in contact with the front frame 700.

The second inclination portion 255 may form a symmetric structure to the first inclination portion 254 based on a YZ plane. Therefore, in the process in which the moving body 200 moves from the first location (see FIG. 37*a*) to the second location, when the second inclination portion 255 is in contact with the front frame 700, the rotational angle of the flip cover 250 may decrease as the movement distance of the moving body 200 increases.

Finally, when the moving body 200 is positioned at the second location, the front frame 700 and the flip cover 250 do not physically interfere with each other. Therefore, when the moving body 200 is positioned at the second location, the flip cover 250 may cover the flow portion hole 220*h* on the bottom of the base 220.

Meanwhile, when the moving body 200 moves backward at the second location (see FIG. 31*a*), the second inclination portion 255 is in contact with the front frame 700 below the rotational axis of the flip cover 250. In addition, the rotational axis of the flip cover 250 may have the same height as the cover portion 256. Therefore, when the moving body 200 moves backward at the second location, the front frame 700 pushes the second inclination portion 255 below the rotational axis of the flip cover 250, and a moment to rotate to open the flow portion hole 220*h* acts on the flip cover 250.

A contact surface of the second inclination portion 255 which contacts the front frame 700 may be distant from the rotational axis of the flip cover 250 as going forward. Therefore, when the moving body 200 moves backward at the second location, a movement distance of the moving body 200 increases, so a rotational angle of the flip cover 250 may increase. When the moving body 200 moves backward at the second location, the rotational angle of the flip cover 250 may become the maximum (hereinafter, referred to as 'maximum rotational angle') at the front end of the second inclination portion 255.

The contact surface of the second inclination portion 255 which contacts the front frame 700 is connected to the cover portion 255 at the front end of the second inclination portion 255. A contact surface of the cover portion 256 which is in contact with the front frame 700 may be in line with the front and rear direction. That is, the contact surface of the cover portion 256 which is in contact with the front frame 700 may form the same distance from the rotational axis of the flip cover 250 in the front and rear direction. Therefore, in the process in which the moving body 200 moves from the second location to the first location (see FIG. 37*a*), the rotational angle of the flip cover 250 may maintain the maximum rotational angle while the cover portion 256 is in contact with the front frame 700.

As described above, the second inclination portion 255 may form the symmetric structure to the first inclination portion 254 based on the YZ plane. Therefore, in the process in which the moving body 200 moves from the second location to the first location (see FIG. 37*a*), when the first inclination portion 254 is in contact with the front frame 700, the rotational angle of the flip cover 250 may decrease as the movement distance of the moving body 200 increases.

Finally, when the moving body 200 is positioned at the first location (see FIG. 37*a*), the front frame 700 and the flip cover 250 do not physically interfere with each other. Therefore, when the moving body 200 is positioned at the first location (see FIG. 37*a*), the flip cover 250 may cover the flow portion hole 220*h* on the bottom of the base 220.

When the flow portion hole 220*h* is formed in the base 220, various foreign substances such as outdoor air, dust, moisture, etc., may be introduced through the flow portion hole 220*h*, and this may serve as an inference factor in constantly maintaining an environment of the accommodation space 10. Further, when the flow portion hole 220*h* is formed in the base 220, the top of the lower body 110 may be exposed to the outside through the flow portion hole 220*h*. The top of the lower body 110 may have multiple curves by placement of multiple components such as the power supply placed inside the lower body 110. Therefore, the exposure of the lower body 110 through the flow portion hole 220*h* may serve as a primary factor of disturbing an interior effect of the shoe care device 3.

As described above, in the shoe care device 3 according to the embodiment of the present invention, the flip cover 250 may be pushed by the front frame 700 and rotated to open the flow portion hole 220*h* between the first location and the second location. Therefore, the lower side of the flow portion hole 220*h* is just exposed through the flow portion hole 220*h* only in the process of opening or closing the shoe care device 3, and the flow portion hole 220*h* maintains the closed state by the flip cover 250 at the first location and the second location of the moving body 200. Therefore, the environment of the accommodation space 10 may be constantly maintained in the state of accommodating the shoes. Further, the aesthetics reduction of the shoe care device 3 by the exposure of the top of the lower body 110 may be prevented.

Further, in the shoe care device 3 according to the embodiment of the present invention, the contact surface of the first inclination portion 254 which contacts the front frame 700 may be distant from the rotational axis of the flip cover 250 as going backward. In addition, the contact surface of the second inclination portion 255 which contacts the front frame 700 may be distant from the rotational axis of the flip cover 250 as going forward. Therefore, in the process in which the moving body 200 moves between the first location and the second location, the flip cover 250 gradually rotates to open and close the flow portion hole 220*h*. Therefore, the flip cover 250 is easily rotated to minimize the increase of the opening force of the shoe care device 3 by the rotation of the flip cover 250.

Further, in the shoe care device 3 according to the embodiment of the present invention, when the first flip cover 250A is rotated at 180 degrees around the Z axis, the first flip cover 250A may be used as the second flip cover 250B. Similarly to this, when the second flip cover 250B is rotated at 180 degrees around the Z axis, the second flip cover 250B may be used as the first flip cover 250A. That is, the first flip cover 250A and the second flip cover 250B may be manufactured to have the same shape. Therefore, the flip cover 250 is easily manufactured and assembled to minimize the increase in production cost and the increase in production man-hours.

Figure 39A:
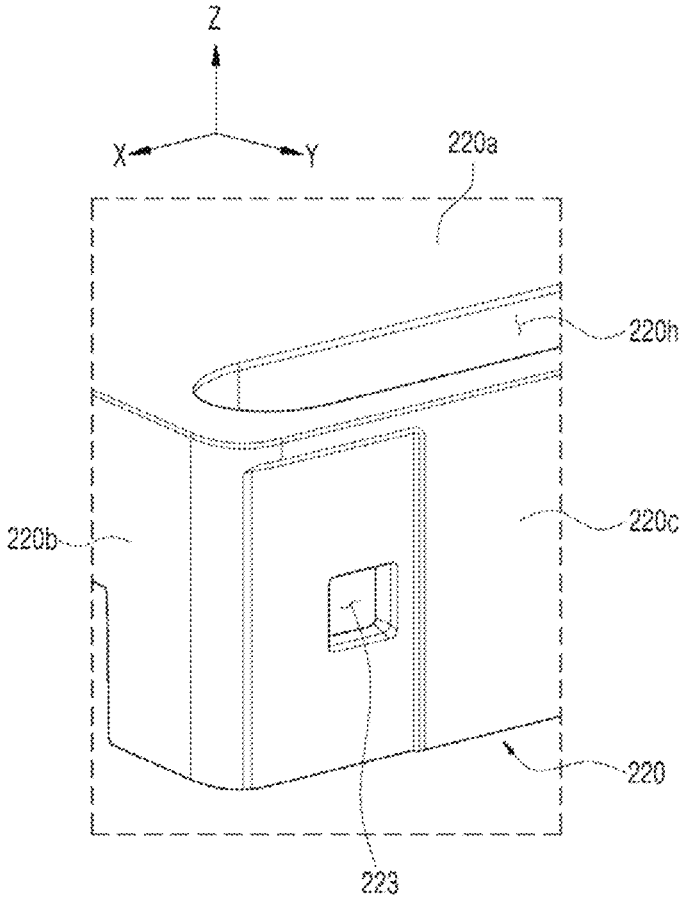
FIG. 39*a* is a partial enlarged diagram of the base of the shoe care device according to the embodiment of the present invention.
Figure 39B:
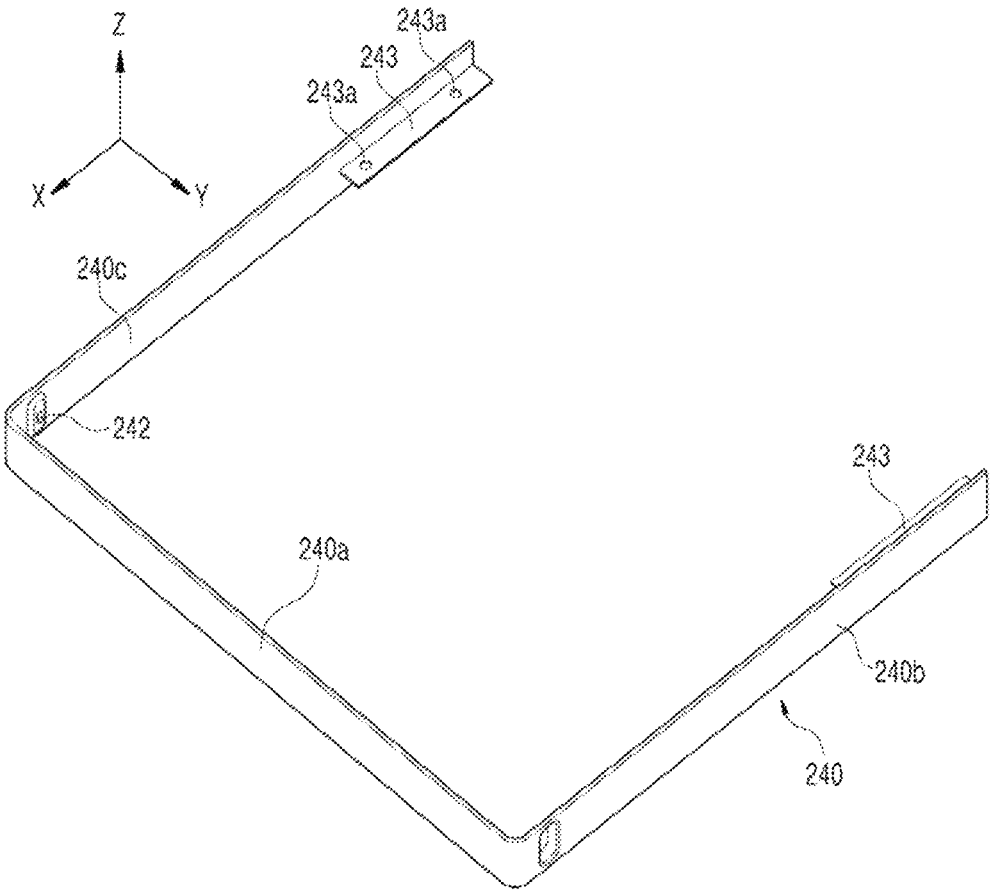
FIG. 39*b* is a perspective view illustrating the lower guard of the shoe care device according to the embodiment of the present invention.
Figure 39C:
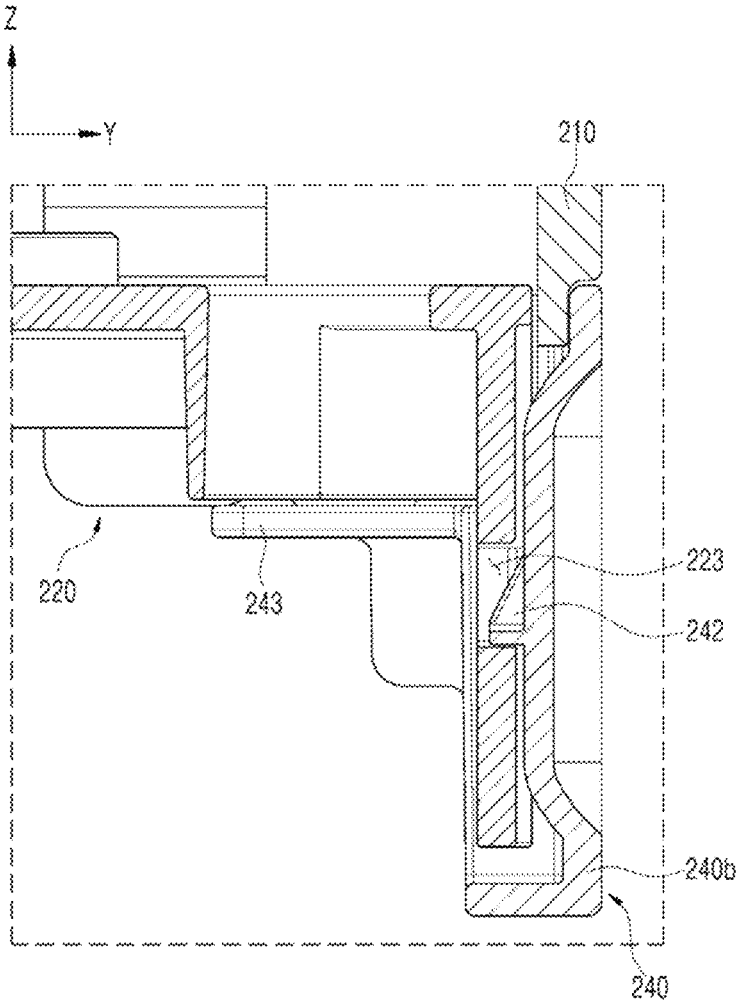
FIG. 39*c* is a partial cross-sectional view illustrating the moving body of the shoe care device according to the embodiment of the present invention.

FIG. 39*a* is a partial enlarged diagram of the base 220 of the shoe care device 3 according to the embodiment of the present invention. FIG. 39*b* is a perspective view illustrating the lower guard 240 of the shoe care device 3 according to the embodiment of the present invention. FIG. 39*c* is a partial cross-sectional view illustrating the moving body 200 of the shoe care device 3 according to the embodiment of the present invention.

The moving body 200 may be configured to include a lower guard 240. The lower guard 240 is fixedly coupled to an outer side of a border of the base 220. The lower guard 240 is fixedly coupled to a front surface 220*b*, a left surface 220*c*, and a right surface 220*d* of the base 220.

The lower guard 240 may be configured substantially in the C shape (or ⊂ shape, π shape, or ⊓ shape) on the plan view. On the plan view, the shape of the lower guard 240 may be configured to correspond to the shape of the transparent window 210.

The lower guard 240 may be positioned outside the lower body 110.

The lower guard 240 is configured to include a first lower guard 240*a*, a second lower guard 240*b*, and a third lower guard 240*c*. The lower guard 240 may be integrally configured.

The first lower guard 240*a* forms the front surface of the lower guard 240. The outer surface and the inner surface of the first lower guard 240*a* may be configured to be orthogonal to the first direction X. The second lower guard 240*b* forms the left surface of the lower guard 240. The outer surface and the inner surface of the second lower guard 240*b* may be configured to be orthogonal to the second direction Y. The third lower guard 240*c* forms the right surface of the lower guard 240. The outer surface and the inner surface of the third lower guard 240*c* may be configured to be orthogonal to the second direction Y.

The first lower guard 240*a* may be positioned at the front side of a front end of the lower body 110. The second lower guard 240*b* may be positioned at the left side of a left end of the lower body 110. The third lower guard 240*c* may be positioned at the right side of a right end of the lower body 110.

In the shoe care device 3 according to the embodiment of the present invention, the lower side of the transparent window 210 may be fixedly interposed between the base 220 and the lower guard 240.

The lower guard 240 may be configured to include a pair of hooks 242. The hook 242 protrudes inward on the inner surface of the lower guard 240. The hook 242 protrudes in an inner direction on the inner surface of each of the second lower guard 240*b* and the third lower guard 240*c*. A pair of hooks 242 may be provided at opposite locations to each other based on the reference plane RP.

A pair of through holes 223 may be formed in the base 220. The through holes 223 may be formed on the fronts of the left surface 220*c* and the right surface of the base 220. The hook 242 is configured to be inserted and locked into the through hole 223.

The lower guard 240 may be configured to include a pair of seating ribs 243. The seating rib 243 protrudes inward on the inner surface of the rear of the lower guard 240. The seating rib 243 protrudes in an inner direction on the inner surface of the rear of each of the second lower guard 240*b* and the third lower guard 240*c*. A pair of seating ribs 243 may be provided at opposite locations based on the reference plane RP.

The base 220 may be seated on a pair of seating ribs 243. The through hole 243*a* may be formed in the seating rib 243. The female screw hole may be formed in the base 220. The bolt may be screw-coupled to the female screw hole through the through hole 243*a*. As a result, the base 220 and the transparent window 210 may be more stably coupled.

As described above, in the shoe care device 3 according to the embodiment of the present invention, the base 220 forms a bottom part of the moving body 200. The front surface 220*b*, the left surface 220*c*, and the right surface of the base 220 are in close contact with the inner surface of the concealment portion 216 of the transparent window 210, the inner surface of the lower guard 240 is in close contact with the outer surface of the concealment portion 216, and the lower guard 240 is fixed to the base 220.

The lower side of the transparent window 210 is fixed by the base 220 and the lower guard 240 to form a rigid coupling structure of the moving body 200. Further, an area of a transparent part (transparent window 210) in the moving body 200 may be maximally secured.

As described above, the hook 242 of the lower guard 240 is configured to be inserted and hooked into the second through hole 223 of the base 220. In addition, a pair of hook 242 and through hole 223 may be provided at opposite locations to each other based on the reference plane RP.

As a result, while the coupling portion (concealment portion 216) of the transparent window 210 is not externally visually exposed, the transparent window 210, the base 220, and the lower guard 240 may be stably coupled.

Figure 40A:
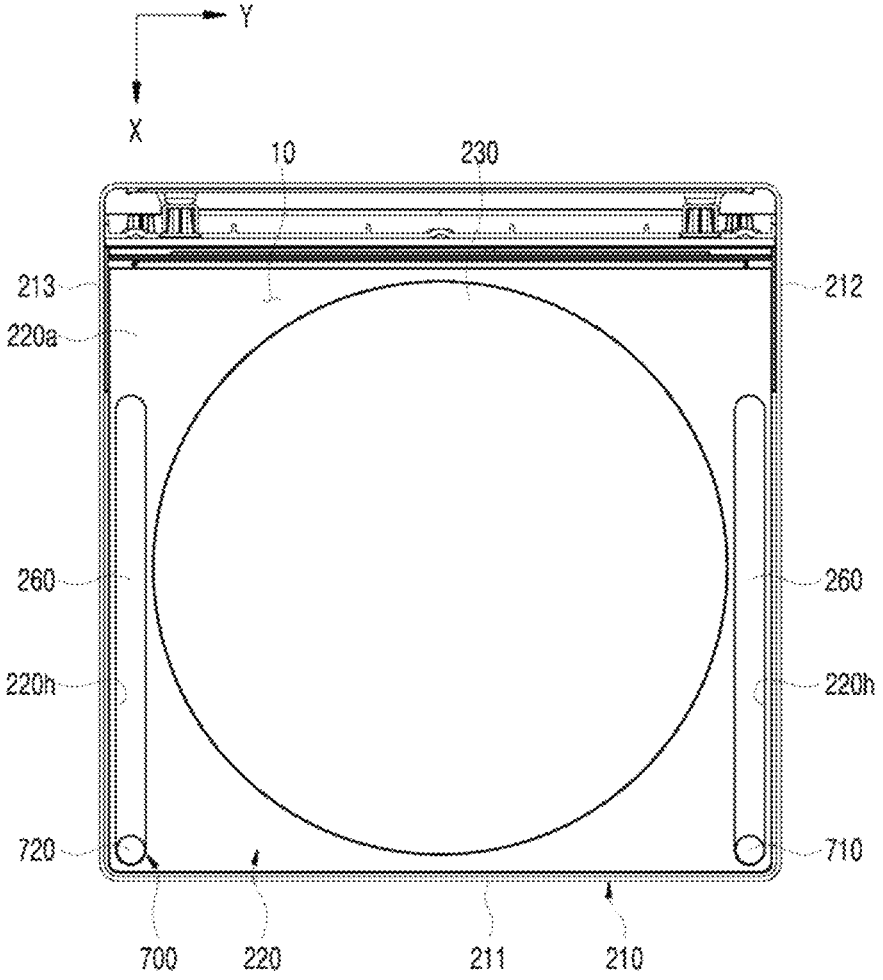
FIG. 40*a* is a plan cross-sectional view illustrating a closed state of the shoe care device according to the embodiment of the present invention.

FIG. 40*a* is a plan cross-sectional view illustrating a closed state of the shoe care device 3 according to the embodiment of the present invention.

Figure 40B:
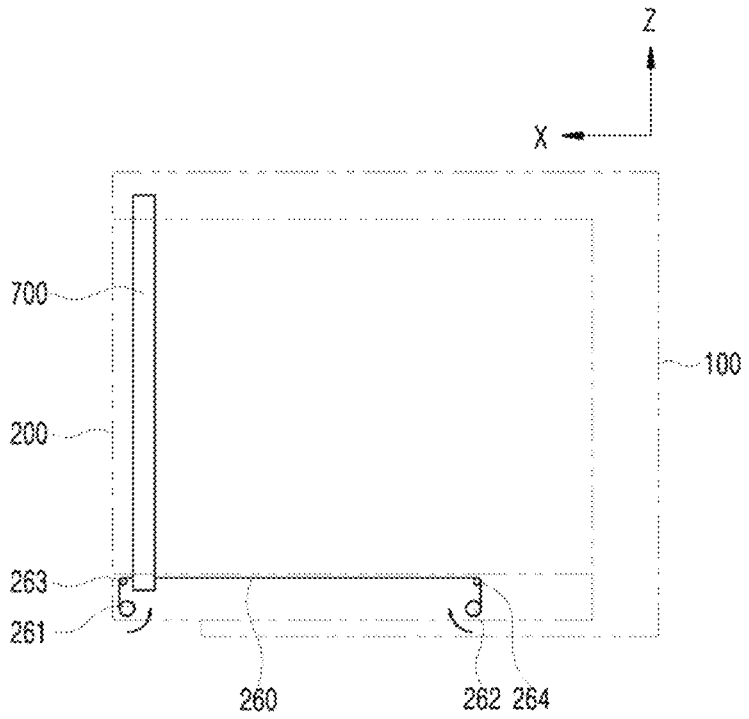
FIG. 40*b* as a side perspective view illustrating the closed state of the shoe care device according to the embodiment of the present invention is a diagram illustrating the front frame and a rolling screen.

FIG. 40*b* as a side perspective view illustrating the closed state of the shoe care device 3 according to the embodiment of the present invention is a diagram illustrating the front frame 700 and a rolling screen 260.

Figure 40C:
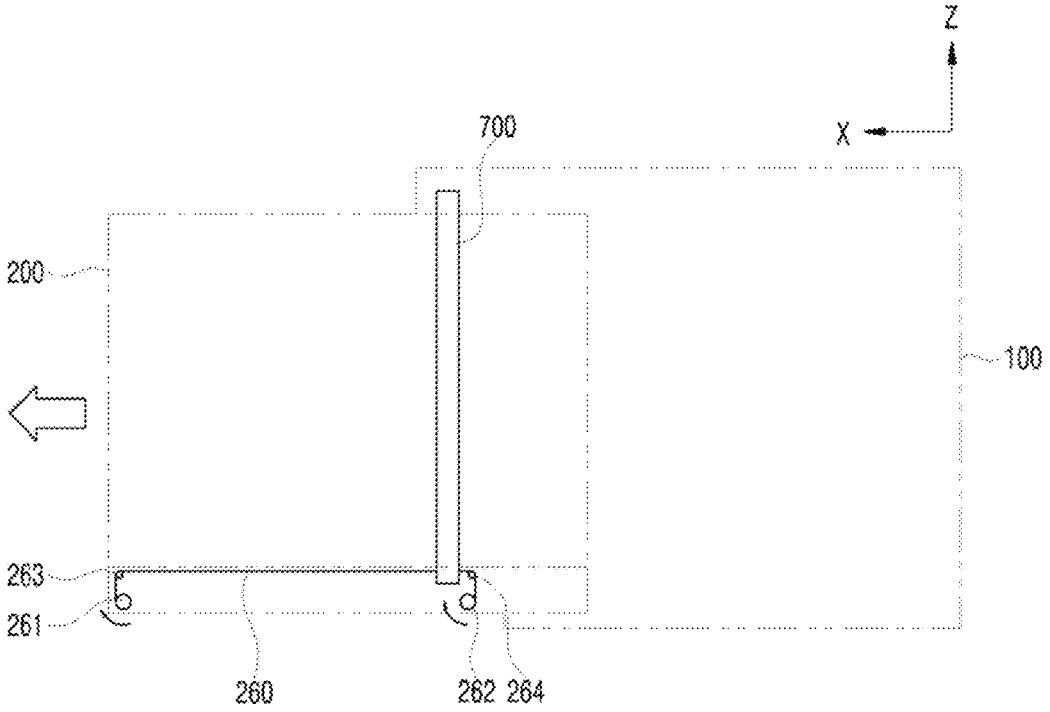
FIG. 40*c* is a side perspective view illustrating the opened state of the shoe care device according to the embodiment of the present invention is a diagram illustrating the front frame and the rolling screen.

FIG. 40*c* is a side perspective view illustrating the opened state of the shoe care device 3 according to the embodiment of the present invention is a diagram illustrating the front frame 700 and the rolling screen 260.

In the shoe care device 3 according to the embodiment of the present invention, the moving body 200 may include the rolling screen 260 (instead of the flip cover 250 and the elastic member 257), a first clockwork 261, and a second clockwork 262. The rolling screen 260, the first clockwork 261, and the second clockwork 262 may be provided below the flow portion hole 220*h*.

The rolling screen 260 may have a band shape which is long in one direction. The rolling screen 260 may be manufactured by a flexible resin material. The rolling screen 260 may cover the flow portion hole 220*h* below the flow portion hole 220*h*. That is, the rolling screen 260 may be provided to be long in the front and rear direction below the flow portion hole 220*h*. The rolling screen 260 may be coupled to the front frame 700. As an example, a hole into which the front frame 700 is insertable may be formed in the rolling screen 260, and the front frame 700 and the rolling screen 260 may be bonded (adhered, fused, etc.) while the lower portion of the front frame 700 is inserted into the hole.

A front part of the rolling screen 260 may be turned through a first middle pin 263 and wound on the first clockwork 261. A rear part of the rolling screen 260 may be turned through a second middle pin 264 and wound on the second clockwork 262.

The first clockwork 261 may wind the rolling screen 260 at the front of the flow portion hole 220*h*. The first clockwork 261 may wind the rolling screen 260 at the front of the flow portion hole 220*h* by elastic restoration force of a spiral spring.

The second clockwork 262 may wind the rolling screen 260 at the rear of the flow portion hole 220*h*. The second clockwork 262 may wind the rolling screen 260 at the rear of the flow portion hole 220*h* by the elastic restoration force of the spiral spring.

The rolling screen 260 may maintain a tightly stretched state below the flow portion hole 220*h* by the elastic restoration force of the first clockwork 261 and the second clockwork 262. Therefore, the rolling screen 260 may cover the flow portion hole 220*h* below the flow portion hole 220*h*.

In the shoe care device 3 according to the embodiment of the present invention, the rolling screen 260 may continuously maintain the state of covering the flow portion hole 220*h* between the first location and the second location. Therefore, the environment of the accommodation space 10 may be constantly maintained in the state of accommodating the shoes. Further, the aesthetics reduction of the shoe care device 3 by the exposure of the top of the lower body 110 may be prevented.

Figure 41A:
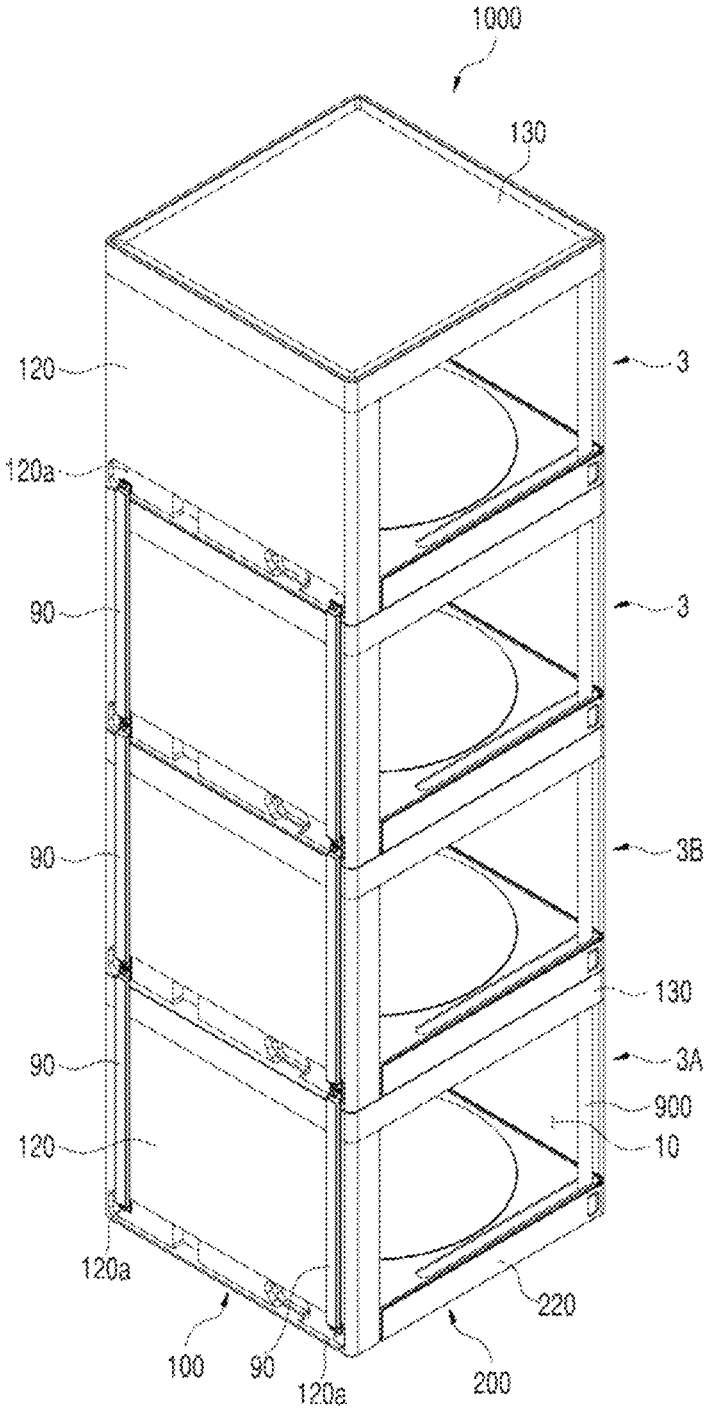
FIG. 41*a* is a perspective view illustrating a shoe care device assembly according to an embodiment of the present invention.

FIG. 41*a* is a perspective view illustrating a shoe care device assembly 1000 according to an embodiment of the present invention.

Figure 41B:
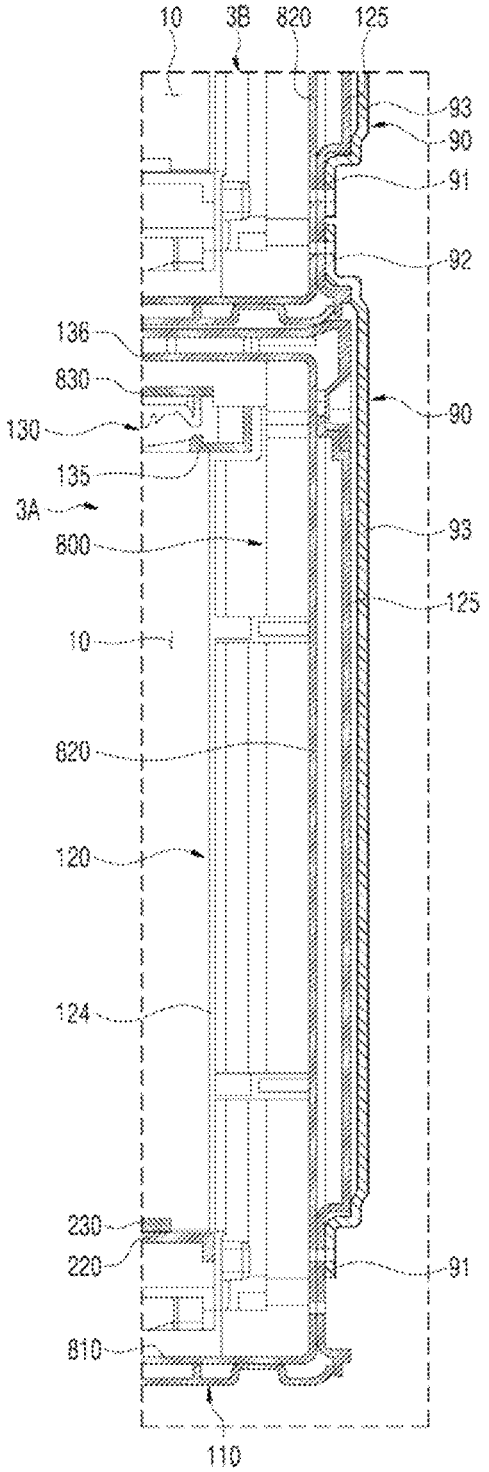
FIG. 41*b* is a partial side cross-sectional view of the shoe care device assembly of FIG. 41*a*.
Figure 41C:
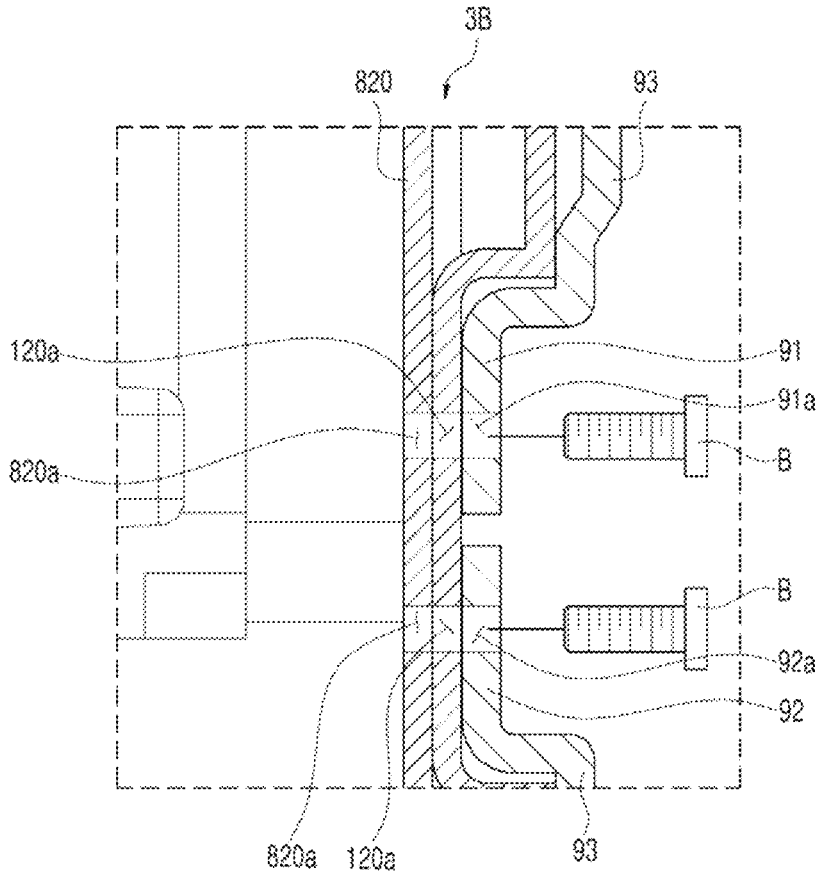
FIG. 41*c* is a partial enlarged diagram of FIG. 41*b*.

FIG. 41*b* is a partial side cross-sectional view of the shoe care device assembly 1000 of FIG. 41*a*. FIG. 41*c* is a partial enlarged diagram of FIG. 41*b*.

When a plurality of shoe care devices 3 is provided, any one shoe care device 3 may be placed on the upper surface of the upper body 130 of the other one shoe care device 3, and both the shoe care devices 3 may be stacked on each other. When the plurality of shoe care devices 3 are stacked on each other, the drooping phenomenon of the upper body 130 may be rapidly progressed by the loads of one or more shoe care devices 3 which are stacked at the upper portion.

The shoe care device assembly 1000 according to an embodiment of the present invention may include a first shoe care device 1A, a second shoe care device 1B, and a rear bracket 90.

The second shoe care device 1B may mean the shoe care devices 3 stacked on the top of the first shoe care device 1A. That is, the first shoe care device 1A and the second shoe care device 1B may be classification of the shoe care devices 3 according to a stacking order.

A pair of female screw holes 820*a* may be formed in the middle frame 820. A pair of female screw holes 820*a* may be spaced apart from each other in the vertical direction. Any one of a pair of female screw holes 820 may be positioned above the other one.

A pair of through holes 120*a* may be formed on the rear surface of the middle body. A pair of through holes 120*a* may be spaced apart from each other in the vertical direction. Any one (hereinafter, referred to as 'first through hole') of a pair of through holes 120*a* may be positioned above the other one (hereinafter, 'second through hole').

The rear bracket 90 may connect rear surfaces of the first shoe care device 1A and the second shoe care device 1B. The rear bracket 90 may be manufactured by bending one member which is formed to extend in the longitudinal direction. The rear bracket 90 may include a first coupling portion 91, a second coupling portion 92, and a rear connection portion 93.

The first coupling portion 91 may have the flat plate shape. A first hole 91*a* may be formed in the first coupling portion 91. The bolt B may be screw-coupled to the female screw hole 820*a* by passing through the first hole 91*a* and the first through hole 120*a*. As a result, the first coupling portion 91 may be coupled to the rear surface of the first shoe care device 1A.

The second coupling portion 92 may have the flat plate shape. A second hole 92*a* may be formed in the second coupling portion 92. The bolt B may be screw-coupled to the female screw hole 820*a* by passing through the second hole 92*a* and the second through hole 120*a*. As a result, the second coupling portion 92 may be coupled to the rear surface of the second shoe care device 1B.

The rear connection portion 93 may connect the first coupling portion 91 and the second coupling portion 92. The rear connection portion 93 may be formed by bending one member which is formed to extend in the vertical direction. Therefore, the rear connection portion 93 may have a rigidity resistant to bending deformation and torsional deformation.

In the shoe care device assembly 1000 according to the embodiment, since the rear bracket 90 including the first coupling portion 91, the second coupling portion 92, and the rear connection portion 93 is formed by bending one member which is formed to extend in the longitudinal direction, the rear bracket 90 may be easily manufactured, and a cutting surface of the rear bracket 90 corresponding to a reinforcing member may be minimized.

In the shoe care device assembly 1000 according to the embodiment, the rear bracket 90 may be placed on the rear surface of the body 100. Since the rear bracket 90 is placed not to be observed at the front of the transparent window 210, the aesthetics may be visually provided by minimizing the exposure of a member not directly related to the function of the shoe care device 3.

The rear bracket 90 may include a first rear bracket 90 and a second rear bracket 90. The first rear bracket 90 may connect the first shoe care device 1A and the second shoe care device 1B on the left rear surface of the body 100. The second rear bracket 90 may connect the first shoe care device 1A and the second shoe care device 1B on the right rear surface of the body 100. Therefore, a rear corner portion of the second care device 1B may have the same height as the rear surface of the first shoe care device 1A.

Therefore, the first shoe care device 1A and the second shoe care device 1B continuously maintain a height difference on the bottom view, and as a result, the aesthetics reduction of the shoe care device 3 by the drooping phenomenon of the upper body 130 may be prevented. Further, the increase in opening force of the moving body 200 by the drooping of the upper body 130 is interrupted, so the moving body 200 may continuously maintain the same opening force between the first location (see FIG. 30*a*) and the second location (see FIG. 31*a*).

Hereinabove, a specific embodiment of the present invention is described and illustrated, but the present invention is not limited to the disclosed embodiment, and it may be appreciated by those skilled in the art that the embodiment can be variously modified and transformed to another specific embodiment without departing from the spirit and the scope of the present invention. Therefore, the scope of the present invention will not be defined by the described embodiment, but defined by the technical spirit disclosed in the claims.

INDUSTRIAL APPLICABILITY

According to an embodiment of the present invention, a frame body can be coupled to the body in a shape of connecting an upper surface, a lower surface, and a rear surface of the body to support the body, the shoe care device can maintain a stable state by reinforcing a structurally vulnerable part in the body.

The invention claimed is:

1. A shoe care device comprising:

an accommodation space to accommodate shoes therein;

a first body;

a second body, the second body being slidably coupled to the first body to move between a first position and a second position, the first body and the second body defining the accommodation space when the second body is in the first position;

a blower configured to circulate air in the accommodation space; and a frame body coupled to the first body to support the first body, wherein the first body includes:

an upper body defining a top of the accommodation space;

a lower body positioned below the accommodation space; and a middle body defining a rear surface of the accommodation space, the middle body connecting rear sides of the upper body and the lower body, wherein the frame body includes:

an upper frame coupled to the upper body;

a lower frame coupled to the lower body; and a middle frame that connects the rear sides of the upper frame and the lower frame and is coupled to the middle body, and wherein the upper frame, the lower frame, and the middle frame are formed by bending a single piece member.

2. The shoe care device of claim 1, wherein the second body includes:

a base slidably coupled to the lower body; and a transparent window extending upward from an upper portion of the base, the transparent window defining a front surface of the accommodation space, a first side surface of the accommodation space, and a second side surface of the accommodation space opposite the first side surface of the accommodation space.

3. The shoe care device of claim 1, wherein the single piece member is a C-shaped channel steel having a web portion and a pair of flanges extending from the web portion, and wherein the pair of flanges are cut to define bending locations in the single piece member to define the upper frame, the lower frame, and the middle frame.

4. The shoe care device of claim 3, further comprising a fastening member inserted through overlapping flange portions at each of the bending locations after bending the web portion.

5. The shoe care device of claim 3, wherein overlapping flange portions at each of the bending locations in the upper frame, the lower frame, and the middle frame are coupled by welding.

6. The shoe care device of claim 1, wherein a location where the upper frame is coupled to the upper body is positioned forward of a location where the lower frame is coupled to the lower body.

7. The shoe care device of claim 1, wherein a vertical length of the upper frame is greater than a horizontal width of the upper frame.

8. The shoe care device of claim 1, wherein a horizontal width of the middle frame is greater than a horizontal width of the upper frame.

9. The shoe care device of claim 1, wherein the upper frame includes:

an upper extension portion extending in a front and rear direction; and an upper connection portion connecting a rear side of the upper extension portion to the middle body, a vertical length of the upper connection portion increases in a rearward direction.

10. The shoe care device of claim 9, wherein a vertical length of the upper connection portion increases while extending downward in a rearward direction.

11. The shoe care device of claim 1, wherein the lower frame includes:

a lower extension portion extending in a front and rear direction; and a lower connection portion connecting a rear side of the lower extension portion to the middle body, a vertical length of the lower connection portion increases in a rearward direction.

12. The shoe care device of claim 11, wherein the vertical length of the lower connection portion increases while extending upward in a rearward direction.

13. The shoe care device of claim 1, wherein the upper frame extends further forward than the lower frame.

14. The shoe care device of claim 1, wherein the frame body is located inside the first body.

15. The shoe care device of claim 1, wherein the frame body is provided as a plurality of frame bodies spaced apart in the first body.

16. The shoe care device of claim 1, wherein the first body further includes a front frame connecting the lower body and the upper body at a front of the first body.

17. The shoe care device of claim 16, wherein the second body further includes a transparent window having:

a first window defining a front surface of the accommodation space;

a second window defining a left surface of the accommodation space; and a third window defining a right surface of the accommodation space, and wherein the front frame includes:

a first front frame positioned at a shortest distance from a corner portion where the first window and the second window meet at the first position; and a second front frame positioned at a shortest distance from a corner portion where the first window and the third window meet at the first position.

18. The shoe care device of claim 17, wherein the second body includes a base coupled to the lower side of the transparent window, the base including a first flow portion hole through which the first front frame extends in a vertical direction, and a second flow portion hole through which the second front frame extends in the vertical direction.

* * * * *